US007306900B2

(12) United States Patent
Yokota

(10) Patent No.: US 7,306,900 B2
(45) Date of Patent: Dec. 11, 2007

(54) SILVER HALIDE COLOR PHOTOSENSITIVE MATERIAL

(75) Inventor: Koichi Yokota, Minamiashigara (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 11/529,522

(22) Filed: Sep. 29, 2006

(65) Prior Publication Data

US 2007/0077527 A1 Apr. 5, 2007

(30) Foreign Application Priority Data

Sep. 30, 2005 (JP) ..... 2005-286065

(51) Int. Cl.
*G03C 1/38* (2006.01)
*G03C 1/295* (2006.01)
*G03C 1/85* (2006.01)

(52) U.S. Cl. ..... 430/528; 430/527; 430/529; 430/599; 430/600; 430/603; 430/631; 430/635; 430/636

(58) Field of Classification Search ..... 430/527, 430/528, 529, 599, 600, 603, 631, 635, 636
See application file for complete search history.

(56) References Cited

U.S. PATENT DOCUMENTS 6,689,554 B2 * 2/2004 Yamada et al. ..... 430/600
6,844,146 B2 * 1/2005 Hosokawa et al. ..... 430/566
6,911,302 B2 * 6/2005 Moon et al. ..... 430/528
2003/0148232 A1 * 8/2003 Orem et al. ..... 430/527
2005/0069824 A1 * 3/2005 Ninomiya et al. ..... 430/502
2005/0106513 A1 * 5/2005 Matsunaga et al. ..... 430/554

* cited by examiner

*Primary Examiner*—Richard L. Schilling
(74) *Attorney, Agent, or Firm*—Sughrue Mion, PLLC

(57) ABSTRACT

A silver halide color photosensitive material comprising at least one layer containing at least one compound selected from a group consisting of the following type 1 and type 2, and at least one layer containing at least one fluorine compound represented by the following general formula (A):

(Type 1)
Compound which undergoes a one-electron oxidation so as to form a one-electron oxidation product capable of, through subsequent bond cleavage reaction, releasing one or more electrons;

(Type 2)
Compound which undergoes a one-electron oxidation so as to form a one-electron oxidation product capable of, after subsequent bond formation reaction, releasing one or more electrons;

Rf–X–M: General formula (A)

wherein Rf represents an alkyl group having 1 to 6 carbons which is substituted with at least one fluorine atom, X represents a divalent coupling group or a single bond, and M represents an anionic group, a cationic group or a betaine group.

6 Claims, No Drawings

SILVER HALIDE COLOR PHOTOSENSITIVE MATERIAL

CROSS-REFERENCE TO RELATED APPLICATIONS

This application is based upon and claims the benefit of priority from prior Japanese Patent Application No. 2005-286065, filed Sep. 30, 2005, the entire contents of which are incorporated herein by reference.

BACKGROUND OF THE INVENTION

1. Field of the Invention

The present invention relates to a silver halide photosensitive material, and more specifically, relates to a silver halide color photosensitive material with high sensitivity and having little processing variation and improved in antistatic property and high-speed coating adoptability with little radiation fog.

2. Description of the Related Art

A demand for a silver halide color photosensitive material beco severe year by year, and high sensitivity and high image quality have been desired. In order for enhancement in sensitivity of a photosensitive material, it becomes the common practice in the art that the size of silver halide emulsion grains being photosensitive elements is increased. However, when the size of silver halide emulsion grains is increased, the number of silver halide emulsion grains is inevitably decreased so far as the content of silver halide emulsion is constant, namely, it has a defect that the number of development initiation points is decreased and the granularity is reduced. Namely, the larger the silver halide emulsion grains are, not only the more the sensitivity is improved, but also the more the granularity is deteriorated. Consequently, it is an important subject to achieve sensitivity enhancement without impairing the granularity.

In the light of the defect, when a design for increasing the number of silver halide grains per unit area is adopted, namely, when the amount of silver halide to be applied to the photosensitive material is increased, the deterioration of photographic properties occurs between manufacture and the use of the photosensitive material. Namely, fog is increased, sensitivity is lowered, granularity is deteriorated, and the diffraction of light is increased, so that the deterioration of sharpness occurs. It is the most basic and important subject in the art for improving the image quality of the photosensitive material that the sensitivity is increased without deteriorating the granularity.

Recently, a compound called "one photon two electrons sensitizer" (for example, refer to U.S. Pat. Nos. 5,747,235 and 5,747,236) and a compound called "a sensitizer capable of releasing three or more electrons per photon" (for example, refer to Jpn. Pat. Appln. KOKAI Publication No. (hereinafter referred to as JP-A-)2003-114487, JP-A-2003-114488 and JP-A-2003-114486) have been disclosed as partial solution for the above-described problems, and the sensitivity enhancement effect of releasing two or more electrons per photon can be obtained.

However, although the increase in the sensitivity is observed by the above-described method, its effect is not adequate. Further, an unwanted exposure trace called a static mark is occasionally generated in the photosensitive material using the above-described method and moreover, new problems of high-speed coating adaptability and the deterioration of storage stability of the photosensitive material become obvious.

The photosensitive material is brought in contact with various substances during production, photographing and development processing. For example, when the photosensitive material is in a wound-up state in the processing step, a surface layer is occasionally brought in contact with a back layer formed on the rear surface of a support. Further, the surface layer is occasionally brought in contact with stainless, a rubber roller and the like during delivery in the processing step. When the surface layer is brought in contact with these materials, the surface (a gelatin layer) of the photosensitive material is positively charged easily, and unnecessary electric discharge occurs in some cases. For this reason, an undesirable exposure trace (static mark) remains on the photosensitive material. In order to reduce the charging property of the gelatin, a compound having a fluorine atom is effective and the addition of a fluorine base surfactant is often carried out (for example, refer to JP-A's-60-128434, 3-95550 and 4-248543)

A surfactant having a fluorinated alkyl chain can carry out various surface modifications by the properties (water repellent property and oil repellent property, lubricity, antistatic property and the like) peculiar to the fluorinated alkyl chain, and is used for the surface processing of various substrates including a textile, a cloth, a carpet and a resin. When the surfactant having a fluorinated alkyl chain (hereinafter, referred to as fluorine base surfactant) is added to an aqueous medium solution of various substrates, not only a uniform film having no cissing can be formed during coating formation, but also a surfactant adsorption layer can be formed on the surface of a matrix, and the properties peculiar to the fluorinated alkyl chain can be imparted on the surface of a film. The cissing means a phenomenon in which circular or streak uncoated portions are generated due to agglomerates generated by adding various compounds to a protective layer coating solution at the production stage.

Various surfactants are also used in the photosensitive material and play an important role. The photosensitive material is usually prepared by individually coating a plurality of coating solutions containing an aqueous solution of hydrophilic colloid binder (for example, gelatin) on a support to form a plurality of layers. A plurality of hydrophilic colloid layers are often coated simultaneously at multilayers. These layers include an antistatic layer, an under-coat layer, an antihalation layer, a silver halide emulsion layer, an intermediate layer, a filter layer and a protective layer, and various materials for expressing various functions are added to respective layers. In addition, polymer latex is occasionally contained in the hydrophilic colloid layer for improving the physical properties of the film. Further, in order to allow the hydrophilic colloid layer to contain functional compounds, such as a color coupler, an ultraviolet absorbent, an optical brightener, and a slipping agent, which are hardly soluble in water, these materials are emulsified to be dispersed as they are, or in a state in which they are dissolved in high-boiling organic solvents such as a phosphate base compound and a phthalate base compound, and are used for preparation of the coating solution in some cases. Thus, the photosensitive material is composed of various hydrophilic colloid layers in general, and it is required at its production that the coating solution containing various materials is uniformly coated at high speed without defects such as cissing and coating unevenness.

Most of fluorine base surfactants which are particularly effective for adjusting the charging property of a photosensitive material and can be most easily available have been hitherto those having a perfluorinated octyl group. Further, many of them are perfluorooctyl sulfonate which is their inherent mode, or have a structure which can be decomposed to a perfluorooctyl sulfonate compound. It has been found from recent reports that the perfluorooctyl sulfonate is possibly accumulated in the blood system of human and animals and high-level administration for a long period is toxic for experimental animals.

Consequently, there is a growing interest in discovering an alternative surfactant which does not exhibit these properties. Desirable are fluorine base surfactants which are not decomposed to perfluorooctyl sulfonate and are not accumulated less in the blood system of animals than perfluorooctyl sulfonate.

As part of solution for the problem, a telomere forming compound having a $CF_3(CF_2)_x$—$CH_2$—$CH_2$— group cannot be decomposed to perfluorooctyl sulfonate.

It has been cleared from quantitative structural activity correlation analysis based on computer soft ware available from SRC (Syracuse Research Corporation) that the risk of in-vivo accumulation of the fluorine base surfactant having a telomere forming fluoroalkyl group, in particular, a group having 6 fluorinated carbons or less (and an ethylene group directly bonded thereof) is little, and a method of adjusting charging properties is disclosed (for example, refer to U.S. Pat. Nos. 6,232,058 and 5,837,440 and JP-A-2003-156819).

Further, the fluorine base surfactant used for the uppermost layer of the photosensitive material must be good in solubility to the coating solution of the uppermost layer and control charging without exerting a harmful influence on the uniform coating of the uppermost layer or lower image forming layer.

An additional requirement is that the surfactant of the uppermost protective layer must not adversely affect the photographic properties of the lower image forming layer.

Thus, the surfactant, in particular, the fluorine base surfactant is used as a coating aid for imparting the uniformity of a coated film or a material having a function of imparting the antistatic property of the photosensitive material.

However, these materials have not always satisfactory performance for the requisites of having the preferable charge property of the recent photosensitive material and further having processing stability and the resistance for radiation fog.

BRIEF SUMMARY OF THE INVENTION

It is an object of the present invention to provide a silver halide color photosensitive material excellent in high sensitivity and antistatic property and improving static resistance. Further, it is another object of the present invention to provide a silver halide color photosensitive material having an improved high-speed coating adoptability, processing stability and radiation resistance.

The present inventors made extensive studies to achieve the above objects and have found that the silver halide color photosensitive materials having the following arrangements have excellent antistatic property, high-speed coating adoptability, processing stability and radiation resistance, thereby completing the present invention.

(1) A silver halide color photosensitive material comprising a support and, superimposed thereon, at least one red-sensitive layer, at least one green-sensitive layer, at least one blue-sensitive layer and at least one protective layer, at least one of the layers containing at least one compound selected from a group consisting of the following type 1 and type 2, and at least one of the layers containing at least one fluorine compound represented by the following general formula (A):

(Type 1)

Compound which undergoes a one-electron oxidation so as to form a one-electron oxidation product capable of, through subsequent bond cleavage reaction, releasing one or more electrons;

(Type 2)

Compound which undergoes a one-electron oxidation so as to form a one-electron oxidation product capable of, after subsequent bond formation reaction, releasing one or more electrons;

Rf—X-M General formula (A):

wherein Rf represents an alkyl group having 1 to 6 carbons which is substituted with at least one fluorine atom; X represents a divalent coupling group or a single bond; and M represents an anionic group, a cationic group or a betaine group.

(2) The silver halide color photosensitive material according to item (1) above, wherein the total amount of silver contained in the photosensitive material is 7.5 $mg/m^2$ or less.

(3) The silver halide color photosensitive material according to item (1) above, wherein the total amount of silver contained in the photosensitive material is 5.5 $mg/m^2$ or less.

(4) A silver halide color photosensitive material comprising a support and, superimposed on one side thereof, at least one red-sensitive layer, at least one green-sensitive layer, at least one blue-sensitive layer and at least one protective layer, at least one of the layers containing at least one compound selected from a group consisting of the following type 1 and type 2, and at least one of the layers containing at least one fluorine compound represented by the following general formula (A), and an antistatic layer being applied on the other side of the support:

(Type 1)

Compound which undergoes a one-electron oxidation so as to form a one-electron oxidation product capable of, through subsequent bond cleavage reaction, releasing one or more electrons;

(Type 2)

Compound which undergoes a one-electron oxidation so as to form a one-electron oxidation product capable of, after subsequent bond formation reaction, releasing one or more electrons;

Rf—X-M General formula (A):

wherein Rf represents an alkyl group having 1 to 6 carbons which is substituted with at least one fluorine atom; X represents a divalent coupling group or a single bond; and M represents an anionic group, a cationic group or a betaine group.

(5) The silver halide color photosensitive material according to item (4) above, wherein the total amount of silver contained in the photosensitive material is 7.5 $mg/m^2$ or less.

(6) The silver halide color photosensitive material according to item (4) above, wherein the total amount of silver contained in the photosensitive material is 5.5 $mg/m^2$ or less.

DETAILED DESCRIPTION OF THE INVENTION

The present invention will be described in detail below.

First, the compounds of type 1 and type 2 contained in the silver halide color photosensitive material of the present invention will be described below.

(Type 1)

Compound which undergoes a one-electron oxidation so as to form a one-electron oxidation product capable of, through subsequent bond cleavage reaction, releasing one or more electrons.

(Type 2)

Compound which undergoes a one-electron oxidation so as to form a one-electron oxidation product capable of, after subsequent bond formation reaction, releasing one or more electrons.

First, the compound of type 1 will be described.

With respect to the compound of type 1, as the compound which undergoes a one-electron oxidation so as to form a one-electron oxidation product capable of, through subsequent bond cleavage reaction, releasing one electron, there can be mentioned compounds referred to as "one photon two electrons sensitizers" or "deprotonating electron donating sensitizers", as described in, for example, JP-A-9-211769 (examples: compounds PMT-1 to S-37 listed in Tables E and F on pages 28 to 32), JP-A-9-211774, JP-A-11-95355 (examples: compounds INV 1 to 36), PCT Japanese Translation Publication 2001-500996 (examples: compounds 1 to 74, 80 to 87 and 92 to 122), U.S. Pat. Nos. 5,747,235 and 5,747,236, EP 786692A1 (examples: compounds INV 1 to 35), EP 893732A1 and U.S. Pat. Nos. 6,054,260 and 5,994,051. Preferred ranges of these compounds are the same as described in the cited patent specifications.

With respect to the compound of type 1, as the compound which undergoes a one-electron oxidation so as to form a one-electron oxidation product capable of, through subsequent bond cleavage reaction, releasing one or more electrons, there can be mentioned compounds of the general formula (1) (identical with the general formula (1) described in JP-A-2003-114487), the general formula (2) (identical with the general formula (2) described in JP-A-2003-114487), the general formula (3) (identical with the general formula (3) described in JP-A-2003-114487), the general formula (3) (identical with the general formula (1) described in JP-A-2003-114488), the general formula (4) (identical with the general formula (2) described in JP-A-2003-114488), the general formula (5) (identical with the general formula (3) described in JP-A-2003-114488), the general formula (6) (identical with the general formula (1) described in JP-A-2003-75950), the general formula (8) (identical with the general formula (1) described in JP-A-2004-239943) and the general formula (9) (identical with the general formula (3) described in JP-A-2004-245929) among the compounds of inducing the reaction represented by the chemical reaction formula (1) (identical with the chemical reaction formula (1) described in JP-A-2004-245929). Preferred ranges of these compounds are the same as described in the cited patent specifications.

General formula (1)

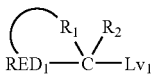

General formula (2)

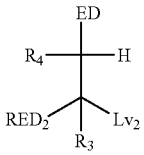

In the general formulae (1) and (2), each of $RED_1$ and $RED_2$ represents a reducing group. $R_1$ represents a nonmetallic atom group capable of forming a cyclic structure corresponding to a tetrahydro form or hexahydro form of 5-membered or 6-membered aromatic ring (including aromatic heterocycle) in cooperation with carbon atom (C) and $RED_1$. Each of $R_2$, $R_3$ and $R_4$ represents a hydrogen atom or a substituent. Each of $L_{v1}$ and $L_{v2}$ represents a split off group. ED represents an electron donating group.

General formula (3)

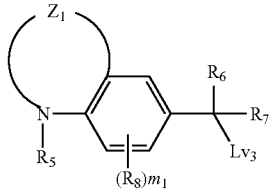

General formula (4)

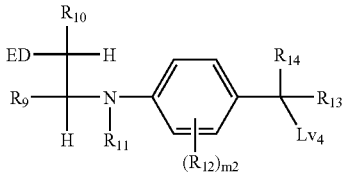

General formula (5)

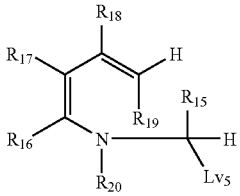

In the general formulae (3), (4) and (5), $Z_1$ represents an atomic group capable of forming a 6-membered ring in cooperation with a nitrogen atom and two carbon atoms of benzene ring. Each of $R_5$, $R_6$, $R_7$, $R_9$, $R_{10}$, $R_{11}$, $R_{13}$, $R_{14}$, $R_{15}$, $R_{16}$, $R_{17}$, $R_{18}$ and $R_{19}$ represents a hydrogen atom or a substituent. $R_{20}$ represents a hydrogen atom or a substituent, provided that when $R_{20}$ represents a non-aryl group, $R_{16}$ and $R_{17}$ are bonded to each other to thereby form an aromatic ring or aromatic heterocycle. Each of $R_8$ and $R_{12}$ represents a substituent capable of substitution on benzene ring. $m_1$ is an integer of 0 to 3. $m_2$ is an integer of 0 to 4. Each of $L_{v3}$, $L_{v4}$ and $L_{v5}$ represents a split off group. ED represents an electron donating group.

General formula (6)

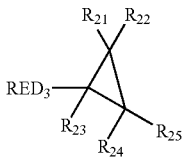

General formula (7)

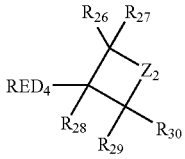

In the general formulae (6) and (7), each of $RED_3$ and $RED_4$ represents a reducing group. Each of $R_{21}$ to $R_{30}$ represents a hydrogen atom or a substituent. $Z_2$ represents —$CR_{111}R_{112}$—, —$NR_{113}$— or —O—. Each of $R_{111}$ and $R_{112}$ independently represents a hydrogen atom or a substituent. $R_{113}$ represents a hydrogen atom, an alkyl group, an aryl group or a heterocyclic group.

General formula (8)

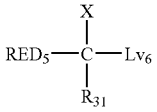

In the general formula (8), $RED_5$ is a reducing group, representing an arylamino group or a heterocyclic amino group. $R_{31}$ represents a hydrogen atom or a substituent. X represents an alkoxy group, an aryloxy group, a heterocyclic oxy group, an alkylthio group, an arylthio group, a heterocyclic thio group, an alkylamino group, an arylamino group or a heterocyclic amino group. $L_{v6}$ is a split off group, representing carboxyl or its salt or a hydrogen atom.

Chemical reaction formula (1)

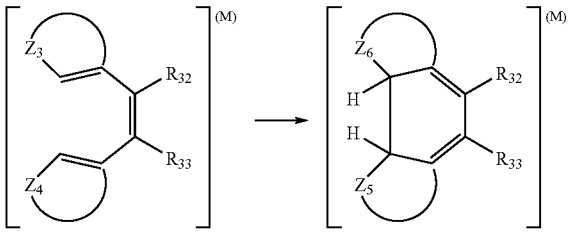

General formula (9)

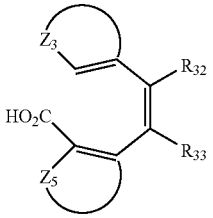

The compound represented by the general formula (9) is one which undergoes a two-electron oxidation accompanied by decarbonation and is further oxidized to thereby effect a bond forming reaction of chemical reaction formula (1). In the chemical reaction formula (1), each of $R_{32}$ and $R_{33}$ represents a hydrogen atom or a substituent. $Z_3$ represents a group capable of forming a 5- or 6-membered heterocyclic ring in cooperation with C═C. $Z_4$ represents a group capable of forming a 5- or 6-membered aryl group or heterocyclic ring in cooperation with C═C. Each of $Z_5$ and $Z_6$ represents a group capable of forming a 5- or 6-membered cycloaliphatic hydrocarbon group or heterocyclic ring in cooperation with C—C. M represents a radical, a radical cation or a cation. In the general formula (9), $R_{32}$, $R_{33}$, $Z_3$ and $Z_5$ have the same meaning as in the chemical reaction formula (1).

Now, the compounds of type 2 will be described.

As the compounds of type 2, namely, compounds which undergo a one-electron oxidation so as to form a one-electron oxidation product capable of, through subsequent bond formation reaction, releasing one or more electrons, there can be mentioned compounds of the general formula (10) (identical with the general formula (1) described in JP-A-2003-140287) and compounds of the general formula (11) (identical with the general formula (2) described in JP-A-2004-245929) capable of inducing the reaction represented by the chemical reaction formula (1) (identical with the chemical reaction formula (1) described in JP-A-2004-245929). Further, the type (2) compound also includes an organic compound which generates a (n+m)-valent cation from an n-valent cation radical described in JP-A-2003-121954 and the like, accompanied with an intramolecular cyclization reaction (provided that each of n and m represents independently an integer of 1 or more). Preferred ranges of these compounds are the same as described in the cited patent specifications.

$RED_6$-Q-Y General formula (10)

In the general formula (10), $RED_6$ represents a reducing group which undergoes a one-electron oxidation. Y represents a reactive group containing carbon to carbon double bond moiety, carbon to carbon triple bond moiety, aromatic group moiety or nonaromatic heterocyclic moiety of benzo condensation ring capable of reacting with a one-electron oxidation product formed by a one-electron oxidation of $RED_6$ to thereby form a new bond. Q represents a linking group capable of linking $RED_6$ with Y.

Chemical reaction formula (1)

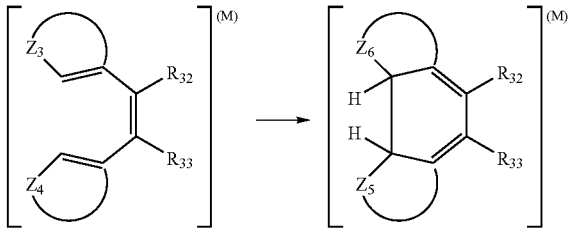

General formula (11)

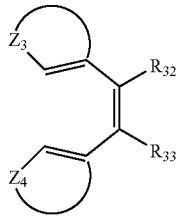

The compound represented by the general formula (11) is one oxidized to thereby effect a bond forming reaction of chemical reaction formula (1). In the chemical reaction formula (1), each of $R_{32}$ and $R_{33}$ represents a hydrogen atom or a substituent. $Z_3$ represents a group capable of forming a 5- or 6-membered heterocyclic ring in cooperation with C═C. $Z_4$ represents a group capable of forming a 5- or 6-membered aryl group or heterocyclic ring in cooperation with C═C. Each of $Z_5$ and $Z_6$ represents a group capable of forming a 5- or 6-membered cycloaliphatic hydrocarbon group or heterocyclic ring in cooperation with C—C. M represents a radical, a radical cation or a cation. In the general formula (11), $R_{32}$, $R_{33}$, $Z_3$ and $Z_4$ have the same meaning as in the chemical reaction formula (1).

Among the compounds of types 1 and 2, "compounds having in the molecule an adsorptive group on silver halides" and "compounds having in the molecule a partial structure of spectral sensitizing dye" are preferred. As representative examples of adsorptive groups on silver halides, there can be mentioned groups described in JP-A-2003-156823, page 16 right column line 1 to page 17 right column line 12. The partial structure of spectral sensitizing dye is as described in the same reference, page 17 right column line 34 to page 18 left column line 6.

Among the compounds of types 1 and 2, "compounds having in the molecule at least one adsorptive group on silver halides" are more preferred. "Compounds having in the same molecule two or more adsorptive groups on silver halides" are still more preferred. When two or more adsorptive groups are present in a single molecule, they may be identical with or different from each other.

As preferred adsorptive groups, there can be mentioned a mercapto-substituted nitrogenous heterocyclic group (e.g., 2-mercaptothiadiazole group, 3-mercapto-1,2,4-triazole group, 5-mercaptotetrazole group, 2-mercapto-1,3,4-oxadiazole group, 2-mercaptobenzoxazole group, 2-mercaptobenzothiazole group or 1,5-dimethyl-1,2,4-triazoium-3-thiolate group) and a nitrogenous heterocyclic group capable of forming an iminosilver (>NAg) and having —NH— as a partial structure of heterocycle (e.g., benzotriazole group, benzimidazole group or indazole group). Among these, a 5-mercaptotetrazole group, a 3-mercapto-1,2,4-triazole group and a benzotriazole group are more preferred. A 3-mercapto-1,2,4-triazole group and a 5-mercaptotetrazole group are most preferred.

An adsorptive group having two or more mercapto groups as a partial structure in the molecule is also especially preferred. The mercapto group (—SH) when tautomerizable may be in the form of a thione group. As preferred examples of adsorptive groups each having two or more mercapto groups as a partial structure (e.g., dimercapto-substituted nitrogenous heterocyclic groups), there can be mentioned a 2,4-dimercaptopyrimidine group, a 2,4-dimercaptotriazine group and a 3,5-dimercapto-1,2,4-triazole group.

Moreover, a quaternary salt structure of nitrogen or phosphorus can preferably be used as the adsorptive group. As the quaternary salt structure of nitrogen, there can be mentioned, for example, an ammonio group (such as trialkylammonio, dialkylaryl(heteroaryl)ammonio or alkyldiaryl(heteroaryl)ammonio) or a group containing a nitrogenous heterocyclic group containing a quaternarized nitrogen atom. As the quaternary salt structure of phosphorus, there can be mentioned, a phosphonio group (such as trialkylphosphonio, dialkylaryl(heteroaryl)phosphonio, alkyldiaryl(heteroaryl)phosphonio or triaryl(heteroaryl)phosphonio). Among these, the quaternary salt structure of nitrogen is more preferred. The 5- or 6-membered nitrogenous aromatic heterocyclic group containing a quaternarized nitrogen atom is still more preferred. A pyridinio group, a quinolinio group and an isoquinolinio group are most preferred. The above nitrogenous heterocyclic group containing a quaternarized nitrogen atom may have any arbitrary substituent.

As examples of counter anions to the quaternary salts, there can be mentioned a halide ion, a carboxylate ion, a sulfonate ion, a sulfate ion, aperchlorate ion, a carbonate ion, a nitrate ion, $BF_4^-$, $PF_6^-$ and $Ph_4B^-$. When in the molecule a group with negative charge is had by carboxylate, etc., an intramolecular salt may be formed therewith. A chloro ion, a bromo ion or a methanesulfonate ion is most preferred as a counter anion not present in the molecule.

Among the compounds of types 1 and 2 having the structure of quaternary salt of nitrogen or phosphorus as the adsorptive group, preferred structures can be represented by the general formula (X).

$$(P\text{-}Q_1\text{-})_i\text{-}R(\text{-}Q_2\text{-}S)_j \qquad \text{General formula (X)}$$

In the general formula (X), each of P and R independently represents the structure of quaternary salt of nitrogen or phosphorus, which is not a partial structure of sensitizing dye. Each of $Q_1$ and $Q_2$ independently represents a linking group, which may be, for example, a single bond, an alkylene group, an arylene group, a heterocyclic group, —O—, —S—, —$NR_N$—, —C(=O)—, —$SO_2$—, —SO— and —P(=O)—, these used individually or in combination. $R_N$ represents a hydrogen atom, an alkyl group, an aryl group or a heterocyclic group. S represents a residue resulting from removal of one atom from the compound of type 1 or type 2. Each of i and j is an integer of 1 or greater, provided that i+j is in the range of 2 to 6. i=1 to 3 while j=1 to 2 is preferred, i=1 or 2 while j=1 is more preferred, and i=j=1 is most preferred. With respect to the compounds represented by the general formula (X), the total number of carbon atoms thereof is preferably in the range of 10 to 100, more preferably 10 to 70, still more preferably 11 to 60, and most preferably 12 to 50.

Specific examples of compounds of type 1 and type 2 will be shown below. Naturally, they in no way limit the scope of the present invention.

1

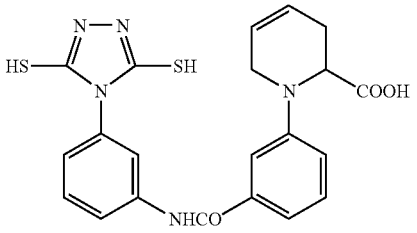

2

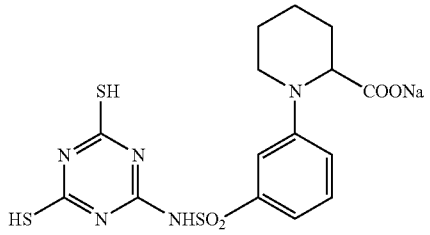

3

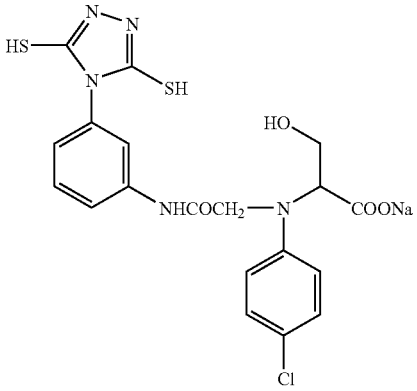

4

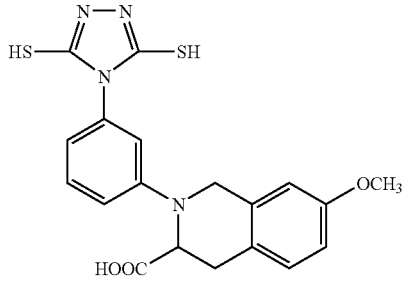

-continued
5
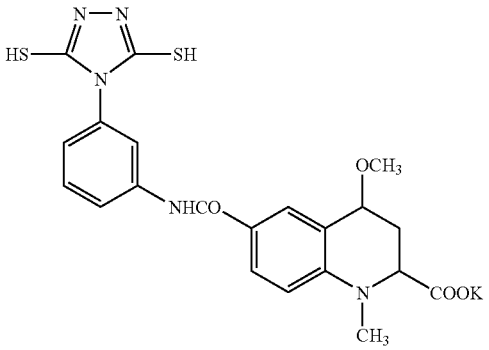
6
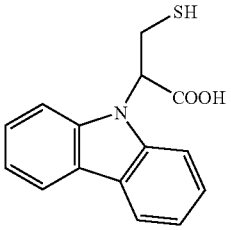
7
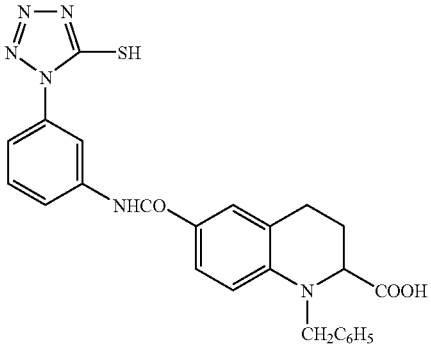
8
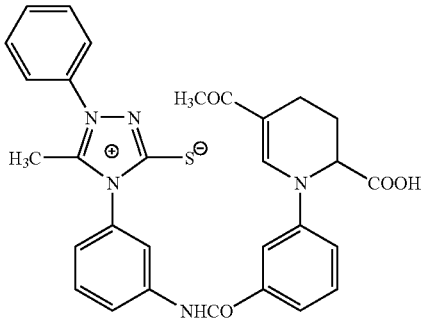
9
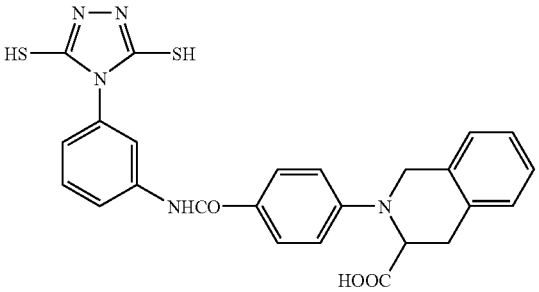
10
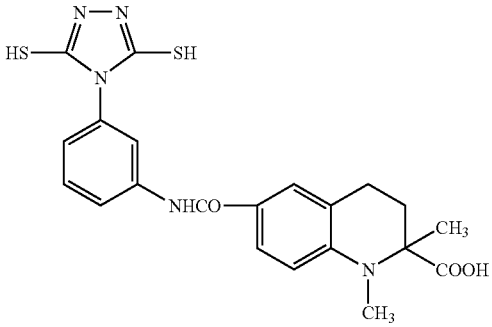
11
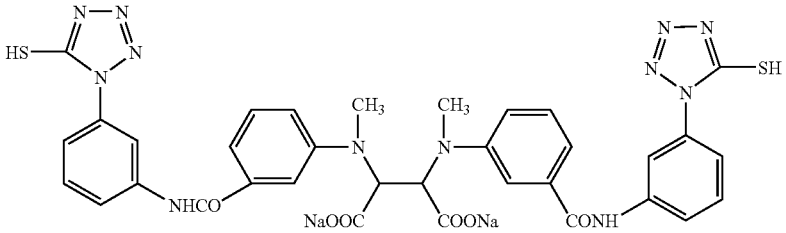

-continued
12
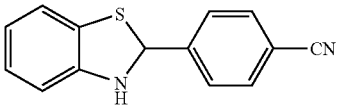
13
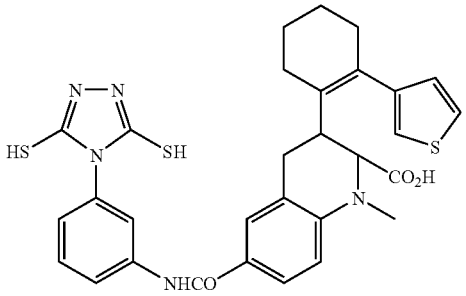
14
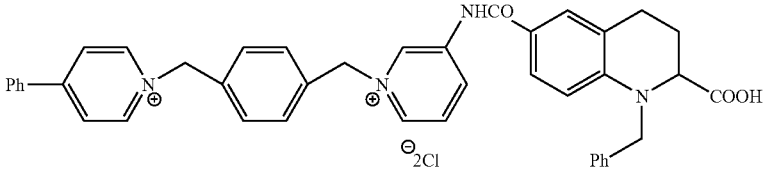
15
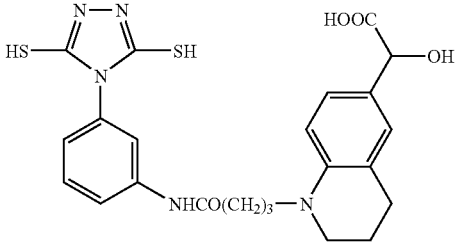
16
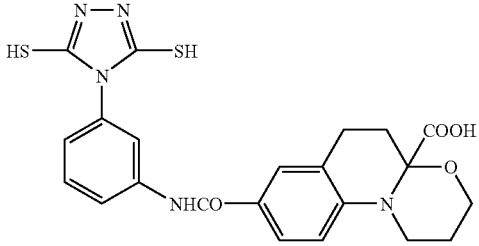
17
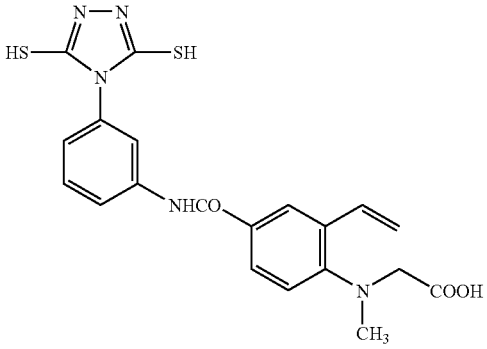
18
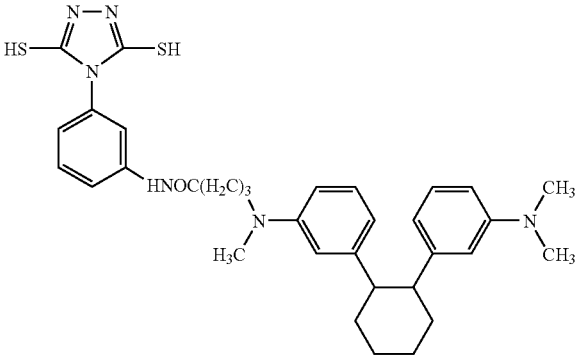
19
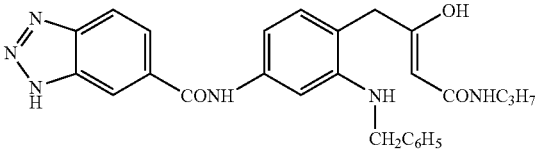
20
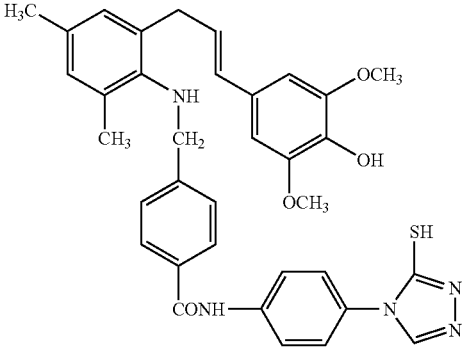

-continued
21
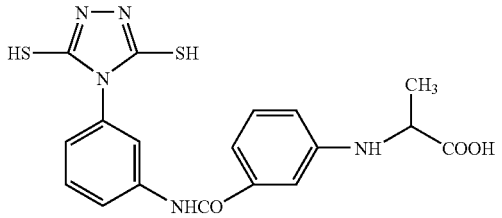
22
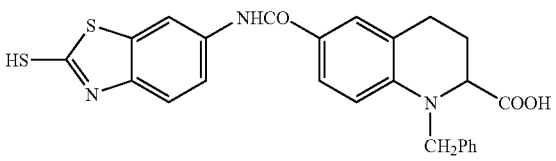
23
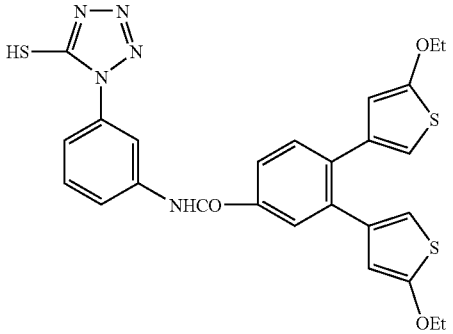
24
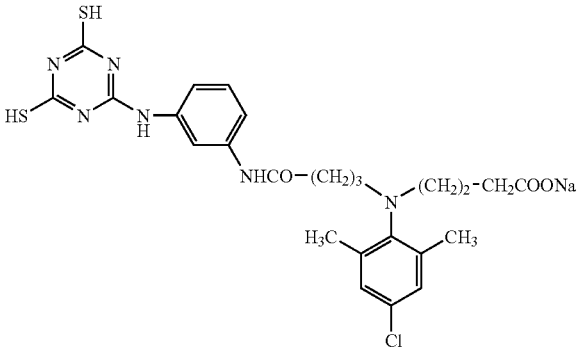
25
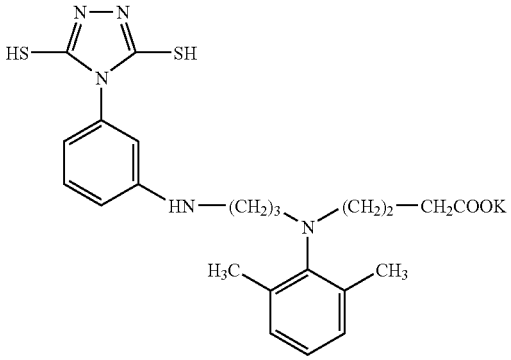
26
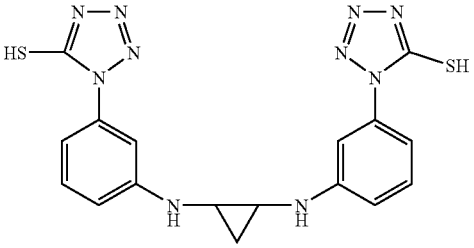
27
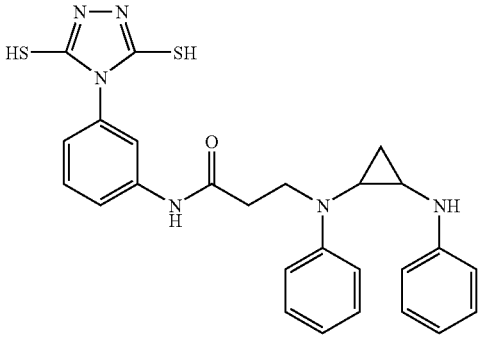
28
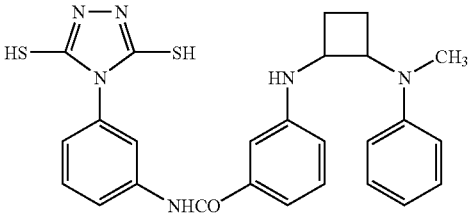

-continued
29
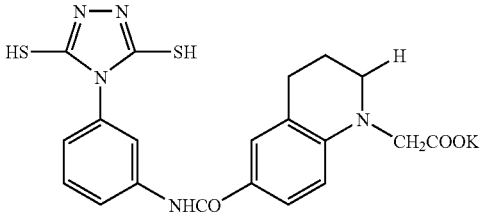
30
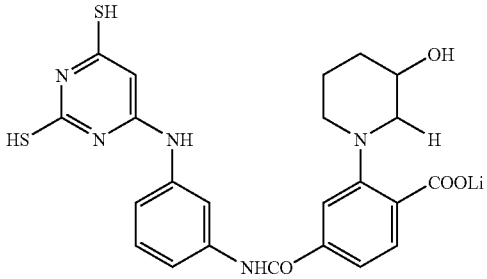
31
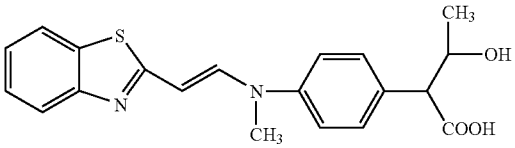
32
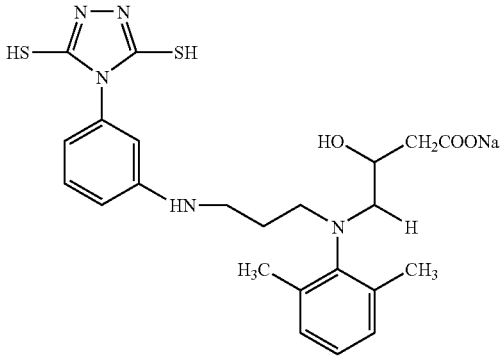
33
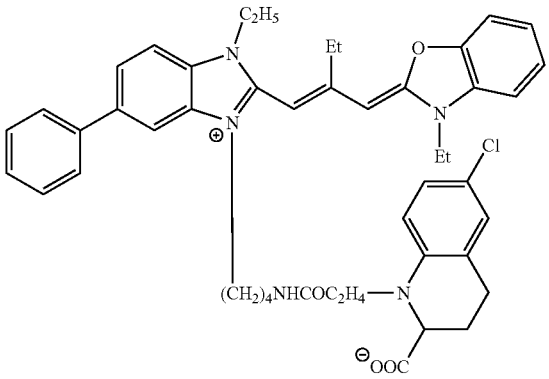
34
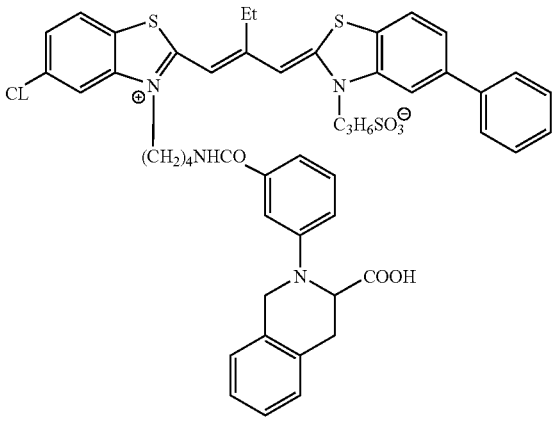
35
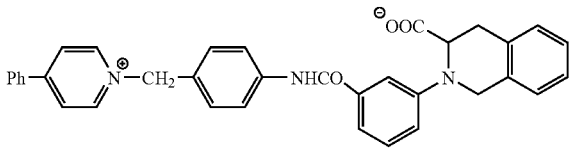
36
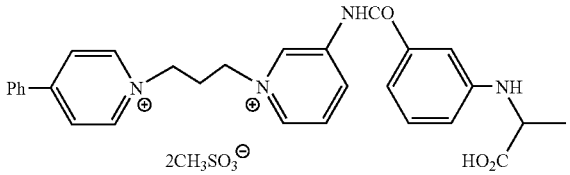
37
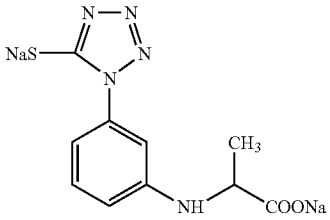

-continued
38
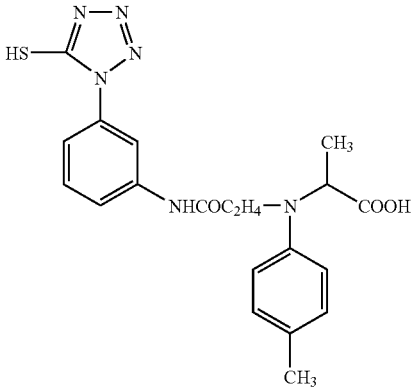
39
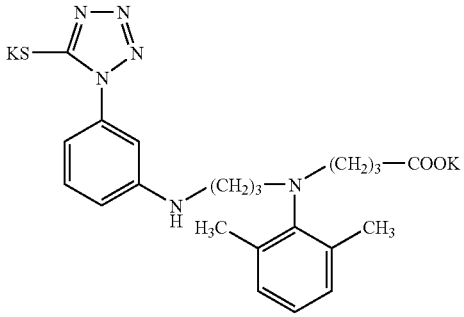
40
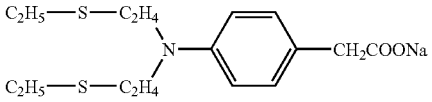
41
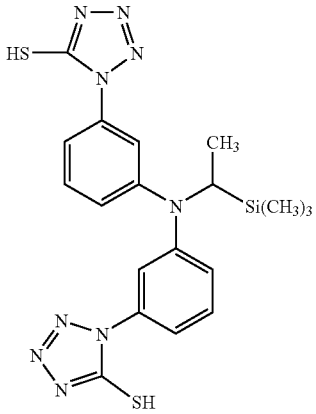
42
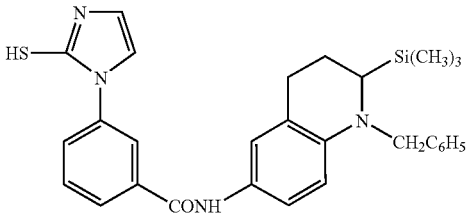
43
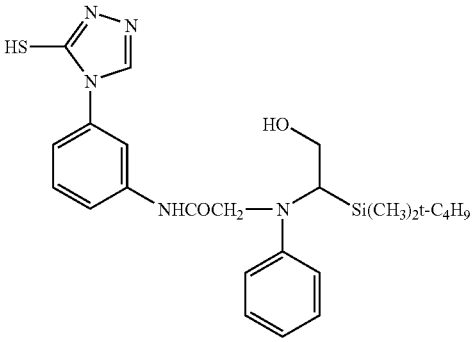
44
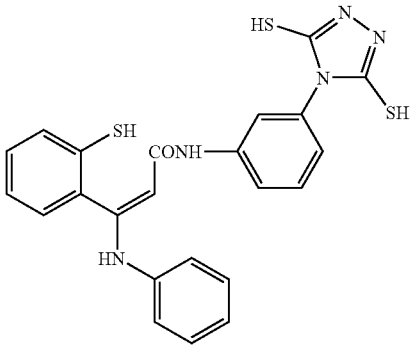
45
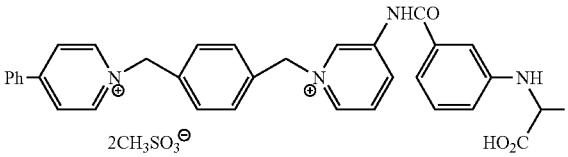
46
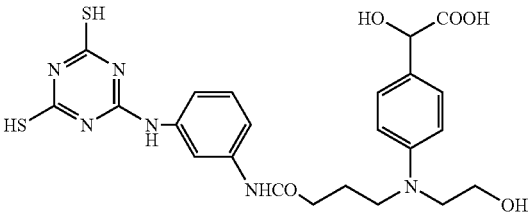

-continued

47

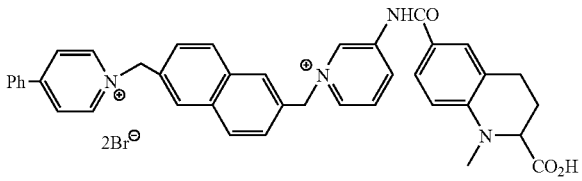

T-4

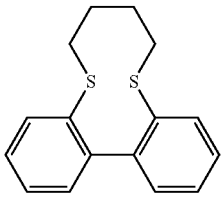

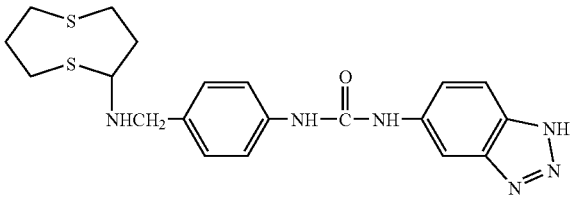

T-1

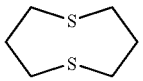

T-31

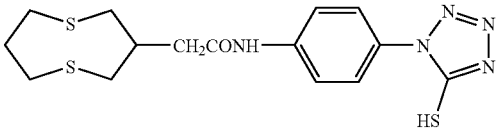

T-32

The compounds of type 1 and type 2 according to the present invention may be added at any stage during the emulsion preparation or photosensitive material production. For example, the addition may be effected at grain formation, desalting, chemical sensitization or coating. The compounds may be divided and added in multiple times during the above stages. The addition stage is preferably after completion of grain formation but before desalting, during chemical sensitization (just before initiation of chemical sensitization to just after termination thereof) or prior to coating. The addition stage is more preferably during chemical sensitization or prior to coating.

The compounds of type 1 and type 2 according to the present invention are preferably dissolved in water, a water soluble solvent such as methanol or ethanol or a mixed solvent thereof before addition. In the dissolving in water, with respect to compounds whose solubility is higher at higher or lower pH value, the dissolution is effected at pH value raised or lowered before addition.

The compounds of type 1 and type 2 according to the present invention, although preferably incorporated in emulsion layers, may be added to not only an emulsion layer but also a protective layer or an interlayer so as to realize diffusion at the time of coating operation. The timing of addition of compounds of the present invention may be before or after sensitizing dye addition, and at either stage the compounds are preferably incorporated in silver halide emulsion layers in an amount of $1\times10^{-9}$ to $5\times10^{-2}$ mol, more preferably $1\times10^{-8}$ to $2\times10^{-3}$ mol per mol of silver halides.

Then, the compound (A) of the present invention is illustrated.

The compound (A) of the present invention is represented by the under-mentioned general formula (A):

Rf—X-M; General formula (A):

wherein Rf represents an alkyl group having 1 or more and 6 or less carbons. Rf may be substituted with at least one of fluorine atoms and may be either of linear, branched and cyclic structures. Further, it may be further optionally substituted with a substituent other than a fluorine atom and may be optionally substituted with only a fluorine atom.

The substituent of Rf other than a fluorine atom includes an alkenyl group, an aryl group, an alkoxyl group, a halogen atom other than fluorine, a carboxylic acid ester group, a carbonamido group, a carbamoyl group, an oxycarbonyl group, and a phosphoric acid ester group.

Rf is preferably a fluorine substituted alkyl group having 2 to 6 carbons and more preferably that having 4 to 6 carbons.

The preferable examples of Rf include:

| | | |
|---|---|---|
| $—(CF_2)_2—H$ (ba-1) | $—(CF_2)_4—H$ (ba-2) | $—(CF_2)_6—H$ (ba-3) |
| $—(CF_2)_2—F$ (bb-1) | $—(CF_2)_4—F$ (bb-2) | $—(CF_2)_6—F$ (bb-3) |

Rf is further preferably an alkyl group having 4 to 6 carbons whose end is substituted with a trifluoromethyl group and in particular, preferably (bb-1) to (bb-3). Among these, (bb-3) is most preferable in particular.

In the fore-mentioned formula, X represents a divalent coupling group or a single bond. The fore-mentioned divalent coupling group is not specifically limited, but preferably a group obtained from an alkylene group, an arylene group, —C(═O)—, —O—, —S—, —S(═O)—, $—S(=O)_2—$, $—NR_p—$ or $—C(R_p)R_q—$ group, alone or by combining those.

The above-mentioned $R_p$ and $R_q$ represent a hydrogen atom or a substituent and as the substituent, each of them represents independently a hydrogen atom or a substituent. The substituent is, for example, an alkyl group (preferably an alkyl group having 1 to 20 carbons, more preferably 1 to 12 carbons and in particular, preferably 1 to 8 carbons and examples include a methyl group, an ethyl group, an isopropyl group, a tert-butyl group, an n-octyl group, a n-decyl group, a n-hexadecyl group, a cyclopropyl group, a cyclopentyl group, and a cyclohexyl group); an alkenyl group (preferably an alkenyl group having 2 to 20 carbons, more preferably 2 to 12 carbons and in particular, preferably 2 to 8 carbons and examples include a vinyl group, an allyl group, a 2-butenyl group, and a 3-pentenyl group); an alkynyl group (preferably an alkynyl group having 2 to 20 carbons, more preferably 2 to 12 carbons and in particular, preferably 2 to 8 carbons and examples include a propargyl group, and a 3-pentynyl group); an aryl group (preferably an aryl group having 6 to 30 carbons, more preferably 6 to 20 carbons and in particular, preferably 6 to 12 carbons and examples include a phenyl group, a p-methylphenyl group, and a naphthyl group); a substituted or unsubstituted amino group (preferably an amino group having 0 to 20 carbons, more preferably 0 to 10 carbons and in particular, preferably 0 to 6 carbons and examples include an unsubstituted amino group, a methylamino group, a dimethylamino group, a diethylamino group, and a dibenzylamino group); an alkoxy group (preferably an alkoxy group having 1 to 20 carbons, more preferably 1 to 12 carbons and in particular, preferably 1 to 8 carbons and examples include a methoxy group, an ethoxy group, and a butoxy group); an aryloxy group (preferably an aryloxy group having 6 to 20 carbons, more preferably 6 to 16 carbons and in particular, preferably 6 to 12 carbons and examples include a phenyloxy group and a 2-naphthyloxy group); an acyl group (preferably an acyl group having 2 to 20 carbons, more preferably 2 to 16 carbons and in particular, preferably 2 to 12 carbons and examples include an acetyl group, a benzoyl group, a formyl group, and a pivaloyl group); an alkoxycarbonyl group (preferably an alkoxycarbonyl group having 2 to 20 carbons, more preferably 2 to 16 carbons and in particular, preferably 2 to 12 carbons and examples include a methoxycarbonyl group and an ethoxycarbonyl group); an aryloxycarbonyl group (preferably an aryloxycarbonyl group having 7 to 20 carbons, more preferably 7 to 16 carbons and in particular, preferably 7 to 10 carbons and examples include a phenyloxycarbonyl group); an acyloxy group (preferably an acyloxy group having 2 to 20 carbons, more preferably 2 to 16 carbons and in particular, preferably 2 to 10 carbons and examples include an acetoxy group and a benzoyloxy group); an acylamino group (preferably an acylamino group having 2 to 20 carbons, more preferably 2 to 16 carbons and in particular, preferably 2 to 10 carbons and examples include an acetylamino group and a benzoylamino group); an alkoxycarbonylamino group (preferably an alkoxycarbonylamino group having 2 to 20 carbons, more preferably 2 to 16 carbons and in particular, preferably 2 to 12 carbons and examples include a methoxycarbonylamino group); an aryloxycarbonylamino group (preferably an aryloxycarbonylamino group having 7 to 20 carbons, more preferably 7 to 16 carbons and in particular, preferably 7 to 12 carbons and examples include a phenyloxycarbonylamino group); a sulfonylamino group (preferably a sulfonylamino group having 1 to 20 carbons, more preferably 1 to 16 carbons and in particular, preferably 1 to 12 carbons and examples include a methanesulfonylamino group and a benzenesulfonylamino group); a sulfamoyl group (preferably a sulfamoyl group having 0 to 20 carbons, more preferably 0 to 16 carbons and in particular, preferably 0 to 12 carbons and examples include a sulfamoyl group, a methylsulfamoyl group, a diethylsulfamoyl group, and a phenylsulfamoyl group); a carbamoyl group (preferably a carbamoyl group having 1 to 20 carbons, more preferably 1 to 16 carbons and in particular, preferably 1 to 12 carbons and examples include an unsubstituted carbamoyl group, a methylcarbamoyl group, a diethylcarbamoyl group, and a phenylcarbamoyl group); an alkylthio group (preferably an alkylthio group having 1 to 20 carbons, more preferably 1 to 16 carbons and in particular, preferably 1 to 12 carbons and examples include a methylthio group and an ethylthio group); an arylthio group (preferably an arylthio group having 6 to 20 carbons, more preferably 6 to 16 carbons and in particular, preferably 6 to 12 carbons and examples include a phenylthio group); a sulfonyl group (preferably a sulfonyl group having 1 to 20 carbons, more preferably 1 to 16 carbons and in particular, preferably 1 to 12 carbons and examples include a mesyl group and a tosyl group); a sulfinyl group (preferably a sulfinyl group having 1 to 20 carbons, more preferably 1 to 16 carbons and in particular, preferably 1 to 12 carbons and examples include a methanesulfinyl group and a benzenesulfinyl group); an ureido group (preferably an ureido group having 1 to 20 carbons, more preferably 1 to 16 carbons and in particular, preferably 1 to 12 carbons and examples include an unsubstituted ureido group, a methylureido group, and a phenylureido group); a phosphoric amide group (preferably a phosphoric amide group having 1 to 20 carbons, more preferably 1 to 16 carbons and in particular, preferably 1 to 12 carbons and examples include a diethylphosphoric amide group and a phenylphosphoric amide group); a hydroxy group, a mercapto group, a halogen atom (for example, a fluorine atom, a chlorine atom, a bromine atom and an iodine atom), a cyano group, a sulfo group, a carboxyl group, a nitro group, a hydroxamic acid group, a sulfino group, a hydrazino group, an imino group, a heterocyclic ring group (preferably a heterocyclic ring group having 1 to 30 carbons and more preferably 1 to 12 carbons, for example, a heterocyclic ring group having hetero atoms such as a nitrogen atom, an oxygen atom and a sulfur atom, and examples include an imidazolyl group, a pyridyl group, a quinolyl group, a furyl group, a piperidyl group, a morpholino group, a benzoxazolyl group, a benzimidazolyl group, and a benzothiazolyl group), a silyl group (preferably a silyl group having 3 to 40 carbons, more preferably 3 to 30 carbons and in particular, preferably 3 to 24 carbons and examples include a trimethylsilyl group and a triphenylsilyl group); etc. These substituents may be further substituted. Further, when there are 2 or more of substituents, they may be the same or different. Furthermore, the substituents may be mutually coupled, if possible, to form a ring.

The preferable examples of X include:

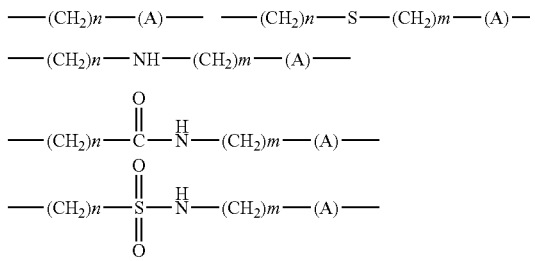

In the above formulas, A represents a coupling group in which groups similarly defined as the fore-mentioned $R_p$ and $R_q$ are alone and combined respectively, or may not exist. Further, n represents an integer of 1 or more and preferably 2 or 3. m represents an integer of 0 or more and preferably 0 to 3.

In the above formulas, M represents an anionic group, a cationic group or a betaine group which is necessary for imparting surface action.

The cationic group is preferably an organic cationic substituent and more preferably an organic cationic group containing a nitrogen atom or a phosphorous atom. Pyridinium cation or ammonium cation is further preferable and trialkylammonium cation represented by the under-mentioned general formula (C) is more preferable:

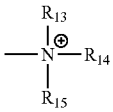

wherein each of $R_{13}$, $R_{14}$ and $R_{15}$ represents independently a substituted or unsubstituted alkyl group. As the substituent, those mentioned as the substituent of $R_p$ and $R_q$ can be applied. Further, $R_{13}$, $R_{14}$ and $R_{15}$ are mutually bound, if possible, to form a ring. $R_{13}$, $R_{14}$ and $R_{15}$ are preferably an alkyl group having 1 to 12 carbons, more preferably an alkyl group having 1 to 6 carbons, further preferably a methyl group, an ethyl group and a methylcarboxyl group, and in particular, preferably a methyl group.

The preferable examples of the compound (A) having a cationic group include:

(FA-1)

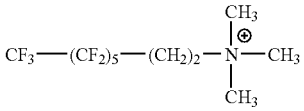

(FA-2)

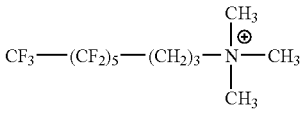

(FA-3)

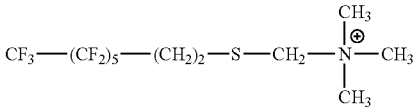

(FA-4)

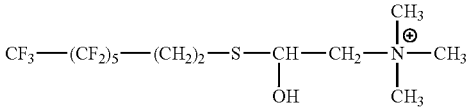

(FA-5)

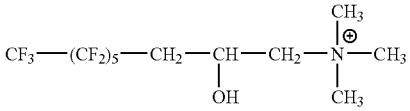

(FA-6)

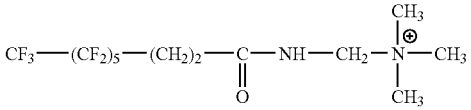

-continued (FA-7)

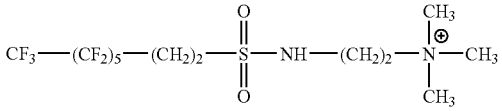

The example of an anionic group includes a sulfonic acid group and its ammonium or metal salt, a carboxylic acid group and its ammonium or metal salt, a phosphonic acid group and its ammonium or metal salt, a sulfuric acid ester group and its ammonium or metal salt, and a phosphoric acid ester group and its ammonium or metal salt. Among these, a sulfonic acid group and its ammonium or metal salt are preferable.

The preferable examples of the compound (A) having an anionic group include:

(FB-1)

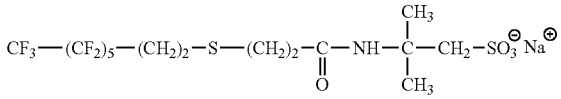

(FB-2)

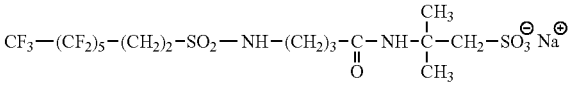

(FB-3)

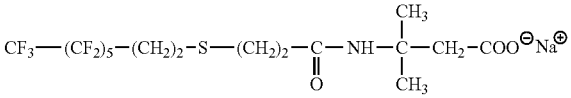

(FB-4)

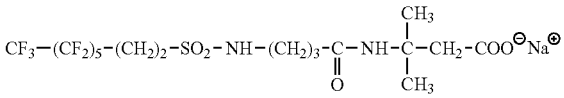

The examples of the betaine group include:

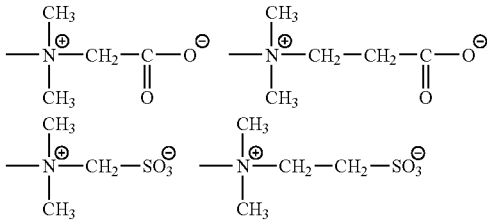

The preferable examples of the compound (A) having a betaine group include:

(FC-1)

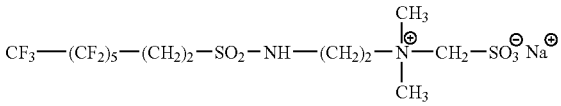

-continued (FC-2)

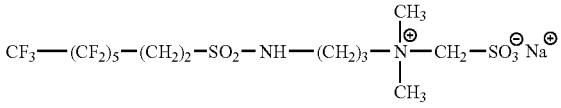

(FC-3)

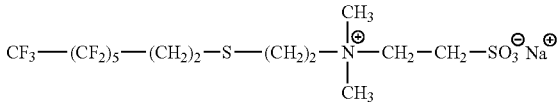

(FC-4)

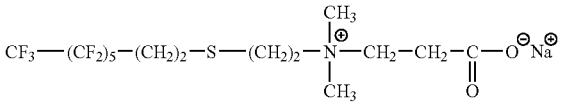

The compound (B) of the present invention is preferably used for the coating composition for forming layers (in particular, a protective layer, an under-coat layer, a back layer and the like) which compose the silver halide photosensitive material. Particularly, when it is used for forming the hydrophilic colloid layer at the uppermost layer of the photosensitive material, it is preferable in particular because effective antistatic ability and coating uniformity can be obtained, but may be also added to a layer having spectral sensitivity other that and an intermediary layer. Further, it may be also added to a plural number of layers and may be also added to either one of layers. The fluorine base surfactants of the present invention may be used respectively singly and a plural number of respective different compounds may be simultaneously used. The use amount is preferably $10^{-6}$ mol/m$^2$ to $10^{-7}$ mol/m$^2$. Further, other anionic, nonionic and cationic surfactants may be used in combination with the compound of the present invention.

The present inventors have intensively studied the deterioration of the antistatic property and high-speed coating adoptability of the photosensitive material using the compound of type 1 and/or type 2, and as a result, have found the effect in combination with the compound (A). They have also found that the improvement of sharpness is attained without lowering the sensitivity, and surprisingly, processing variation is lessened.

The silver content of the present invention means the total amount of silver containing materials contained in component layers of the silver halide photosensitive material. Specifically, silver halide contained in light-sitive layers, silver halide contained in non-sensitive layers, metal silver and the like fall under the category, and the value is converted to silver per square meter. Several methods are known for analyzing the silver content of the photosensitive material. Any method may be used, and for example, elemental analysis using a fluorescent X-ray method is convenient.

The silver content of the silver halide color photosensitive material of the present invention is not limited, but it is preferably 7.5 mg/m$^2$ or less, and particularly preferably 5.5 mg/m$^2$ or less.

In the photosensitive material to which the method of the present invention can be employed, at least one blue-sensitive layer, at least one green-sensitive layer, at least one red-sensitive layer and at least one non-light-sensitive layer need only be formed on a support. A typical example is a silver halide photosensitive material having, on a support, at least one blue, green and red sensitive layer each consisting of a plurality of silver halide emulsion layers sensitive to substantially the same color but different in sensitivity, and at least one non-light-sensitive layer. This sensitive layer is a unit sensitive layer sensitive to one of blue light, green light, and red light. In a multilayered silver halide color photographic light-sensitive material, sensitive layers are generally arranged in the order of red-, green-, and blue-sensitive layers from a support. However, according to the intended use, this order of arrangement can be reversed, or sensitive layers sensitive to the same color can sandwich another sensitive layer sensitive to a different color. Non-light-sensitive layers can be formed between the silver halide sensitive layers and as the uppermost layer and the lowermost layer. These non-light-sensitive layers can contain, e.g., couplers, DIR compounds, and color amalgamation inhibitors to be described later. As a plurality of silver halide emulsion layers constituting each unit sensitive layer, as described in DE1,121,470 or GB923,045, the disclosures of which are incorporated herein by reference, high- and low-speed emulsion layers are preferably arranged such that the sensitivity is sequentially decreased toward a support. Also, as described in JP-A's-57-112751, 62-200350, 62-206541, and 62-206543, layers can be arranged such that a low-speed emulsion layer is formed apart from a support and a high-speed layer is formed close to the support.

More specifically, layers can be arranged, from the one farthest from a support, in the order of a low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), the order of BH/BL/GL/GH/RH/RL, or the order of BH/BL/GH/GL/RL/RH.

In addition, as described in Jpn. Pat. Appln. KOKOKU Publication No. (hereinafter referred to as JP-B-)55-34932, layers can be arranged in the order of a blue-sensitive layer/GH/RH/GL/RL from the one farthest from a support. Furthermore, as described in JP-A's-56-25738 and 62-63936, layers can be arranged in the order of a blue-sensitive layer/GL/RL/GH/RH from the one farthest from a support.

As described in JP-B-49-15495, three layers can be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer, i.e., three layers having different sensitivities can be arranged such that the sensitivity is sequentially decreased toward a support. When the layer structure is thus constituted by three layers having different sensitivities, these three layers can be arranged, in the same color-sensitive layer, in the order of a medium-speed emulsion layer/high-speed emulsion layer/low-speed emulsion layer from the one farthest from a support as described in JP-A-59-202464.

In addition, the order of a high-speed emulsion layer/low-speed emulsion layer/medium-speed emulsion layer or low-speed emulsion layer/medium-speed emulsion layer/high-speed emulsion layer can be used. Furthermore, the arrangement can be changed as described above even when four or more layers are formed.

As a means for improving the color reproduction, the use of an interlayer inhibiting effect is preferred.

It is further preferable to form a donor layer which donates the interlayer effect to a red-sensitive layer. It is particularly preferable that a weight-average sensitivity wavelength $\lambda_G$, represented by the following equation (III), of the spectral sensitivity distribution of a green-sensitive silver halide emulsion layer be 520 nm<$\lambda_G$≦580 nm, that the weight-average wavelength ($\lambda_{-R}$) of the spectral sensitivity distribution of the interlayer effect, which a red-sensitive silver halide emulsion layer is given from other silver halide emulsion layers within the range of 500 to 600 nm, be 500 nm<$\lambda_{-R}$<560 nm, and that $\lambda_G$-$\lambda_{-R}$ be preferably 5 nm or more, more preferably 10 nm or more.

$$\lambda_G = \frac{\int_{500}^{600} \lambda S_G(\lambda) d\lambda}{\int_{500}^{600} S_G(\lambda) d\lambda}$$

where $S_G(\lambda)$ is the spectral sensitivity distribution curve of the green-sensitive silver halide emulsion layer, and $S_G$ at a specific wavelength $\lambda$ is represented by the reciprocal of an exposure amount by which a cyan density is fog+0.5 when exposed to the specific wavelength.

To obtain the Interlayer effect to a red-sensitive layer as described above in a specific wavelength region, it is preferable to separately form an interlayer effect donor layer containing silver halide grains spectrally sensitized to a predetermined degree.

To implement the spectral sensitivity of the present invention, the weight-average sensitivity wavelength of this interlayer effect donor layer is set between 510 and 540 nm.

The weight-average wavelength $\lambda_{-R}$ of the wavelength distribution of the magnitude of the interlayer effect, which a red-sensitive silver halide emulsion layer is given from other silver halide emulsion layers in the range of 500 nm to 600 nm, can be calculated by a method described in JP-B-3-10287, the disclosure of which is incorporated herein by reference.

In the present invention, it is preferred that the weight-average wavelength of red-sensitive layer $\lambda_R$ be 630 nm or less. Herein, the weight-average wavelength of red-sensitive layer $\lambda_R$ is defined by the following formula (I).

$$\lambda_R = \frac{\int_{550}^{700} \lambda S_R(\lambda) d\lambda}{\int_{550}^{700} S_R(\lambda) d\lambda} \quad \text{(I)}$$

In the formula, $S_R(\lambda)$ refers to the spectral sensitivity distribution curve of red-sensitive layer, and the $S_R$ at specified wavelength $\lambda$ is expressed as the inverse number of exposure intensity with which the cyan density becomes fog+0.5 at the application of exposure of the specified wavelength.

As a material for imparting the interlayer effect, a compound which releases a development inhibitor or its precursor by reacting with the oxidized form of a developing agent produced by development is used. Examples are a DIR (development inhibitor releasing) coupler, DIR-hydroquinone, and a coupler which releases DIR-hydroquinone or its precursor. For a development inhibitor having high diffusivity, the development inhibiting effect can be obtained regardless of the position of the donor layer in a multilayered interlayer arrangement. However, a development inhibiting effect in an unintended direction also occurs. To correct this effect, therefore, it is preferable to make the donor layer generate a color (e.g., to make the donor layer generate the same color as a layer which undergoes the influence of the undesired development inhibiting effect). Generation of magenta is preferable to obtain the spectral sensitivity of the present invention.

The size and shape of silver halide grains to be used in the layer having the interlayer effect on red-sensitive layers are not particularly restricted. It is, however, favorable to use so-called tabular grains having a high aspect ratio, a monodisperse emulsion which is uniform in grain size, or silver iodobromide grains having a layered structure of iodide. In addition, to enlarge the exposure latitude, it is preferable to mix two or more types of emulsions different in grain size.

Although the donor layer which donates the interlayer effect to a red-sensitive layer can be formed in any position on a support, it is preferable to form this layer closer to the support than a blue-sensitive layer and farther from the support than a green-sensitive layer. It is more preferable that the donor layer be located closer to the support than a yellow filter layer.

It is further preferable that the donor layer which donates the interlayer effect to a red-sensitive layer be located closer to a support than a green-sensitive layer and farther from the support than the red-sensitive layer. It is most preferable that the donor layer be located adjacent to the side of a green-sensitive layer close to a support. "Adjacent" means that there is no interlayer or the like in between.

The layer which donates the interlayer effect to a red-sensitive layer can include a plurality of layers. In that case, these layers can be either adjacent to or separated from each other.

Solid disperse dyes described in JP-A-11-305396, the disclosure of which is incorporated herein by reference can be used in the present invention.

The emulsion of the present invention relates to a silver iodobromide, silver bromide or silver chloroiodobromide tabular grain emulsion.

With respect to the color photographic lightsensitive material of the present invention, preferably, each unit lightsensitive layer is constituted of a plurality of silver halide emulsion layers which exhibit substantially identical color sensitivity but are different in speed, and 50% or more of the total projected area of silver halide grains contained in at least one layer of the emulsion layers with the highest photographic speed among the silver halide emulsion layers constituting each of the unit lightsensitive layers consists of tabular silver halide grains (hereinafter also referred to as "tabular grains"). In the present invention, the average aspect ratio of such tabular grains is preferably 8 or higher, more preferably 12 or higher, and most preferably 15 or higher.

With respect to tabular grains, the aspect ratio refers to the ratio of diameter to thickness of silver halides. That is, the aspect ratio is the quotient of diameter divided by thickness with respect to each individual silver halide grain. Herein, the diameter refers to the diameter of a circle with an area equal to the projected area of grain exhibited when silver halide grains are observed through a microscope or an electron microscope. Further, herein, the average aspect ratio refers to the average of aspect ratios regarding all the tabular grains of each emulsion.

The method of taking a transmission electron micrograph by the replica technique and measuring the equivalent circle diameter and thickness of each individual grain can be mentioned as an example of aspect ratio determining method. In the mentioned method, the thickness is calculated from the length of replica shadow.

The configuration of tabular grains of the present invention is generally hexagonal. The terminology "hexagonal configuration" means that the shape of the main planes of tabular grains is hexagonal, the adjacent side ratio (maximum side length/minimum side length) thereof being 2 or less. The adjacent side ratio is preferably 1.6 or less, more preferably 1.2 or less. It is needless to mention that the lower limit thereof is 1.0. In the grains of high aspect ratio, especially, triangular tabular grains are increased in the tabular grains. The triangular tabular grains are produced when the Ostwald ripening has excessively been advanced. From the viewpoint of obtaining substantially hexagonal tabular grains, it is preferred that the period of this ripening be minimized. For this purpose, it is requisite to endeavor to raise the tabular grain ratio by nucleation. It is preferred that one or both of an aqueous silver ion solution and an aqueous bromide ion solution contain gelatin for the purpose of raising the probability of occurrence of hexagonal tabular grains at the time of adding silver ions and bromide ions to a reaction mixture according to the double jet technique, as described in JP-A-63-11928 by Saito.

The hexagonal tabular grains contained in the lightsensitive material of the present invention are formed through the steps of nucleation, Ostwald ripening and growth. Although all of these steps are important for suppressing the spread of grain size distribution, attention should be paid so as to avoid the spread of size distribution at the first nucleation step because the spread of size distribution brought about in the above steps cannot be narrowed by an ensuing step. What is important in the nucleation step is the relationship between the temperature of reaction mixture and the period of time of nucleation comprising adding silver ions and bromide ions to a reaction mixture according to the double jet technique and producing precipitates. JP-A-63-92942 by Saito describes that it is preferred that the temperature of the reaction mixture at the time of nucleation be in the range of from 20 to 45° C. for realizing a monodispersity enhancement. Further, JP-A-2-222940 by Zola et al describes that the suitable temperature at nucleation is 60° C. or below.

Addition of gelatin may be effected during the grain formation in order to obtain monodisperse tabular grains of high aspect ratio. The added gelatin is preferably a chemically modified gelatin as described in JP-A's-10-148897 and 11-143002. This chemically modified gelatin is a gelatin characterized in that at least two carboxyl groups have newly been introduced at a chemical modification of amino groups contained in the gelatin, and it is preferred that gelatin trimellitate be used as the same. Also, gelatin succinate is preferably used. The chemically modified gelatin is preferably added prior to the growth step, more preferably immediately after the nucleation.

The addition amount thereof is preferably 60% or greater, more preferably 80% or greater, and most preferably 90% or greater, based on the total mass of dispersion medium used in grain formation.

The tabular grain emulsion is constituted of silver iodobromide or silver chloroiodobromide. Although silver chloride may be contained, the silver chloride content is preferably 8 mol % or less, more preferably 3 mol % or less, and most preferably 0 mol %. With respect to the silver iodide content, it is preferably 20 mol % or less inasmuch as the variation coefficient of the grain size distribution of the tabular grain emulsion is preferably 30% or less. The lowering of the variation coefficient of the distribution of equivalent circle diameter of the tabular grain emulsion can be facilitated by decreasing the silver iodide content. It is especially preferred that the variation coefficient of the grain size distribution of the tabular grain emulsion be 20% or less while the silver iodide content be 10 mol % or less.

Furthermore, it is preferred that the tabular grain emulsion have some intragranular structure with respect to the silver iodide distribution. The silver iodide distribution may have a double structure, a treble structure, a quadruple structure or a structure of higher order.

In the present invention, tabular grains have dislocation lines. Dislocation lines in tabular grains can be observed by a direct method performed using a transmission electron microscope at a low temperature, as described in, e.g., J. F. Hamilton, Phot. Sci. Eng., 11, 57, (1967) or T. Shiozawa, J. Soc. Phot. Sci. Japan, 3, 5, 213, (1972). That is, silver halide grains, carefully extracted from an emulsion so as not to apply any pressure by which dislocations are produced in the grains, are placed on a mesh for electron microscopic observation. Observation is performed by a transmission method while the sample is cooled to prevent damage (e.g., print out) due to electron rays. In this observation, as the thickness of a grain is increased, it becomes more difficult to transmit electron rays through it. Therefore, grains can be observed more clearly by using an electron microscope of a high voltage type (200 kV or more for a grain having a thickness of 0.25 μm). From photographs of grains obtained by the above method, it is possible to obtain the positions and the number of dislocations in each grain viewed in a direction perpendicular to the principal planes of the grain.

The average number of dislocation lines is preferably 10 or more, and more preferably, 20 or more per grain. If dislocation lines are densely present or cross each other, it is sometimes impossible to correctly count dislocation lines per grain. Even in these situations, however, dislocation lines can be roughly counted to such an extent that their number is approximately 10, 20, or 30. This makes it possible to distinguish these grains from those in which obviously only a few dislocation lines are present. The average number of dislocation lines per grain is obtained as a number average by counting dislocation lines of 100 or more grains. Several hundreds of dislocation lines are sometimes found.

Dislocation lines can be introduced to, e.g., a portion near the peripheral region of a tabular grain. In this case, dislocations are substantially perpendicular to the peripheral region and produced from a position x % of the length between the center and the edge (peripheral region) of a tabular grain to the peripheral region. The value of x is preferably 10 to less than 100, more preferably, 30 to less than 99, and most preferably, 50 to less than 98. Although the shape obtained by connecting the start positions of the dislocations is almost similar to the shape of the grain, this shape is not perfectly similar but sometimes distorted. Dislocations of this type are not found in the central region of a grain. The direction of dislocation lines is crystallographically, approximately a (211) direction. Dislocation lines, however, are often zigzagged and sometimes cross each other.

A tabular grain can have dislocation lines either almost uniformly across the whole peripheral region or at a particular position of the peripheral region. That is, in the case of a hexagonal tabular silver halide grain, dislocation lines can be limited to either portions near the six corners or only a portion near one of the six corners. In contrast, it is also possible to limit dislocation lines to only portions near the edges except for the portions near the six corners.

Dislocation lines can also be formed across a region containing the centers of two principal planes of a tabular grain. When dislocation lines are formed across the entire region of the principal planes, the direction of the dislocation lines is sometimes crystallographically, approximately a (211) direction with respect to a direction perpendicular to the principal planes. In some cases, however, the direction is a (110) direction or random. The lengths of the individual dislocation lines are also random; the dislocation lines are sometimes observed as short lines on the principal planes and sometimes observed as long lines reaching the edges (peripheral region). Although dislocation lines are sometimes straight, they are often zigzagged. In many cases, dislocation lines cross each other.

As described above, the position of dislocation lines can be either limited on the peripheral region or the principal planes or a local position on at least one of them. That is, dislocation lines can be present on both the peripheral region and the principal planes.

Introducing dislocation lines to a tabular grain can be achieved by forming a specific silver iodide rich phase inside the grain. This silver iodide rich phase can include a discontinuous silver iodide rich region. More specifically, after a substrate grain is prepared, the silver iodide rich phase is formed and covered with a layer having a silver iodide content lower than that of the silver iodide rich phase. The silver iodide content of the substrate tabular grain is lower than that of the silver iodide rich phase, and is preferably 0 to 20 mol %, and more preferably, 0 to 15 mol %.

In this specification, the silver iodide rich phase inside a grain is a silver halide solid solution containing silver iodide. This silver halide is preferably silver iodide, silver iodobromide, or silver bromochloroiodide, and more preferably, silver iodide or silver iodobromide (the silver iodide content with respect to a silver halide contained in this silver iodide rich phase is 10 to 40 mol %). To cause this silver iodide rich phase inside a grain (to be referred to as an internal silver iodide rich phase hereinafter) to selectively exist on the edge, the corner, or the surface of a substrate grain, it is desirable to control the formation conditions of the substrate grain, the formation conditions of the internal silver iodide rich phase, and the formation conditions of a phase covering the outside of the internal silver iodide rich phase. Important factors as the formation conditions of a substrate grain are the pAg (the logarithm of the reciprocal of a silver ion concentration), the presence/absence, type, and amount of a silver halide solvent, and the temperature. By controlling the pAg to preferably 8.5 or less, more preferably, 8 or less during the growth of substrate grains, the internal silver iodide rich phase can be made to selectively exist in portions near the corners or on the surface of the substrate grain, when this silver iodide rich phase is formed later.

On the other hand, by controlling the pAg to preferably 8.5 or more, more preferably, 9 or more during the growth of substrate grains, the internal silver iodide rich phase can be made to exist on the edges of the substrate grain. The threshold value of the pAg rises and falls depending on the temperature and the presence/absence, type, and amount of a silver halide solvent. When thiocyanate is used as the silver halide solvent, this threshold value of the pAg shifts to higher values. The value of the pAg at the end of the growth of substrate grains is particularly important, among other pAg values during the growth. On the other hand, even if the pAg during the growth does not meet the above value, the position of the internal silver iodide rich phase can be controlled by performing ripening by controlling the pAg to the above proper value after the growth of substrate grains. In this case, ammonia, an amine compound, a thiourea derivative, or thiocyanate salt can be effectively used as the silver halide solvent. The internal silver iodide rich phase can be formed by a so-called conversion method.

This method includes a method which, at a certain point during grain formation, adds halogen ion smaller in solubility for salt for forming silver ion than halogen ion that forms grains or portions near the surfaces of grains at that point. In the present invention, the amount of halogen ion having a smaller solubility to be added preferably takes a certain value (related to a halogen composition) with respect to the surface area of grains at that point. For example, at a given point during grain formation, it is preferable to add a certain amount or more of KI with respect to the surface area of silver halide grains at that point. More specifically, it is preferable to add $8.2\times10^{-5}$ mol/m$^2$ or more of iodide salt.

A more preferable method of forming the internal silver iodide rich phase is to add an aqueous silver salt solution simultaneously with addition of an aqueous silver halide solution containing iodide salt.

As an example, an aqueous $AgNO_3$ solution is added simultaneously with addition of an aqueous KI solution by the double-jet method. In this case, the addition start timings and the addition end timings of the aqueous KI solution and the aqueous $AgNO_3$ solution can be shifted from each other. The addition molar ratio of the aqueous $AgNO_3$ solution to the aqueous KI solution is preferably 0.1 or more, more preferably, 0.5 or more, and most preferably, 1 or more. The total addition molar quantity of the aqueous $AgNO_3$ solution can exit in a silver excess region with respect to halogen ion in the system and iodine ion added. During the addition of the aqueous silver halide solution containing iodine ion and the addition of the aqueous silver salt solution by the double-jet method, the pAg preferably decreases with the addition time by the double-jet. The pAg before the addition is preferably 6.5 to 13, and more preferably, 7.0 to 11. The pAg at the end of the addition is most preferably 6.5 to 10.0.

In carrying out the above method, the solubility of a silver halide in the mixing system is preferably as low as possible. Therefore, the temperature of the mixing system at which the silver iodide rich phase is formed is preferably 30° C. to 80° C., and more preferably, 30° C. to 70° C.

The formation of the internal silver iodide rich phase is most preferably performed by adding fine-grain silver iodide, fine-grain silver iodobromide, fine-grain silver chloroiodide, or fine-grain silver bromochloroiodide. The addition of fine-grain silver iodide is particularly preferred. These fine grains normally have a grain size of 0.01 to 0.1 μm, but those having a grain size of 0.01 μm or less or 0.1 μm or more can also be used. Methods of preparing these fine silver halide grains are described in JP-A's-1-183417, 2-44335, 1-183644, 1-183645, 2-43534, and 2-43535, the disclosures of which are incorporated herein by reference. The internal silver iodide rich phase can be formed by adding and ripening these fine silver halide grains.

In dissolving the fine grains by ripening, the silver halide solvent described above can also be used. These fine grains added need not immediately, completely dissolve to disappear but need only disappear by dissolution when the final grains are completed.

The internal silver iodide rich phase is located in a region of, when measuring from the center of, e.g., a hexagon formed in a plane by projecting a grain thereon, preferably 5 to less than 100 mol %, more preferably, 20 to less than 95 mol %, and most preferably, 50 to less than 9 mol % with respect to the total silver amount of the grain. The amount of a silver halide which forms the internal silver iodide rich phase is, as a silver amount, preferably 50 mol % or less, and more preferably, 20 mol % or less of the total silver amount of a grain. These values of amounts of the silver iodide rich phase are not those obtained by measuring the halogen composition of the final grain by using various analytical methods but formulated values in the producing of a silver halide emulsion. The internal silver iodide rich phase often disappears from the final grain owing to, e.g., recrystallization, and so all silver amounts described above are related to their formulated values.

It is, therefore, readily possible to observe dislocation lines in the final grains by the above method, but the internal silver iodide rich phase introduced to introduce dislocation lines cannot be observed as a definite phase in many cases because the silver iodide composition in the boundary continuously changes. The halogen compositions in each portion of a grain can be checked by combining X-ray diffraction, an EPMA (also called an XMA) method (a method of scanning a silver halide grain by electron rays to detect its silver halide composition), and an ESCA (also called an XPS) method (a method of radiating X-rays to spectroscopically detect photoelectrons emitted from the surface of a grain).

The silver iodide content of an outer phase covering the internal silver iodide rich phase is lower than that of the silver iodide rich phase, and is preferably 0 to 30 mol %, more preferably, 0 to 20 mol %, and most preferably, 0 to 10 mol % with respect to a silver halide amount contained in the outer phase.

Although the temperature and the pAg, at which the outer phase covering the internal silver iodide rich phase is formed, can take arbitrary values, the temperature is preferably 30° C. to 80° C., and most preferably, 35° C. to 70° C., and the pAg is preferably 6.5 to 11.5. The use of the silver halide solvents described above is sometimes preferable, and the most preferable silver halide solvent is thiocyanate salt.

Another method of introducing dislocation lines to tabular grains is to use an iodide ion releasing agent as described in JP-A-6-11782, the disclosure of which is incorporated herein by reference. This method is also preferably used.

Dislocation lines can also be introduced by appropriately combining this dislocation line introducing method with the above-mentioned dislocation line introducing method.

The variation coefficient of the inter-grain iodide distribution of silver halide grains contained in a light-sensitive material of the present invention is preferably 20% or less, more preferably, 15% or less, and most preferably, 10% or less. If the variation coefficient of the iodide content distribution of each individual silver halide is larger than 20%, no high contrast can be obtained, and a reduction of the sensitivity upon application of a pressure increases.

Any known method can be used as a method of producing silver halide grains contained in a light-sensitive material of the present invention and having a narrow inter-grain iodide distribution. Examples are a method of adding fine grains as disclosed in JP-A-1-183417 and a method which uses an iodide ion releasing agent as disclosed in JP-A-2-68538, the disclosures of which are incorporated herein by reference. These methods can be used alone or in combination.

The variation coefficient of the inter-grain iodide distribution of silver halide grains of the present invention is preferably 20% or less. The most preferred method of monodispersing the inter-grain iodide distribution is a method described in JP-A-3-213845, the disclosure of which is incorporated herein by reference. That is, fine silver halide grains containing 95 mol % or more of silver iodide are formed by mixing an aqueous solution of a water-soluble silver salt and an aqueous solution of a water-soluble halide (containing 95 mol % or more of iodide ions) in a mixer placed outside a reaction vessel, and supplied to the reaction vessel immediately after the formation. In this manner, a monodisperse inter-grain iodide distribution can be achieved. The reaction vessel is a vessel which causes nucleation and/or crystal growth of tabular silver halide grains.

As described in JP-A-3-213845, the disclosure of which is incorporated herein by reference, the following three technologies can be used as a method of adding the silver halide grains prepared in the mixer and as a preparing means used in the method.

(1) After being formed in the mixer, the fine grains are immediately added to the reaction vessel.
(2) Strong and efficient stirring is performed in the mixer.
(3) An aqueous protective colloid solution is poured into the mixer.

The protective colloid used in method (3) above can be singly poured into the mixer or can be poured into the mixer after being contained in an aqueous halogen salt solution or aqueous silver nitrate solution. The concentration of the protective colloid is 1 mass % or more, preferably 2 to 5 mass %. Examples of a polymer compound having a protective colloid function with respect to silver halide grains used in the present invention are a polyacrylamide polymer, an amino polymer, a polymer having a thioether group, polyvinyl alcohol, an acrylic acid polymer, a polymer having hydroxyquinoline, cellulose, starch, acetal, polyvinylpyrrolidone, and a ternary polymer. The use of low-molecular-weight gelatin is preferred. The weight-average molecular weight of this low-molecular-weight gelatin is preferably 30,000 or less, and more preferably, 10,000 or less.

When fine silver halide grains are to be prepared, the grain formation temperature is preferably 35° C. or less, and particularly preferably, 25° C. or less. The temperature of the reaction vessel to which fine silver halide grains are added is 50° C. or more, preferably 60° C. or more, and more preferably, 70° C. or more.

The grain size of a fine silver halide used in the present invention can be directly confirmed by a transmission electron microscope by placing the grain on a mesh. The size of fine grains of the present invention is preferably 0.3 μm or less, more preferably, 0.1 μm or less, and most preferably, 0.01 μm or less. This fine silver halide can be added simultaneously with another halogen ion or silver ion or can be added alone. The mixing amount of the fine silver halide grains is 0.005 to 20 mol %, preferably 0.01 to 10 mol % with respect to a total silver halide.

The silver iodide content of each grain can be measured by analyzing the composition of the grain by using an X-ray microanalyzer. The variation coefficient of an inter-grain iodide distribution is a value defined by $$(\text{standard deviation}/\text{average silver iodide content})\times 100=\text{variation coefficient}\ (\%)$$

by using the standard deviation of silver iodide contents and the average silver iodide content when the silver iodide contents of at least 100, more preferably, 200, and most preferably, 300 emulsion grains are measured. The measurement of the silver iodide content of each individual grain is described in, e.g., European Patent 147,868. A silver iodide content Yi [mol %] and an equivalent-sphere diameter Xi [μm] of each grain sometimes have a correlation and sometimes do not. However, Yi and Xi desirably have no correlation. The halogen composition structure of a tabular grain of the present invention can be checked by combining, e.g., X-ray diffraction, an EPMA (also called an XMA) method (a method of scanning a silver halide grain by electron rays to detect its silver halide composition), and an ESCA (also called an XPS) method (a method of radiating X-rays to spectroscopically detect photoelectrons emitted from the surface of a grain). When the silver iodide content is measured in the present invention, the grain surface is a region about 5 nm deep from the surface, and the grain interior is a region except for the surface. The halogen composition of this grain surface can usually be measured by the ESCA method.

In the present invention, regular-crystal grains such as cubic, octahedral, and tetradecahedral grains and irregular twinned-crystal grains can be used in addition to aforementioned tabular grains.

Silver halide emulsions of the present invention are preferably subjected to selenium sensitization or gold sensitization.

As selenium sensitizers usable in the present invention, selenium compounds disclosed in conventionally known patents can be used. Usually, a labile selenium compound and/or a non-labile selenium compound is used by adding it to an emulsion and stirring the emulsion at a high temperature, preferably 40° C. or more for a predetermined period of time. As non-labile selenium compounds, it is preferable to use compounds described in, e.g., JP-B-44-15748, JP-B-43-13489, and JP-A's-4-25832 and 4-109240, the disclosures of which are incorporated herein by reference.

Practical examples of a labile selenium sensitizer are isoselenocyanates (e.g., aliphatic isoselenocyanates such as allylisoselenocyanate), selenoureas, selenoketones, selenoamides, selenocarboxylic acids (e.g., 2-selenopropionic acid and 2-selenobutyric acid), selenoesters, diacylselenides (e.g., bis(3-chloro-2,6-dimethoxybenzoyl)selenide), selenophosphates, phosphineselenides, and colloidal metal selenium.

Although preferred examples of a labile selenium compound are described above, the present invention is not limited to these examples. It is generally agreed by those skilled in the art that the structure of a labile selenium compound used as a sensitizer for a photographic emulsion is not so important as long as selenium is labile, and that the organic part of a molecule of a selenium sensitizer has no important role except the role of carrying selenium and keeping it in a labile state in an emulsion. In the present invention, therefore, labile selenium compounds in this extensive concept are advantageously used.

Examples of a non-labile selenium compound usable in the present invention are compounds described in JP-B's-46-4553, 52-34491, and 52-34492, the disclosures of which are incorporated herein by reference. Practical examples of a non-labile selenium compound are selenious acid, potassium selenocyanide, selenazoles, quaternary ammonium salts of selenazoles, diarylselenide, diaryldiselenide, dialkylselenide, dialkyldiselenide, 2-selenazolidinedione, 2-selenoxazolidinethione, and derivatives of these compounds.

These selenium sensitizers are dissolved in water, an organic solvent such as methanol or ethanol, or a solvent mixture of such organic solvents, and the resultant solution is added during chemical sensitization, preferably before the start of chemical sensitization. A selenium sensitizer to be used is not limited to one type, but two or more types of the selenium sensitizers described above can be used together. Combining a labile selenium compound and a non-labile selenium compound is preferred.

The addition amount of selenium sensitizers usable in the present invention changes in accordance with the activity of each selenium sensitizer used, the type or grain size of a silver halide, and the temperature and time of ripening. The addition amount, however, is preferably $2\times10^{-6}$ to $5\times10^{-6}$ mol per mol of a silver halide. When selenium sensitizers are used, the temperature of chemical sensitization is preferably 40° C. to 80° C. The pAg and pH can take given values. For example, the effect of the present invention can be obtained in a wide pH range of 4 to 9.

Selenium sensitization can be achieved more effectively in the presence of a silver halide solvent.

Examples of a silver halide solvent usable in the present invention are (a) organic thioethers described in U.S. Pat. Nos. 3,271,157, 3,531,289, and 3,574,628, and JP-A's-54-1019 and 54-158917, the disclosures of which are incorporated herein by reference, (b) thiourea derivatives described in JP-A's-53-82408, 55-77737, and 55-2982, the disclosures of which are incorporated herein by reference, (c) a silver halide solvent having a thiocarbonyl group sandwiched between an oxygen or sulfur atom and a nitrogen atom, described in JP-A-53-144319, the disclosure of which is incorporated herein by reference, (d) imidazoles described in JP-A-54-100717, the disclosure of which is incorporated herein by reference, (e) sulfite, and (f) thiocyanate.

Most preferred examples of a silver halide solvent are thiocyanate and tetramethylthiourea. Although the amount of a solvent to be used changes in accordance with its type, a preferred amount is $1\times10^{-4}$ to $1\times10^{-2}$ mol per mol of a silver halide.

A gold sensitizer for use in gold sensitization of the present invention can be any compound having an oxidation number of gold of +1 or +3, and it is possible to use gold compounds normally used as gold sensitizers. Representative examples are chloroaurate, potassium chloroaurate, auricrichloride, potassium auricthiocyanate, potassium iodoaurate, tetracyanoauric acid, ammonium aurothiocyanate, pyridyltrichloro gold, gold sulfide, and gold selenide. Although the addition amount of gold sensitizers changes in accordance with various conditions, the amount is preferably $1\times10^{-7}$ to $5\times10^{-5}$ mol per mol of a silver halide.

Emulsions of the present invention are preferably subjected to sulfur sensitization during chemical sensitization.

This sulfur sensitization is commonly performed by adding sulfur sensitizers and stirring the emulsion for a predetermined time at a high temperature, preferably 40° C. or more.

Sulfur sensitizers known to those skilled in the art can be used in sulfur sensitization. Examples are thiosulfate, allylthiocarbamidothiourea, allylisothiacyanate, cystine, p-toluenethiosulfonate, and rhodanine. It is also possible to use sulfur sensitizers described in, e.g., U.S. Pat. Nos. 1,574,944, 2,410,689, 2,278,947, 2,728,668, 3,501,313, and 3,656,955, German Patent 1,422,869, JP-B-56-24937, and JP-A-55-45016, the disclosures of which are incorporated herein by reference. The addition amount of sulfur sensitizers need only be large enough to effectively increase the sensitivity of an emulsion. This amount changes over a wide range in accordance with various conditions, such as the pH, the temperature, and the size of silver halide grains. However, the amount is preferably $1\times10^{-7}$ to $5\times10^{-5}$ mol per mol of a silver halide.

Silver halide emulsions of the present invention can also be subjected to reduction sensitization during grain formation, after grain formation and before or during chemical sensitization, or after chemical sensitization.

Reduction sensitization can be selected from a method of adding reduction sensitizers to a silver halide emulsion, a method called silver ripening in which grains are grown or ripened in a low-pAg ambient at pAg 1 to 7, and a method called high-pH ripening in which grains are grown or ripened in a high-pH ambient at pH 8 to 11. Two or more of these methods can also be used together.

The method of adding reduction sensitizers is preferred in that the level of reduction sensitization can be finely adjusted.

Known examples of reduction sensitizers are stannous salt, ascorbic acid and its derivative, amines and polyamines, a hydrazine derivative, formamidinesulfinic acid, a silane compound, and a borane compound. In reduction sensitization of the present invention, it is possible to selectively use these known reduction sensitizers or to use two or more types of compounds together. Preferred compounds as reduction sensitizers are stannous chloride, thiourea dioxide, dimethylamineborane, and ascorbic acid and its derivative. Although the addition amount of reduction sensitizers must be so selected as to meet the emulsion producing conditions, a preferable amount is $10^{-7}$ to $10^{-3}$ mol per mol of a silver halide.

Reduction sensitizers are dissolved in water or an organic solvent such as alcohols, glycols, ketones, esters, or amides, and the resultant solution is added during grain growth. Although adding to a reactor vessel in advance is also preferred, adding at a given timing during grain growth is more preferred. It is also possible to add reduction sensitizers to an aqueous solution of a water-soluble silver salt or of a water-soluble alkali halide to precipitate silver halide grains by using this aqueous solution. Alternatively, a solution of reduction sensitizers can be added separately several times or continuously over a long time period with grain growth.

It is preferable to use an oxidizer for silver during the process of producing emulsions of the present invention. An oxidizer for silver is a compound having an effect of converting metal silver into silver ion. A particularly effective compound is the one that converts very fine silver grains, formed as a by-product in the process of formation and chemical sensitization of silver halide grains, into silver ion. The silver ion produced can form a silver salt hard to dissolve in water, such as a silver halide, silver sulfide, or silver selenide, or a silver salt easy to dissolve in water, such as silver nitrate. An oxidizer for silver can be either an inorganic or organic substance. Examples of an inorganic oxidizer are ozone, hydrogen peroxide and its adduct (e.g., $NaBO_2.H_2O_2.3H_2O$, $2NaCO_3.3H_2O_2$, $Na_4P_2O_7.2H_2O_2$, and $2Na_2SO_4.H_2O_2.2H_2O$), peroxy acid salt (e.g., $K_2S_2O_8$, $K_2C_2O_6$, and $K_2P_2O_8$), a peroxy complex compound (e.g., $K_2[Ti(O_2)C_2O_4].3H_2O$, $4K_2SO_4.Ti(O_2)OH.SO_4.2H_2O$, and $Na_3[VO(O_2)(C_2H_4)_2.6H_2O]$), permanganate (e.g., $KMnO_4$), an oxyacid salt such as chromate (e.g., $K_2Cr_2O_7$), a halogen element such as iodine and bromine, perhalogenate (e.g., potassium periodate), a salt of a high-valence metal (e.g., potassium hexacyanoferrate(II)), and thiosulfonate.

Examples of an organic oxidizer are quinones such as p-quinone, an organic peroxide such as peracetic acid and perbenzoic acid, and a compound for releasing active halogen (e.g., N-bromosuccinimide, chloramine T, and chloramine B).

Preferable oxidizers of the present invention are inorganic oxidizers such as ozone, hydrogen peroxide and its adduct, a halogen element, and thiosulfonate, and organic oxidizers such as quinones.

It is preferable to use the reduction sensitization described above and the oxidizer for silver together. In this case, the reduction sensitization can be performed after the oxidizer is used or vice versa, or the oxidizer can be used simultaneously with the reduction sensitization. These methods can be applied to both the grain formation step and the chemical sensitization step.

Photographic emulsions of the present invention can achieve high color saturation when spectrally sensitized by preferably methine dyes and the like. Usable dyes involve a cyanine dye, merocyanine dye, composite cyanine dye, composite merocyanine dye, holopolar cyanine dye, hemicyanine dye, styryl dye, and hemioxonole dye. Most useful dyes are those belonging to a cyanine dye, merocyanine dye, and composite merocyanine dye. These dyes can contain any nucleus commonly used as a basic heterocyclic nucleus in cyanine dyes.

Examples are a pyrroline nucleus, oxazoline nucleus, thiazoline nucleus, pyrrole nucleus, oxazole nucleus, thiazole nucleus, selenazole nucleus, imidazole nucleus, tetrazole nucleus, and pyridine nucleus; a nucleus in which an aliphatic hydrocarbon ring is fused to any of the above nuclei; and a nucleus in which an aromatic hydrocarbon ring is fused to any of the above nuclei, e.g., an indolenine nucleus, benzindolenine nucleus, indole nucleus, benzoxadole nucleus, naphthoxazole nucleus, benzthiazole nucleus, naphthothiazole nucleus, benzoselenazole nucleus, benzimidazole nucleus, and quinoline nucleus. These nuclei can be substituted on a carbon atom.

It is possible to apply to a merocyanine dye or a composite merocyanine dye a 5- or 6-membered heterocyclic nucleus as a nucleus having a ketomethylene structure. Examples are a pyrazoline-5-one nucleus, thiohydantoin nucleus, 2-thiooxazolidine-2,4-dione nucleus, thiazolidine-2,4-dione nucleus, rhodanine nucleus, and thiobarbituric acid nucleus.

Although these sensitizing dyes can be used singly, they can also be combined. The combination of sensitizing dyes is often used for a supersensitization purpose. Representative examples of the combination are described in U.S. Pat. Nos. 2,688,545, 2,977,229, 3,397,060, 3,522,0523, 3,527,641, 3,617,293, 3,628,964, 3,666,480, 3,672,898, 3,679,4283, 3,703,377, 3,769,301, 3,814,609, 3,837,862, and 4,026,707, British Patents 1,344,281 and 1,507,803, JP-B's-43-4936 and 53-12375, and JP-A's-52-110618 and 52-109925, the disclosures of which are incorporated herein by reference.

In addition to sensitizing dyes, emulsions can contain dyes having no spectral sensitizing effect or substances not substantially absorbing visible light and presenting supersensitization.

The present invention is preferably combined with a technique of increasing a light absorption factor by the addition of a spectral sensitizing dye. For example, there can be mentioned more than monolayer saturated adsorption (namely, single-layer adsorption) of a sensitizing dye onto the surface of silver halide grains by means of intermolecular force, or adsorption of a so-called connected dye, comprising a plurality of chromophores connected to each other by covalent bonds without separate conjugation. As the techniques, there can be mentioned the following patent publications: JP-A's-10-239789, 11-133531, 2000-267216, 2000-275772, 2001-75222, 2001-75247, 2001-75221, 2001-75226, 2001-75223, 2001-255615, 2002-23294, 2002-99053, 2002-148767, 2002-287309, 2002-351004, 2002-365752, 2003-121956, 2004-184596, 2004-191926, 2004-219784, 2004-280062, 10-171058, 10-186559, 10-197980, 2000-81678, 2001-5132, 2001-13614, 2001-166413, 2002-

49113, 2003-177486, 64-91134, 10-110107, 10-226758, 10-307358, 10-307359, 10-310715, 2000-231174, 2000-231172, 2000-231173, 2001-356442, 2002-55406, 2002-169258 and 2003-121957 and EP's 985965A, 985964A, 985966A, 985967A, 1085372A, 1085373A, 1172688A, 1199595A, 887700A1 and 1439417A1 and U.S. Pat. Nos. 6,699,652B1, 6,790,602B2, 6,794,121B2, 6,787,297B1, 2004/0142288A1 and 2004/0146818A1.

It is still more preferred to combine the present invention with techniques described in the following patent publications:

JP-A's-10-239789, 10-171058, 2001-75222, 2002-287309, 2004-184596 and 2004-191926.

Sensitizing dyes can be added to an emulsion at any point conventionally known to be useful during the preparation of an emulsion. Most ordinarily, sensitizing dyes are added after the completion of chemical sensitization and before coating. However, it is possible to perform the addition simultaneously with the addition of chemical sensitizing dyes to thereby perform spectral sensitization and chemical sensitization at the same time, as described in U.S. Pat. Nos. 3,628,969 and 4,225,666, the disclosures of which are incorporated herein by reference. It is also possible to perform the addition prior to chemical sensitization, as described in JP-A-58-113928, the disclosure of which is incorporated herein by reference, or before the completion of the formation of a silver halide grain precipitate to thereby start spectral sensitization. Alternatively, as disclosed in U.S. Pat. No. 4,225,666, these sensitizing dyes can be added separately; a portion of the sensitizing dyes is added prior to chemical sensitization, and the rest is added after that. That is, sensitizing dyes can be added at any timing during the formation of silver halide grains, including the method disclosed in U.S. Pat. No. 4,183,756, the disclosure of which is incorporated herein by reference.

When a plurality of sensitizing dyes are to be added, these sensitizing dyes can be separately added with predetermined pauses between them or added mixedly, or a portion of one sensitizing dye is previously added and the rest is added together with the other sensitizing dyes. That is, it is possible to select an optimum method in accordance with the types of the chosen sensitizing dyes and with the desired spectral sensitivity.

The addition amount of sensitizing dyes can be $4\times10^{-6}$ to $8\times10^{-3}$ mol per mol of a silver halide. However, for a more favorable silver halide grain size of 0.2 to 1.4 μm, an addition amount of about $5\times10^{-5}$ to $2\times10^{-3}$ mol is more effective.

The twin plane spacing of a silver halide grain of the present invention is preferably 0.017 μm or less, more preferably, 0.007 to 0.017 μm, and most preferably, 0.007 to 0.015 μm.

Fog occurring while a silver halide emulsion of the present invention is aged can be improved by adding and dissolving a previously prepared silver iodobromide emulsion during chemical sensitization. This silver iodobromide emulsion can be added at any timing during chemical sensitization. However, it is preferable to first add and dissolve the silver iodobromide emulsion and then add sensitizing dyes and chemical sensitizers in this order. The silver iodobromide emulsion used has an iodide content lower than the surface iodide content of a host grain, and is preferably a pure silver bromide emulsion. The size of this silver iodobromide emulsion is not limited as long as the emulsion can be completely dissolved. However, the equivalent-sphere diameter is preferably 0.1 μm or less, and more preferably, 0.05 μm or less. Although the addition amount of the silver iodobromide emulsion changes in accordance with a host grain used, the amount is basically preferably 0.005 to 5 mol %, and more preferably, 0.1 to 1 mol % per mol of silver.

Common dopants known to be useful to silver halide emulsions can be used in emulsions used in the present invention. Examples of common dopants are Fe, Co, Ni, Ru, Rh, Pd, Re, Os, Ir, Pt, Au, Hg, Pb, and Tl. In the present invention, a hexacyano iron(II) complex and hexacyanoruthenium complex (to be simply referred to as "metal complexes" hereinafter) are preferably used.

The addition amount of these metal complexes is preferably $10^{-7}$ to $10^{-3}$ mol, and more preferably, $1.0\times10^{-5}$ to $5\times10^{-4}$ mol per mol of a silver halide.

Metal complexes used in the present invention can be added in any stage of the preparation of silver halide grains, i.e., before or after nucleation, growth, physical ripening, or chemical sensitization. Also, metal complexes can be divisionally added a plurality of times. However, 50% or more of the total content of metal complexes contained in a silver halide grain are preferably contained in a layer ½ or less as a silver amount from the outermost surface of the grain. A layer not containing metal complexes can also be formed on the outside, i.e., on the side away from a support, of the layer containing metal complexes herein mentioned.

These metal complexes are preferably contained by dissolving them in water or an appropriate solvent and directly adding the solution to a reaction solution during the formation of silver halide grains, or by forming silver halide grains by adding them to an aqueous silver salt solution, aqueous silver salt solution, or some other solution for forming the grains. Alternatively, these metal complexes are also favorably contained by adding and dissolving fine silver halide grains previously made to contain the metal complexes, and depositing these grains on other silver halide grains. When these metal complexes are to be added, the hydrogen ion concentration in a reaction solution is such that the pH is preferably 1 to 10, and more preferably, 3 to 7.

Photographic additives usable in the present invention are also described in RDs, and the relevant portions are summarized in the following table.

| Additives | RD17643 | RD18716 |
|---|---|---|
| 1. Chemical sensitizers | page 23 | page 648, right column |
| 2. Sensitivity increasing agents | | page 648, right column |
| 3. Spectral sensitizers, super sensitizers | pages 23-24 | page 648, right column to page 649, right column |
| 4. Brighteners | page 24 | page 647, right column |
| 5. Light absorbents, filter dyes, ultraviolet absorbents | pages 25-26 | page 649, right column to page 650, left column |
| 6. Binders | page 26 | page 651, left column |
| 7. Plasticizers, lubricants | page 27 | page 650, right column |
| 8. Coating aids, surface active agents | pages 26-27 | page 650, right column |
| 9. Antistatic agents | page 27 | page 650, right column |
| 10. Matting agents | | |

-continued

| Additives | RD307105 |
|---|---|
| 1. Chemical sensitizers | page 866 |
| 2. Sensitivity increasing agents | |
| 3. Spectral sensitizers, super sensitizers | pages 866-868 |
| 4. Brighteners | page 868 |
| 5. Light absorbent, filter dye, ultraviolet absorbents | page 873 |
| 6. Binder | pages 873-874 |
| 7. Plasticizers, lubricants | page 876 |
| 8. Coating aids, surface active agents | pages 875-876 |
| 9. Antistatic agents | pages 876-877 |
| 10. Matting agent | pages 878-879 |

Various dye forming couplers can be used in a light-sensitive material of the present invention, and the following couplers are particularly preferable.

Yellow couplers: couplers represented by formulas (I) and (II) in EP502,424A; couplers (particularly Y-28 on page 18) represented by formulas (1) and (2) in EP513,496A; a coupler represented by formula (I) in claim 1 of EP568,037A; a coupler represented by formula (I) in column 1, lines 45 to 55 of U.S. Pat. No. 5,066,576; a coupler represented by formula (I) in paragraph 0008 of JP-A-4-274425; couplers (particularly D-35 on page 18) described in claim 1 on page 40 of EP498,381A1; couplers (particularly Y-1 (page 17) and Y-54 (page 41)) represented by formula (Y) on page 4 of EP447,969A1; and couplers (particularly II-17 and II-19 (column 17), and II-24 (column 19)) represented by formulas (II) to (IV) in column 7, lines 36 to 58 of U.S. Pat. No. 4,476,219, the disclosures of which are incorporated herein by reference.

Magenta couplers: JP-A-3-39737 (L-57 (page 11, lower right column), L-68 (page 12, lower right column), and L-77 (page 13, lower right column); [A-4]-63 (page 134), and [A-4]-73 and [A-4]-75 (page 139) in EP456,257; M-4 and M-6 (page 26), and M-7 (page 27) in EP486,965; M-45 (page 19) in EP571,959A; (M-1) (page 6) in JP-A-5-204106; and M-22 in paragraph 0237 of JP-A-4-362631, the disclosures of which are incorporated herein by reference.

Cyan couplers: CX-1, CX-3, CX-4, CX-5, CX-11, CX-12, CX-14, and CX-15 (pages 14 to 16) in JP-A-4-204843; C-7 and C-10 (page 35), C-34 and C-35 (page 37), and (I-1) and (I-17) (pages 42 and 43) in JP-A-4-43345; and couplers represented by formulas (Ia) and (Ib) in claim 1 of JP-A-6-67385, the disclosures of which are incorporated herein by reference.

Polymer couplers: P-1 and P-5 (page 11) in JP-A-2-44345, the disclosure of which is incorporated herein by reference.

Couplers for forming a colored dye with proper diffusibility are preferably those described in U.S. Pat No. 4,366,237, GB2,125,570, EP96,873B, and DE3,234,533, the disclosures of which are incorporated herein by reference.

Couplers for correcting unnecessary absorption of a colored dye are preferably yellow colored cyan couplers (particularly YC-86 on page 84) represented by formulas (CI), (CII), (CIII), and (CIV) described on page 5 of EP456,257A1; yellow colored magenta couplers ExM-7 (page 202), EX-1 (page 249), and EX-7 (page 251) described in EP456,257A1; magenta colored cyan couplers CC-9 (column 8) and CC-13 (column 10) described in U.S. Pat. No. 4,833,069; (2) (column 8) in U.S. Pat. No. 4,837,136; and colorless masking couplers (particularly compound examples on pages 36 to 45) represented by formula (A) in claim 1 of WO92/11575, the disclosures of which are incorporated herein by reference.

Examples of compounds (including a coupler) which react with a developing agent in an oxidized form to thereby release a photographically useful compound residue are as follows.

Development inhibitor release compounds: compounds (particularly T-101 (page 30), T-104 (page 31), T-113 (page 36), T-131 (page 45), T-144 (page 51), and T-158 (page 58)) represented by formulas (I), (II), (III), (IV) described on page 11 of EP378,236A1, compounds (particularly D-49 (page 51)) represented by formula (I) described on page 7 of EP436,938A2, compounds (particularly (23) (page 11)) represented by formula (1) in EP568,037A, and compounds (particularly I-(1) on page 29) represented by formulas (I), (II), and (III) described on pages 5 and 6 of EP440,195A2; bleaching accelerator release compounds: compounds (particularly (60) and (61) on page 61) represented by formulas (I) and (I') on page 5 of EP310,125A2, and compounds (particularly (7) (page 7)) represented by formula (I) in claim 1 of JP-A-6-59411; ligand release compounds: compounds (particularly compounds in column 12, lines 21 to 41) represented by LIG-X described in claim 1 of U.S. Pat. No. 4,555,478; leuco dye release compounds: compounds 1 to 6 in columns 3 to 8 of U.S. Pat. No. 4,749,641; fluorescent dye release compounds: compounds (particularly compounds 1 to 11 in columns 7 to 10) represented by COUP-DYE in claim 1 of U.S. Pat. No. 4,774,181; development accelerator or fogging agent release compounds: compounds (particularly (I-22) in column 25) represented by formulas (1), (2), and (3) in column 3 of U.S. Pat. No. 4,656,123, and ExZK-2 on page 75, lines 36 to 38 of EP450,637A2; compounds which release a group which does not function as a dye unless it splits off: compounds (particularly Y-1 to Y-19 in columns 25 to 36) represented by formula (I) in claim 1 of U.S. Pat. No. 4,857,447, the disclosures of which are incorporated herein by reference.

Preferred examples of additives other than couplers are as follows.

Dispersants of oil-soluble organic compounds: P-3, P-5, P-16, P-19, P-25, P-30, P-42, P-49, P-54, P-55, P-66, P-81, P-85, P-86, and P-93 (pages 140 to 144) in JP-A-62-215272; impregnating latexes of oil-soluble organic compounds: latexes described in U.S. Pat. No. 4,199,363; developing agent oxidized form scavengers: compounds (particularly I-(1), I-(2), I-(6), and I-(12) (columns 4 and 5)) represented by formula (I) in column 2, lines 54 to 62 of U.S. Pat. No. 4,978,606, and formulas (particularly a compound 1 (column 3)) in column 2, lines 5 to 10 of U.S. Pat. No. 4,923,787; stain inhibitors: formulas (I) to (III) on page 4, lines 30 to 33, particularly I-47, I-72, III-1, and III-27 (pages 24 to 48) in EP298321A; discoloration inhibitors: A-6, A-7, A-20, A-21, A-23, A-24, A-25, A-26, A-30, A-37, A-40, A-42, A-48, A-63, A-90, A-92, A-94, and A-164 (pages 69 to 118) in EP298321A, II-1 to III-23, particularly III-10 in columns 25 to 38 of U.S. Pat. No. 5,122,444, I-1 to III-4, particularly II-2 on pages 8 to 12 of EP471347A, and A-1 to A-48, particularly A-39 and A-42 in columns 32 to 40 of U.S. Pat. No. 5,139,931; materials which reduce the use amount of a color enhancer or a color amalgamation inhibitor: I-1 to II-15, particularly I-46 on pages 5 to 24 of EP411324A; formalin scavengers: SCV-1 to SCV-28, particularly SCV-8 on pages 24 to 29 of EP477932A; film hardeners: H-1, H-4, H-6, H-8, and H-14 on page 17 of JP-A-1-214845, compounds (H-1 to H-54) represented by formulas (VII) to (XII) in columns 13 to 23 of U.S. Pat. No. 4,618,573, compounds (H-1 to H-76), particularly H-14 represented by formula (6) on page 8, lower right column of JP-A-2-214852, and compounds described in claim 1 of U.S. Pat. No. 3,325,287; development inhibitor precursors: P-24, P-37, and P-39 (pages 6 and 7) in JP-A-62-168139; compounds described in claim 1, particularly 28 and 29 in column 7 of U.S. Pat. No. 5,019,492;

antiseptic agents and mildewproofing agents: I-1 to III-43, particularly II-1, II-9, II-10, II-18, and III-25 in columns 3 to 15 of U.S. Pat. No. 4,923,790; stabilizers and antifoggants: I-1 to (14), particularly I-1, I-60, (2), and (13) in columns 6 to 16 of U.S. Pat. No. 4,923,793, and compounds 1 to 65, particularly the compound 36 in columns 25 to 32 of U.S. Pat. No. 4,952,483; chemical sensitizers: triphenylphosphine selenide and a compound 50 in JP-A-5-40324; dyes: a-1 to b-20, particularly a-1, a-12, a-18, a-27, a-35, a-36, and b-5 on pages 15 to 18 and V-1 to V-23, particularly V-1 on pages 27 to 29 of JP-A-3-156450, F-I-1 to F-II-43, particularly F-I-11 and F-II-8 on pages 33 to 55 of EP445627A, III-1 to III-36, particularly III-1 and III-3 on pages 17 to 28 of EP457153A, fine-crystal dispersions of Dye-1 to Dye-124 on pages 8 to 26 of WO88/04794, compounds 1 to 22, particularly the compound 1 on pages 6 to 11 of EP319999A, compounds D-1 to D-87 (pages 3 to 28) represented by formulas (1) to (3) in EP519306A, compounds 1 to 22 (columns 3 to 10) represented by formula (I) in U.S. Pat. No. 4,268,622, and compounds (1) to (31) (columns 2 to 9) represented by formula (I) in U.S. Pat. No. 4,923,788; UV absorbents: compounds (18b) to (18r) and 101 to 427 (pages 6 to 9) represented by formula (1) in JP-A-46-3335, compounds (3) to (66) (pages 10 to 44) and compounds HBT-1 to HBT-10 (page 14) represented by formula (III) in EP520938A, and compounds (1) to (31) (columns 2 to 9) represented by formula (1) in EP521823A, the disclosures of which are incorporated herein by reference.

The present invention can be applied to various color photosensitive materials such as color negative films for general purposes or cinemas, color intermediate film for cinemas, color reversal films for slides and TV, color paper, color positive films and color reversal paper. Moreover, the present invention is suitable to lens equipped film units described in JP-B-2-32615 and Jpn. Utility Model Appln. KOKOKU Publication No. 3-39784.

Supports which can be suitably used in the present invention are described in, e.g., RD. No. 17643, page 28; RD. No. 18716, from the right column of page 647 to the left column of page 648; and RD. No. 307105, page 879.

In the photosensitive material of the present invention, backing layer (referred to as "back layer") having a total dry film thickness of 0.1 to 20 μm is preferably provided on the side opposite to the side having emulsion layers. Preferably, the back layer which comprises one layer or plural layers contains the aforementioned light absorbent, filter dye, ultraviolet absorbent, antistatic agent, film hardener, binder, plasticizer, lubricant, coating aid and surfactant in accordance with the purpose. The swelling ratio of these back layers is preferably in the range of 100 to 500%.

In particular, an antistatic layer is applied preferably to the photosensitive material of the present invention as the back layer. The antistatic layer preferably contains conductive metal oxide particles and an conductive compound such as a π-electron base conductive polymer or carbon black particles. Since the carbon black particles are black, it is not preferable that they remain after development, and they are generally removed at development in the art. Accordingly, the antistatic function after development is extinguished. The conductive metal oxide particles and π-electron base conductive polymer are more preferable from the viewpoint that they have the antistatic function with respect to the photosensitive material after development.

As means for producing the preferable antistatic layer having carbon black particles in the present invention, there can be mentioned, for example, the methods described in JP-A-4-258952 and U.S. Pat. No. 3,489,567.

As the preferable materials of the conductive metal particles of the present invention, there can be mentioned, for example, ZnO, $TiO_2$, $SnO_2$, $Al_2O_3$, $In_2O_3$, MgO, BaO, $MoO_3$, $V_2O_5$ and composite oxides thereof, and metal oxides further containing different atoms in addition to these metal oxides. ZnO, $TiO_2$, $SnO_2$ and $In_2O_3$ are preferable in particular. As the metal oxides containing different atoms, there can be mentioned, for example, ZnO doped with 0.01 to 30% by mol of Al or In; $TiO_2$ doped with 0.01 to 30% by mol of Nb or Ta; $In_2O_3$ doped with 0.01 to 30% by mol of Sn; and $SnO_2$ doped with 0.01 to 30% by mol of Sb, Nb or halogen element. As methods, there can be mentioned, for example, the Examples described in JP-A-8-36239 and JP-A-2001-305704.

As the preferable material of the π-electron base conductive polymer of the present invention, there can be mentioned, for example, polypyrrole and its derivative, polythiophene and its derivative, polyaniline and its derivative, and copolymers thereof. As methods, there can be mentioned, for example, the methods described in JP-A-8-211555 and JP-A-2000-292888.

The specified photographic speed referred to in the present invention is determined by the method described in JP-A-63-236035. The determining method is substantially in accordance with JIS K 7614-1981 except that the development processing is completed within 30 min to 6 hr after exposure for sensitometry and that the development processing is performed according to Fuji Color standard processing recipe CN-16. Others are substantially the same as those of the method described in JIS.

In the photosensitive material of the present invention, the thickness of photosensitive silver halide layer closest to the support through surface of the photosensitive material is preferably 24 μm or less, more preferably 22 μm or less. Film swelling speed $T_{1/2}$ is preferably 30 sec or less, more preferably 20 sec or less. The film swelling speed $T_{1/2}$ is defined as the time that when the saturation film thickness refers to 90% of the maximum swollen film thickness attained by the processing in a color developer at 30° C. for 3 min 15 sec, is spent for the film thickness to reach ½ of the saturation film thickness. The film thickness means one measured under moisture conditioning at 25° C. in a relative humidity of 55% (two days). The film swelling speed $T_{1/2}$ can be measured by using a swellometer described in A. Green et al., Photogr. Sci. Eng., Vol. 19, No. 2, pp. 124 to 129. The film swelling speed $T_{1/2}$ can be regulated by adding a film hardener to gelatin as a binder, or by changing aging conditions after coating. The swelling ratio preferably ranges from 150 to 400%. The swelling ratio can be calculated from the maximum swollen film thickness measured under the above conditions in accordance with the formula:

$$[(\text{maximum swollen film thickness} - \text{film thickness})/\text{film thickness}] \times 100(\%).$$

The photosensitive material according to the present invention can be developed by conventional methods described in the aforementioned RD. No. 17643, pages 28 and 29; RD. No. 18716, page 651, left to right columns; and RD No. 307105, pages 880 and 881.

The color negative film processing solution for use in the present invention will be described below.

The compounds listed in page 9, right upper column, line 1 to page 11, left lower column, line 4 of JP-A-4-121739 can be used in the color developing solution for use in the present invention. Preferred color developing agents for use in especially rapid processing are 2-methyl-4-[N-ethyl-N-(2-hydroxyethyl)amino]aniline, 2-methyl-4-[N-ethyl-N-(3-hydroxypropyl)amino]aniline and 2-methyl-4-[N-ethyl-N-(4-hydroxybutyl)amino]aniline.

These color developing agents are preferably used in an amount of 0.01 to 0.08 mol, more preferably 0.015 to 0.06 mol, and most preferably 0.02 to 0.05 mol per liter (hereinafter also referred to as "L") of the color developing solution. The replenisher of the color developing solution preferably contains the color developing agent in an amount corresponding to 1.1 to 3 times the above concentration, more preferably 1.3 to 2.5 times the above concentration.

Hydroxylamine can widely be used as a preservative of the color developing solution. When enhanced preserving properties are required, it is preferred to use hydroxylamine derivatives having substituents such as alkyl, hydroxyalkyl, sulfoalkyl and carboxyalkyl groups. Preferred examples thereof include N,N-di(sulfoehtyl)hydroxylamine, monomethylhydroxylamine, dimethylhydroxylamine, monoethylhydroxylamine, diethylhydroxylamine and N,N-di(carboxyethyl)hydroxylamine. Of these, N,N-di(sulfoehtyl) hydroxylamine is most preferred. Although these may be used in combination with hydroxylamine, it is preferred that one or two or more members thereof be used in place of hydroxylamine.

These preservatives are preferably used in an amount of 0.02 to 0.2 mol, more preferably 0.03 to 0.15 mol, and most preferably 0.04 to 0.1 mol per L of the color developing solution. The replenisher of the color developing solution preferably contains the preservatives in an amount corresponding to 1.1 to 3 times the concentration of the mother liquor (processing tank solution) as in the color developing agent.

Sulfurous salts are used as tarring preventives for the color developing agent oxidation products in the color developing solution. Sulfurous salts are preferably used in the color developing solution in an amount of 0.01 to 0.05 mol, more preferably 0.02 to 0.04 mol per L. In the replenisher, sulfurous salts are preferably used in an amount corresponding to 1.1 to 3 times the above concentration.

The pH value of the color developing solution preferably ranges from 9.8 to 11.0, more preferably from 10.0 to 10.5. The pH of the replenisher is preferably set for a value 0.1 to 1.0 higher than the above value. Common buffers, such as carbonic acid salts, phosphoric acid salts, sulfosalicylic acid salts and boric acid salts, are used for stabilizing the above pH value.

Although the amount of the replenisher of the color developing solution preferably ranges from 80 to 1300 mL per $m^2$ of the photosensitive material, the employment of smaller amount is desirable from the viewpoint of reduction of environmental pollution load. Specifically, the amount of the replenisher more preferably ranges from 80 to 600 mL, most preferably from 80 to 400 mL.

The bromide ion concentration in the color developer is usually 0.01 to 0.06 mol per L. However, this bromide ion concentration is preferably set at 0.015 to 0.03 mol per L in order to suppress fog and improve discrimination and graininess while maintaining sensitivity. To set the bromide ion concentration in this range, it is only necessary to add bromide ions calculated by the following equation to a replenisher. If C represented by formula below takes a negative value, however, no bromide ions are preferably added to a replenisher.

$$C=A-W/V$$

where

C: the bromide ion concentration (mol/L) in a color developer replenisher

A: the target bromide ion concentration (mol/L) in a color developer

W: the amount (mol) of bromide ions dissolving into the color developer from 1 $m^2$ of a photosensitive material when the sensitive material is color-developed V: the replenishment rate (L) of the color developer replenisher for 1 $m^2$ of the photosensitive material As a method of increasing the sensitivity when the replenishment rate is decreased or high bromide ion concentration is set, it is preferable to use a development accelerator such as pyrazolidones represented by 1-phenyl-3-pyrazolidone and 1-phenyl-2-methyl-2-hydroxylmethyl-3-pyrazolidone, or a thioether compound represented by 3,6-dithia-1,8-octandiol.

Compounds and processing conditions described on page 4, left lower column, line 16 to page 7, left lower column, line 6 of JP-A-4-125558 can be applied to the processing solution having bleaching capability for use in the present invention.

Bleaching agents having redox potentials of at least 150 mV are preferably used. Specifically, suitable examples thereof are those described in JP-A-5-72694 and JP-A-5-173312, and especially suitable examples thereof are 1,3-diaminopropanetetraacetic acid, Example 1 compounds listed on page 7 of JP-A-5-173312 and ferric complex salts.

For improving the biodegradability of bleaching agent, it is preferred that ferric complex salts of compounds listed in JP-A-4-251845, JP-A-4-268552, EP 588289, EP 591934 and JP-A-6-208213 be used as the bleaching agent. The concentration of these bleaching agents preferably ranges from 0.05 to 0.3 mol per liter of solution having bleaching capability, and it is especially preferred that a design be made at 0.1 to 0.15 mol per liter for the purpose of reducing the discharge to the environment. When the solution having bleaching capability is a bleaching solution, a bromide is preferably incorporated therein in an amount of 0.2 to 1 mol, more preferably 0.3 to 0.8 mol per liter.

Each component is incorporated in the replenisher of the solution having bleaching capability fundamentally at a concentration calculated by the following formula. This enables keeping the concentration in the mother liquor constant.

$$C_R=C_T\times(V_1+V_2)/V_1+C_P$$

$C_R$: concentration of each component in the replenisher, $C_T$: concentration of the component in the mother liquor (processing tank solution), $C_P$: component concentration consumed during processing, $V_1$: amount of replenisher having bleaching capability supplied per $m^2$ of photosensitive material (mL), and $V_2$: amount carried from previous bath by 1 $m^2$ of photosensitive material (mL).

In addition, a pH buffer is preferably incorporated in the bleaching solution, and it is especially preferred to incorporate a dicarboxylic acid of low order such as succinic acid, maleic acid, malonic acid, glutaric acid or adipic acid. It is also preferred to use common bleaching accelerators listed in JP-A-53-95630, RD No. 17129 and U.S. Pat. No. 3,893,858.

The bleaching solution is preferably replenished with 50 to 1000 mL, more preferably 80 to 500 mL, and most preferably 100 to 300 mL of a bleaching replenisher per $m^2$ of photosensitive material.

Further, the bleaching solution is preferably aerated.

Compounds and processing conditions described on page 7, left lower column, line 10 to page 8, right lower column, line 19 of JP-A-4-125558 can be applied to a processing solution having fixing capability.

For enhancing the fixing velocity and preservability, it is especially preferred to incorporate compounds represented by the general formulae (I) and (II) of JP-A-6-301169 either individually or in combination in the processing solution having fixing capability. Further, the use of not only p-toluenesulfinic salts but also sulfinic acids listed in JP-A-1-224762 is preferred from the viewpoint of enhancing the preservability.

Although the incorporation of an ammonium as a cation in the solution having bleaching capability or solution having fixing capability is preferred from the viewpoint of enhancing the desilvering, it is preferred that the amount of ammonium be reduced or brought to nil from the viewpoint of minimizing environmental pollution.

Conducting jet agitation described in JP-A-1-309059 is especially preferred in the bleach, bleach-fix and fixation steps.

The amount of replenisher supplied in the bleach-fix or fixation step is in the range of 100 to 1000 mL, preferably 150 to 700 mL, and more preferably 200 to 600 mL per $m^2$ of the photosensitive material.

Silver is preferably recovered by installing any of various silver recovering devices in an in-line or off-line mode in the bleach-fix or fixation step. In-line installation enables processing with the silver concentration of solution lowered, so that the amount of replenisher can be reduced. It is also suitable to conduct an off-line silver recovery and recycle residual solution for use as a replenisher.

The bleach-fix and fixation steps can each be accomplished by the use of multiple processing tanks. Preferably, the tanks are provided with cascade piping and a multistage counterflow system is adopted. A 2-tank cascade structure is generally effective from the viewpoint of a balance with the size of the developing machine. The ratio of processing time in the former-stage tank to that in the latter-stage tank is preferably in the range of 0.5:1 to 1:0.5, more preferably 0.8:1 to 1:0.8.

From the viewpoint of enhancing the preservability, it is preferred that a chelating agent which is free without forming any metal complex be present in the bleach-fix and fixing solutions. Biodegradable chelating agents described in connection with the bleaching solution are preferably used as such a chelating agent.

Descriptions made on page 12, right lower column, line 6 to page 13, right lower column, line 16 of JP-A-4-125558 mentioned above can preferably be applied to the washing and stabilization steps. In particular, with respect to the stabilizing solution, the use of azolylmethylamines described in EP 504609 and EP 519190 and N-methylolazoles described in JP-A-4-362943 in place of formaldehyde and the conversion of magenta coupler to two-equivalent form so as to obtain a surfactant solution not containing any image stabilizer such as formaldehyde are preferred from the viewpoint of protecting working environment.

Further, stabilizing solutions described in JP-A-6-289559 can preferably be used for reducing the adhesion of refuse to a magnetic recording layer applied to the photosensitive material.

The replenishing amount of washing and stabilizing solutions is preferably in the range of 80 to 1000 mL, more preferably 100 to 500 mL, and most preferably 150 to 300 mL, per $m^2$ of the photosensitive material from the viewpoint that washing and stabilizing functions are ensured and that the amount of waste solution is reduced to contribute to environment protection. In the processing conducted with the above replenishing amount, known mildewproofing agents such as thiabendazole, 1,2-benzoisothiazolin-3-one and 5-chloro-2-methylisothiazolin-3-one, antibiotics such as gentamicin, and water deionized by the use of, for example, an ion exchange resin are preferably used for preventing the breeding of bacteria and mildew. The joint use of deionized water, a mildewproofing agent and an antibiotic is more effective than single use thereof.

With respect to the solution placed in the washing or stabilizing solution tank, it is also preferred that the replenishing amount be reduced by conducting a reverse osmosis membrane treatment as described in JP-A's-3-46652, 3-53246, 3-55542, 3-121448 and 3-126030. A low-pressure reverse osmosis membrane is preferably used as the reverse osmosis membrane of the above treatment.

In the processing of the present invention, it is especially preferred that an evaporation correction of processing solution be carried out as disclosed in JIII (Japan Institute of Invention and Innovation) Journal of Technical Disclosure No. 94-4992. In particular, the method in which a correction is effected with the use of information on the temperature and humidity of developing machine installation environment in accordance with Formula 1 on page 2 thereof is preferred. Water for use in the evaporation correction is preferably procured from the washing replenishing tank. In that instance, deionized water is preferably used as the washing replenishing water.

Processing agents set forth on page 3, right column, line 15 to page 4, left column, line 32 of the above journal of technical disclosure are preferably used in the present invention. Film processor described on page 3, right column, lines 22 to 28 thereof is preferably used as the developing machine in the processing of the present invention.

Specific examples of processing agents, automatic developing machines and evaporation correction schemes preferably employed in carrying out of the present invention are described on page 5, right column, line 11 to page 7, right column, last line of the above journal of technical disclosure.

The processing agent for use in the present invention may be supplied in any form, for example, form of a liquid agent with the same concentration as in use or concentrated one, granules, powder, tablets, a paste or an emulsion. For example, a liquid agent stored in a container of low oxygen permeability is disclosed in JP-A-63-17453, vacuum packed powder or granules in JP-A's-4-19655 and 4-230748, granules containing a water soluble polymer in JP-A-4-221951, tablets in JP-A's-51-61837 and 6-102628 and a paste processing agent in PCT National Publication 57-500485. Although any of these can be suitably used, from the viewpoint of easiness in use, it is preferred to employ a liquid prepared in the same concentration as in use in advance.

Any one or a composite of polyethylene, polypropylene, polyvinyl chloride, polyethylene terephthalate, nylon, etc. is molded into the container for storing the above processing agents. These materials are selected in accordance with the required level of oxygen permeability. A material of low oxygen permeability is preferably used for storing an easily oxidized liquid such as a color developing solution, which is, for example, polyethylene terephthalate or a composite material of polyethylene and nylon. It is preferred that each of these materials be used in the container at a thickness of 500 to 1500 μm so that the oxygen permeability therethrough is 20 $mL/m^2 \cdot 24$ hrs·atm or less.

A magnetic recording layer preferably used in the present invention will be described below. This magnetic recording layer is formed by coating the surface of a support with an aqueous or organic solvent-based coating solution which is prepared by dispersing magnetic grains in a binder.

As the magnetic grains used in the present invention, it is possible to use, e.g., ferromagnetic iron oxide such as $\gamma Fe_2O_3$, Co-deposited $\gamma Fe_2O_3$, Co-deposited magnetite, Co-containing magnetite, ferromagnetic chromium dioxide, a ferromagnetic metal, a ferromagnetic alloy, Ba ferrite of a hexagonal system, Sr ferrite, Pb ferrite, and Ca ferrite. Co-deposited ferromagnetic iron oxide such as Co-deposited $\gamma Fe_2O_3$ is preferred. The grain can take the shape of any of, e.g., a needle, rice grain, sphere, cube, and plate. The specific area is preferably 20 $m^2/g$ or more, and more preferably, 30 $m^2/g$ or more as $S_{BET}$.

The saturation magnetization (σs) of the ferromagnetic substance is preferably $3.0\times10^4$ to $3.0\times10^5$ A/m, and most preferably, $4.0\times10^4$ to $2.5\times10^5$ A/m. A surface treatment can be performed for the ferromagnetic grains by using silica and/or alumina or an organic material. Also, the surface of the ferromagnetic grain can be treated with a silane coupling agent or a titanium coupling agent as described in JP-A-6-161032, the disclosure of which is incorporated herein by reference. A ferromagnetic grain whose surface is coated with an inorganic or organic substance described in JP-A-4-259911 or JP-A-5-81652, the disclosures of which are incorporated herein by reference, can also be used.

As a binder used in the magnetic grains, it is possible to use a thermoplastic resin, thermosetting resin, radiation-curing resin, reactive resin, acidic, alkaline, or biodegradable polymer, natural polymer (e.g., a cellulose derivative and sugar derivative), and their mixtures. These examples are described in JP-A-4-219569, the disclosure of which is incorporated herein by reference. The Tg of the resin is preferably −40° C. to 300° C., and its weight average molecular weight is preferably 2,000 to 1,000,000. Examples are a vinyl-based copolymer, cellulose derivatives such as cellulosediacetate, cellulosetriacetate, celluloseacetatepropionate, celluloseacetatebutylate, and cellulosetripropionate, acrylic resin, and polyvinylacetal resin. Gelatin is also preferred. Cellulosedi(tri)acetate is particularly preferred. This binder can be hardened by the addition of an epoxy-, aziridine-, or isocyanate-based crosslinking agent. Examples of the isocyanate-based crosslinking agent are isocyanates such as tolylenediisocyanate, 4,4'-diphenylmethanediisocyanate, hexamethylenediisocyanate, and xylylenediisocyanate, reaction products of these isocyanates and polyalcohol (e.g., a reaction product of 3 mols of tolylenediisocyanate and 1 mol of trimethylolpropane), and polyisocyanate produced by condensation of any of these isocyanates. These examples are described in JP-A-6-59357, the disclosure of which is incorporated herein by reference.

As a method of dispersing the magnetic substance in the binder, as described in JP-A-6-35092, the disclosure of which is incorporated herein by reference, a kneader, pin type mill, and annular mill are preferably used singly or together. Dispersants described in JP-A-5-088283, the disclosure of which is incorporated herein by reference, and other known dispersants can be used. The thickness of the magnetic recording layer is 0.1 to 10 μm, preferably 0.2 to 5 μm, and more preferably, 0.3 to 3 μm. The mass ratio of the magnetic grains to the binder is preferably 0.5:100 to 60:100, and more preferably, 1:100 to 30:100. The coating amount of the magnetic grains is 0.005 to 3 $g/m^2$, preferably 0.01 to 2 $g/m^2$, and more preferably, 0.02 to 0.5 $g/m^2$. The transmission yellow density of the magnetic recording layer is preferably 0.01 to 0.50, more preferably, 0.03 to 0.20, and most preferably, 0.04 to 0.15. The magnetic recording layer can be formed in the whole area of, or into the shape of stripes on, the back surface of a photographic support by coating or printing. As a method of coating the magnetic recording layer, it is possible to use any of an air doctor, blade, air knife, squeegee, impregnation, reverse roll, transfer roll, gravure, kiss, cast, spray, dip, bar, and extrusion. A coating solution described in JP-A-5-341436, the disclosure of which is incorporated herein by reference is preferred.

The magnetic recording layer can be given a lubricating property improving function, curling adjusting function, antistatic function, adhesion preventing function, and head polishing function. Alternatively, another functional layer can be formed and these functions can be given to that layer. A polishing agent in which at least one type of grains are aspherical inorganic grains having a Mohs hardness of 5 or more is preferred. The composition of this aspherical inorganic grain is preferably an oxide such as aluminum oxide, chromium oxide, silicon dioxide, titanium dioxide, and silicon carbide, a carbide such as silicon carbide and titanium carbide, or a fine powder of diamond. The surfaces of the grains constituting these polishing agents can be treated with a silane coupling agent or titanium coupling agent. These grains can be added to the magnetic recording layer or overcoated (as, e.g., a protective layer or lubricant layer) on the magnetic recording layer. A binder used together with the grains can be any of those described above and is preferably the same binder as in the magnetic recording layer. Light-sensitive materials having the magnetic recording layer are described in U.S. Pat. No. 5,336,589, U.S. Pat. No. 5,250,404, U.S. Pat. No. 5,229,259, U.S. Pat. No. 5,215,874, and EP 466,130, the disclosures of which are incorporated herein by reference.

A polyester support used in the present invention will be described below. Details of the polyester support and light-sensitive materials, processing, cartridges, and examples (to be described later) are described in Journal of Technical Disclosure No. 94-6023 (JIII; Mar. 15, 1994), the disclosure of which is incorporated herein by reference. Polyester used in the present invention is formed by using diol and aromatic dicarboxylic acid as essential components. Examples of the aromatic dicarboxylic acid are 2,6-, 1,5-, 1,4-, and 2,7-naphthalenedicarboxylic acids, terephthalic acid, isophthalic acid, and phthalic acid. Examples of the diol are diethyleneglycol, triethyleneglycol, cyclohexanedimethanol, bisphenol A, and bisphenol. Examples of the polymer are homopolymers such as polyethyleneterephthalate, polyethylenenaphthalate, and polycyclohexanedimethanolterephthalate. Polyester containing 50 to 100 mol % of 2,6-naphthalenedicarboxylic acid is particularly preferred.

Polyethylene-2,6-naphthalate is most preferred among other polymers. The average molecular weight ranges between about 5,000 and 200,000. The Tg of the polyester of the present invention is 50° C. or higher, preferably 90° C. or higher.

To give the polyester support a resistance to curling, the polyester support is heat-treated at a temperature of preferably 40° C. to less than Tg, and more preferably, Tg −20° C. to less than Tg. The heat treatment can be performed at a fixed temperature within this range or can be performed together with cooling. The heat treatment time is preferably 0.1 to 1500 hr, and more preferably, 0.5 to 200 hr. The heat treatment can be performed for a roll-like support or while a support is conveyed in the form of a web. The surface shape can also be improved by roughening the surface (e.g., coating the surface with conductive inorganic fine grains such as $SnO_2$ or $Sb_2O_5$). It is desirable to knurl and slightly raise the end portion, thereby preventing the cut portion of the core from being photographed. These heat treatments can be performed in any stage after support film formation, after surface treatment, after back layer coating (e.g., an antistatic agent or lubricating agent), and after undercoating. A favorable timing is after the antistatic agent is coated.

An ultraviolet absorbent can be incorporated into this polyester. Also, to prevent light piping, dyes or pigments such as Diaresin manufactured by Mitsubishi Kasei Corp. or Kayaset manufactured by NIPPON KAYAKU CO. LTD. commercially available for polyester can be incorporated.

In the present invention, it is preferable to perform a surface treatment in order to adhere the support and the light-sensitive material constituting layers. Examples of the surface treatment are surface activation treatments such as a chemical treatment, mechanical treatment, corona discharge treatment, flame treatment, ultraviolet treatment, high-frequency treatment, glow discharge treatment, active plasma treatment, laser treatment, mixed acid treatment, and ozone oxidation treatment. Among other surface treatments, the ultraviolet radiation treatment, flame treatment, corona treatment, and glow treatment are preferred.

An undercoat layer can include a single layer or two or more layers. Examples of an undercoat layer binder are copolymers formed by using, as a starting material, a monomer selected from vinyl chloride, vinylidene chloride, butadiene, methacrylic acid, acrylic acid, itaconic acid, and maleic anhydride. Other examples are polyethyleneimine, an epoxy resin, grafted gelatin, nitrocellulose, and gelatin. Resorcin and p-chlorophenol are examples of a compound which swells a support. Examples of a gelatin hardener added to the undercoat layer are chromium salt (e.g., chromium alum), aldehydes (e.g., formaldehyde and glutaraldehyde), isocyanates, an active halogen compound (e.g., 2,4-dichloro-6-hydroxy-s-triazine), an epichlorohydrin resin, and an active vinylsulfone compound. $SiO_2$, $TiO_2$, inorganic fine grains, or polymethylmethacrylate copolymer fine grains (0.01 to 10 μm) can also be contained as a matting agent.

In the present invention, an antistatic agent is preferably used. Examples of this antistatic agent are carboxylic acid, carboxylate, a macromolecule containing sulfonate, cationic macromolecule, and ionic surfactant compound.

As the antistatic agent, it is most preferable to use fine grains of at least one crystalline metal oxide selected from ZnO, $TiO_2$, $SnO_2$, $Al_2O_3$, $In_2O_3$, $SiO_2$, MgO, BaO, $MoO_3$, and $V_2O_5$, and having a volume resistivity of preferably $10^7$ Ω·cm or less, and more preferably, $10^5$ Ω·cm or less and a grain size of 0.001 to 1.0 μm, fine grains of composite oxides (e.g., Sb, P, B, In, S, Si, and C) of these metal oxides, fine grains of sol metal oxides, or fine grains of composite oxides of these sol metal oxides.

The content in a light-sensitive material is preferably 5 to 500 mg/m$^2$, and particularly preferably, 10 to 350 mg/m$^2$. The ratio of a conductive crystalline oxide or its composite oxide to the binder is preferably 1/300 to 100/1, and more preferably, 1/100 to 100/5.

A light-sensitive material of the present invention preferably has a slip property. Slip agent-containing layers are preferably formed on the surfaces of both a light-sensitive layer and back layer. A preferable slip property is 0.01 to 0.25 as a coefficient of kinetic friction. This represents a value obtained when a stainless steel sphere 5 mm in diameter is conveyed at a speed of 60 cm/min (25° C., 60% RH). In this evaluation, a value of nearly the same level is obtained when the surface of a light-sensitive layer is used as a sample to be measured.

Examples of a slip agent usable in the present invention are polyorganocyloxane, higher fatty acid amide, higher fatty acid metal salt, and ester of higher fatty acid and higher alcohol. As the polyorganocyloxane, it is possible to use, e.g., polydimethylcyloxane, polydiethylcyloxane, polystyrylmethylcyloxane, or polymethylphenylcyloxane. A layer to which the slip agent is added is preferably the outermost emulsion layer or back layer. Polydimethylcyloxane or ester having a long-chain alkyl group is particularly preferred.

A light-sensitive material of the present invention preferably contains a matting agent. This matting agent can be added to either the emulsion surface or back surface and is most preferably added to the outermost emulsion layer. The matting agent can be either soluble or insoluble in processing solutions, and the use of both types of matting agents is preferred. Favorable examples are polymethylmethacrylate grains, poly(methylmethacrylate/methacrylic acid=9/1 or 5/5 (molar ratio)) grains, and polystyrene grains. The grain size is preferably 0.8 to 10 μm, and a narrow grain size distribution is favored. It is preferable that 90% or more of all grains have grain sizes 0.9 to 1.1 times the average grain size. To increase the matting property, it is preferable to simultaneously add fine grains with a grain size of 0.8 μm or smaller. Examples are polymethylmethacrylate grains (0.2 μm), poly(methylmethacrylate/methacrylic acid=9/1 (molar ratio, 0.3 μm) grains, polystyrene grains (0.25 μm), and colloidal silica grains (0.03 μm).

A film cartridge used in the present invention will be described below. The principal material of the cartridge used in the present invention can be a metal or synthetic plastic.

Preferable plastic materials are polystyrene, polyethylene, polypropylene, and polyphenylether. The cartridge of the present invention can also contain various antistatic agents. For this purpose, carbon black, metal oxide grains, nonion-, anion-, cation-, and betaine-based surfactants, or a polymer can be preferably used. These cartridges subjected to the antistatic treatment are described in JP-A-1-312537 and JP-A-1-312538, the disclosures of which are incorporated herein by reference. It is particularly preferable that the resistance be $10^{12}$ Ω or less at 25° C. and 25% RH. Commonly, plastic cartridges are manufactured by using plastic into which carbon black or a pigment is incorporated in order to give a light-shielding property. The cartridge size can be a presently available 135 size. To miniaturize cameras, it is effective to decrease the diameter of a 25 mm cartridge of 135 size to 22 mm or less. The volume of a cartridge case is 30 cm$^3$ or less, preferably 25 cm$^3$ or less. The weight of plastic used in the cartridge and the cartridge case is preferably 5 to 15 g.

Furthermore, a cartridge which feeds a film by rotating a spool can be used in the present invention. It is also possible to use a structure in which a film leader is housed in a cartridge main body and fed through a port of the cartridge to the outside by rotating a spool shaft in the film feed direction. These structures are disclosed in U.S. Pat. No. 4,834,306 and U.S. Pat. No. 5,226,613, the disclosures of which are incorporated herein by reference. Photographic films used in the present invention can be so-called raw films before being developed or developed photographic films. Also, raw and developed photographic films can be accommodated in the same new cartridge or in different cartridges.

A color photographic light-sensitive material of the present invention is also suitably used as a negative film for Advanced Photo System (to be referred to as APS hereinafter). Examples are the NEXIA A, NEXIA F, and NEXIA H (ISO 200, 100, and 400, respectively) manufactured by Fuji Photo Film Co., Ltd. (to be referred to as Fuji Film hereinafter). These films are so processed as to have an APS format and set in an exclusive cartridge. These APS cartridge films are loaded into APS cameras such as the Fuji Film EPION Series (e.g., the EPION 300Z). A color photosensitive material of the present invention is also suited as a film with lens such as the Fuji Film FUJICOLOR UTSURUNDESU SUPER SLIM.

A photographed film is printed through the following steps in a mini-lab system.

(1) Reception (an exposed cartridge film is received from a customer)

(2) Detaching step (the film is transferred from the cartridge to an intermediate cartridge for development)

(3) Film development (4) Reattaching step (the developed negative film is returned to the original cartridge)

(5) Printing (prints of three types C, H, and P and an index print are continuously automatically printed on color paper [preferably the Fuji Film SUPER FA8])

(6) Collation and shipment (the cartridge and the index print are collated by an ID number and shipped together with the prints)

As these systems, the Fuji Film MINI-LAB CHAMPION SUPER FA-298/ FA-278/ FA-258/ FA-238 and the Fuji Film FRONTIER digital lab system are preferred.

Examples of a film processor for the MINI-LAB CHAMPION are the FP922AL/ FP562B/ FP562B,AL/ FP362B/ FP362B,AL and recommended processing chemicals are the FUJICOLOR JUST-IT CN-16L and CN-16Q.

Examples of a printer processor are the PP3008AR/ PP3008A/ PP1828AR/ PP1828A/ PP1258AR/ PP1258A/ PP728AR/ PP728A, and a recomended processing chemicals are the FUJICOLOR JUST-IT CP-47L and CP-40FAII. In the FRONTIER system, the SP-1000 scanner & image processor and the LP-1000P laser printer & paper processor or the LP-1000W laser printer are used. A detacher used in the detaching step and a reattacher used in the reattaching step are preferably the Fuji Film DT200/ DT100 and AT200/ AT100, respectively.

APS can also be enjoyed by PHOTO JOY SYSTEM whose main component is the Fuji Film Aladdin 1000 digital image workstation. For example, a developed APS cartridge film is directly loaded into the Aladdin 1000, or image information of a negative film, positive film, or print is input to the Aladdin 1000 by using the FE-550 35 mm film scanner or the PE-550 flat head scanner. Obtained digital image data can be easily processed and edited. This data can be printed out by the NC-550AL digital color printer using a photo-fixing heat-sensitive color printing system or the PICTOROGRAPHY 3000 using a laser exposure thermal development transfer system, or by existing laboratory equipment through a film recorder. The Aladdin 1000 can also output digital information directly to a floppy® disk or Zip disk or to an CD-R via a CD writer.

In a home, a user can enjoy photographs on a TV set simply by loading a developed APS cartridge film into the Fuji Film PHOTO PLAYER AP-1. Image information can also be continuously input to a personal computer by loading a developed APS cartridge film into the Fuji Film PHOTO SCANNER AS-1. The Fuji Film PHOTO VISION FV-10/ FV-5 can be used to input a film, print, or three-dimensional object. Furthermore, image information recorded in a floppy disk, Zip disk, CR-R, or hard disk can be variously processed on a computer by using the Fuji Film PHOTO FACTORY application software. The Fuji Film NC-2/ NC-2D digital color printer using a photo-fixing heat-sensitive color printing system is suited to outputting high-quality prints from a personal computer.

To keep developed APS cartridge films, the FUJICOLOR POCKET ALBUM AP-5 POP L, AP-1 POP L, or AP-1 POP KG, or the CARTRIDGE FILE 16 is preferred.

Examples of the present invention will be described below. However, the present invention is not limited to these examples.

EXAMPLE 1

Each of layers having compositions as the under-description was coated in piles on a cellulose triacetate film support on which under-coating was carried out, to prepare a multilayer color photosensitive material (sample 101).

Coating of Light-Sensitive Layer

Each of layers having compositions as the under-description was coated in piles to prepare a color negative film sample 101.

(Compositions of Light-Sensitive Layers)

The number corresponding to each component indicates the coating amount in units of g/m$^2$. The coating amount of a silver halide is indicated by the amount of silver.

(Sample 101)

| | | |
|---|---|---|
| 1st layer (1st antihalation layer) | | |
| Black colloidal silver | silver | 0.108 |
| Silver iodobromide emulsion grain (average grain diameter 0.07 μm, silver iodide content 2 mol %) | silver | 0.011 |
| Gelatin | | 0.900 |
| ExM-1 | | 0.040 |
| ExC-1 | | 0.002 |
| ExC-3 | | 0.002 |
| Cpd-2 | | 0.001 |
| F-8 | | 0.001 |
| HBS-1 | | 0.050 |
| HBS-2 | | 0.002 |
| 2nd layer (2nd antihalation layer) | | |
| Black colloidal silver | silver | 0.058 |
| Gelatin | | 0.440 |
| ExY-1 | | 0.040 |
| ExF-1 | | 0.003 |
| F-8 | | 0.001 |
| Solid disperse dye ExF-7 | | 0.130 |
| HBS-1 | | 0.080 |
| 3rd layer (Interlayer) | | |
| ExC-2 | | 0.045 |
| Cpd-1 | | 0.092 |
| Polyethylaclyrate latex | | 0.220 |

-continued

| | | |
|---|---|---|
| HBS-1 | | 0.120 |
| Gelatin | | 0.740 |
| 4th layer (Low-speed red-sensitive emulsion layer) | | |
| Em-C | silver | 0.380 |
| Em-D | silver | 0.520 |
| ExC-1 | | 0.188 |
| ExC-2 | | 0.012 |
| ExC-3 | | 0.077 |
| ExC-4 | | 0.123 |
| ExC-5 | | 0.012 |
| ExC-6 | | 0.008 |
| ExC-8 | | 0.053 |
| ExC-9 | | 0.020 |
| ExY-3 | | 0.009 |
| Cpd-2 | | 0.025 |
| Cpd-4 | | 0.023 |
| Cpd-7 | | 0.015 |
| UV-2 | | 0.050 |
| UV-3 | | 0.080 |
| UV-4 | | 0.020 |
| HBS-1 | | 0.250 |
| HBS-5 | | 0.038 |
| Gelatin | | 2.100 |
| 5th layer (Medium-speed red-sensitive emulsion layer) | | |
| Em-B | silver | 0.332 |
| Em-C | silver | 0.475 |
| ExC-1 | | 0.140 |
| ExC-2 | | 0.080 |
| ExC-3 | | 0.028 |
| ExC-4 | | 0.110 |
| ExC-5 | | 0.018 |
| ExC-6 | | 0.012 |
| ExC-8 | | 0.019 |
| ExC-9 | | 0.004 |
| ExY-3 | | 0.007 |
| Cpd-2 | | 0.036 |
| Cpd-4 | | 0.028 |
| Cpd-7 | | 0.020 |
| HBS-1 | | 0.120 |
| Gelatin | | 1.290 |
| 6th layer (High-speed red-sensitive emulsion layer) | | |
| Em-A | silver | 0.950 |
| ExC-1 | | 0.240 |
| ExC-3 | | 0.030 |
| ExC-6 | | 0.022 |
| ExC-8 | | 0.110 |
| ExC-9 | | 0.024 |
| ExM-6 | | 0.060 |
| ExY-3 | | 0.014 |
| Cpd-2 | | 0.060 |
| Cpd-4 | | 0.079 |
| Cpd-7 | | 0.030 |
| HBS-1 | | 0.290 |
| HBS-2 | | 0.060 |
| Gelatin | | 1.920 |
| 7th layer (Interlayer) | | |
| Cpd-1 | | 0.090 |
| Cpd-6 | | 0.372 |
| Solid disperse dye ExF-4 | | 0.032 |
| HBS-1 | | 0.052 |
| Polyethylacrylate latex | | 0.090 |
| Gelatin | | 0.900 |
| 8th layer (layer for donating interlayer effect to red-sensitive layer) | | |
| Em-E | silver | 0.800 |
| Cpd-4 | | 0.030 |
| ExM-2 | | 0.140 |
| ExM-3 | | 0.016 |
| ExM-4 | | 0.010 |
| ExY-1 | | 0.017 |
| ExY-3 | | 0.005 |
| ExY-4 | | 0.041 |
| ExC-7 | | 0.010 |
| ExC-10 | | 0.007 |

-continued

| | | |
|---|---|---|
| HBS-1 | | 0.222 |
| HBS-3 | | 0.003 |
| HBS-5 | | 0.030 |
| Gelatin | | 0.850 |
| 9th layer (Low-speed green-sensitive emulsion layer) | | |
| Em-H | silver | 0.263 |
| Em-I | silver | 0.310 |
| Em-J | silver | 0.350 |
| ExM-2 | | 0.245 |
| ExM-3 | | 0.050 |
| ExM-4 | | 0.120 |
| ExY-1 | | 0.010 |
| ExY-3 | | 0.006 |
| ExC-7 | | 0.004 |
| ExC-10 | | 0.002 |
| HBS-1 | | 0.330 |
| HBS-3 | | 0.008 |
| HBS-4 | | 0.200 |
| HBS-5 | | 0.050 |
| Cpd-5 | | 0.020 |
| Cpd-7 | | 0.020 |
| Gelatin | | 1.840 |
| 10th layer (Medium-speed green-sensitive emulsion layer) | | |
| Em-G | silver | 0.350 |
| Em-H | silver | 0.370 |
| ExM-2 | | 0.057 |
| ExM-3 | | 0.022 |
| ExM-4 | | 0.005 |
| ExM-5 | | 0.005 |
| ExY-3 | | 0.006 |
| ExC-6 | | 0.014 |
| ExC-7 | | 0.050 |
| ExC-8 | | 0.010 |
| ExC-10 | | 0.020 |
| HBS-1 | | 0.060 |
| HBS-3 | | 0.002 |
| HBS-4 | | 0.020 |
| HBS-5 | | 0.020 |
| Cpd-5 | | 0.020 |
| Cpd-7 | | 0.010 |
| Gelatin | | 0.650 |
| 11th layer (High-speed green-sensitive emulsion layer) | | |
| Em-F | silver | 0.950 |
| ExC-6 | | 0.003 |
| ExC-8 | | 0.014 |
| ExM-1 | | 0.017 |
| ExM-2 | | 0.025 |
| ExM-3 | | 0.020 |
| ExM-4 | | 0.005 |
| ExM-5 | | 0.005 |
| ExM-6 | | 0.060 |
| ExY-3 | | 0.008 |
| ExY-4 | | 0.005 |
| Cpd-3 | | 0.005 |
| Cpd-4 | | 0.007 |
| Cpd-5 | | 0.020 |
| Cpd-7 | | 0.020 |
| HBS-1 | | 0.149 |
| HBS-3 | | 0.003 |
| HBS-4 | | 0.020 |
| HBS-5 | | 0.037 |
| Polyethylacrylate latex | | 0.090 |
| Gelatin | | 1.200 |
| 12th layer (Yellow filter layer) | | |
| Cpd-1 | | 0.090 |
| Solid disperse dye ExF-2 | | 0.074 |
| Solid disperse dye ExF-5 | | 0.008 |
| Oil-soluble dye ExF-6 | | 0.008 |
| HBS-1 | | 0.040 |
| Gelatin | | 0.615 |
| 13th layer (Low-speed blue-sensitive emulsion layer) | | |
| Em-M | silver | 0.350 |
| Em-N | silver | 0.320 |

-continued

| | | |
|---|---|---|
| ExC-1 | | 0.022 |
| ExC-7 | | 0.006 |
| ExC-10 | | 0.003 |
| ExY-1 | | 0.003 |
| ExY-2 | | 0.350 |
| ExY-3 | | 0.007 |
| ExY-4 | | 0.050 |
| ExY-5 | | 0.410 |
| Cpd-2 | | 0.100 |
| Cpd-3 | | 0.004 |
| HBS-1 | | 0.220 |
| HBS-5 | | 0.070 |
| Gelatin | | 1.750 |
| 14th layer (Medium-speed blue-sensitive emulsion layer) | | |
| Em-L | silver | 0.500 |
| ExY-2 | | 0.041 |
| ExY-3 | | 0.006 |
| ExY-4 | | 0.040 |
| ExY-5 | | 0.050 |
| Cpd-2 | | 0.035 |
| Cpd-3 | | 0.001 |
| Cpd-7 | | 0.016 |
| HBS-1 | | 0.060 |
| Gelatin | | 0.350 |
| 15th layer (High-speed blue-sensitive emulsion layer) | | |
| Em-K | silver | 0.780 |
| ExY-2 | | 0.041 |
| ExY-3 | | 0.002 |
| ExY-4 | | 0.030 |
| ExY-5 | | 0.050 |
| Cpd-2 | | 0.035 |
| Cpd-3 | | 0.001 |
| Cpd-7 | | 0.016 |
| HBS-1 | | 0.060 |
| Gelatin | | 0.540 |
| 16th layer (1st protective layer) | | |
| Silver iodobromide emulsion grain (average grain diameter 0.07 μm, silver iodide content 2 mol %) | silver | 0.323 |
| UV-1 | | 0.210 |
| UV-2 | | 0.127 |
| UV-3 | | 0.190 |
| UV-4 | | 0.020 |
| UV-5 | | 0.204 |
| ExF-8 | | 0.001 |
| ExF-9 | | 0.001 |
| ExF-10 | | 0.002 |
| ExF-11 | | 0.001 |
| F-11 | | 0.009 |
| S-1 | | 0.086 |
| HBS-1 | | 0.170 |
| HBS-4 | | 0.052 |
| Gelatin | | 2.150 |
| 17th layer (2nd protective layer) | | |
| H-1 | | 0.400 |
| B-1 (diameter 1.7 μm) | | 0.050 |
| B-2 (diameter 1.7 μm) | | 0.150 |
| B-3 | | 0.050 |
| S-1 | | 0.200 |
| W-1 | | $9.0 \times 10^{-3}$ |
| Gelatin | | 0.700 |

In addition to the above components, to improve the storage stability, processability, resistance to pressure, antiseptic and mildewproofing properties, antistatic properties, and coating properties, the individual layers contained W-1 to W-9, B-4 to B-6, F-1 to F-19, lead salt, platinum salt, iridium salt, and rhodium salt.

Preparation of Dispersions of Organic Solid Disperse Dyes

ExF-2 in the 12th layer was dispersed by the following method.

| | |
|---|---|
| Wet cake (containing 17.6 mass % of water) of ExF-2 | 1.210 kg |
| W-7 | 0.400 kg |
| F-15 | 0.006 kg |
| Water | 8.384 kg |
| Total | 10.000 kg |

(pH was adjusted to 7.2 by NaOH)

A slurry having the above composition was coarsely dispersed by stirring by using a dissolver. The resultant material was dispersed at a peripheral speed of 10 m/s, a discharge amount of 0.6 kg/min, and a packing ratio of 0.3-mm diameter zirconia beads of 80% by using an agitator mill, thereby obtaining a solid disperse dye ExF-2. The average grain size of the fine dye grains was 0.15 μm.

Following the same procedure as above, solid disperse dyes ExF-4 and ExF-7 were obtained. The average grain sizes of the fine dye grains were 0.28 and 0.49 μm, respectively. ExF-5 was dispersed by a microprecipitation dispersion method described in Example 1 of EP549,489A, the disclosure of which is incorporated herein by reference. The average grain size was found to be 0.06 μm.

The characteristics of emulsion used in examples of the present invention will be described in Tables 1 to 4.

TABLE 1

Characteristics of silver halide grains contained in Em-A to Em-N

| Emulsion name | Layer used | Grain shape | ESD*1 (μm) | ECD(μm)*2/ VC(%)*3 |
|---|---|---|---|---|
| Em-A | High-speed red-sensitive layer | (111)main plane tabular grain | 0.95 | 2.20/32 |
| Em-B | Medium-speed red-sensitive layer | (111)main plane tabular grain | 0.69 | 1.30/35 |
| Em-C | Medium and low-speed red-sensitive layers | (111)main plane tabular grain | 0.48 | 0.89/17 |
| Em-D | Low-speed red-sensitive layer | (111)main plane tabular grain | 0.31 | 0.40/20 |
| Em-E | Layer for donating interlayer effect to red-sensitive layer | (111)main plane tabular grain | 0.78 | 1.38/24 |
| Em-F | High-speed green-sensitive layer | (111)main plane tabular grain | 0.95 | 2.20/32 |
| Em-G | Medium-speed green-sensitive layer | (111)main plane tabular grain | 0.74 | 1.64/34 |
| Em-H | Medium and low-speed green-sensitive layers | (111)main plane tabular grain | 0.55 | 0.79/30 |
| Em-I | Low-speed green-sensitive layer | (111)main plane tabular grain | 0.44 | 0.53/30 |
| Em-J | Low-speed green-sensitive layer | (111)main plane tabular grain | 0.31 | 0.40/20 |
| Em-K | High-speed blue-sensitive layer | (111)main plane tabular grain | 0.81 | 1.10/30 |
| Em-L | Medium-speed blue-sensitive layer | (111)main plane tabular grain | 0.51 | 0.80/24 |
| Em-M | Low-speed blue-sensitive layer | (111)main plane tabular grain | 0.40 | 0.55/32 |

TABLE 1-continued

Characteristics of silver halide grains contained in Em-A to Em-N

| | | | | |
|---|---|---|---|---|
| Em-N | Low-speed blue-sensitive layer | (100)main plane cubic grain | 0.21 | 0.21/20 |

| Emulsion name | Av. thickness (μm)/ VC*4 (%) | Av. aspect ratio | Ratio of tabular grains*5 (%) | Av. thickness of core portion (μm) | Annual ring structure of core portion | Number of dislocation lines per one grain |
|---|---|---|---|---|---|---|
| Em-A | 0.12/14 | 18 | 97 | 0.09 | Absence | 10≦ |
| Em-B | 0.10/15 | 13 | 90 | 0.07 | Absence | 10≦ |
| Em-C | 0.09/12 | 10 | 99 | — | — | 10≦ |
| Em-D | 0.09/9.3 | 4.5 | 98 | — | — | 10≦ |
| Em-E | 0.15/13 | 9.2 | 90 | 0.12 | Presence | 10≦ |
| Em-F | 0.12/14 | 18 | 97 | 0.09 | Absence | 10≦ |
| Em-G | 0.10/15 | 16 | 96 | 0.07 | Absence | 10≦ |
| Em-H | 0.14/13 | 5.5 | 97 | 0.11 | Presence | 10≦ |
| Em-I | 0.17/18 | 3.2 | 97 | 0.13 | Presence | 10≦ |
| Em-J | 0.09/9.3 | 4.5 | 98 | — | — | 10≦ |
| Em-K | 0.23/18 | 4.7 | 97 | 0.13 | Presence | 10≦ |
| Em-L | 0.19/22 | 4.3 | 98 | 0.12 | Absence | 10≦ |
| Em-M | 0.13/16 | 4.6 | 96 | 0.11 | Presence | 10≦ |
| Em-N | 0.21/20 | 1 | — | — | — | — |

*1ESD: average equivalent-sphere diameter

*2ECD: average equivalent-circular diameter

*3VC: variation coefficient

*4VC: variation coefficient

*5Ratio of tabular grains based on the total projected area occupied by all the grains (%)

TABLE 2

Composition structures of silver halide grains contained in Em-A to Em-N

| Emulsion name | Characteristics of grains occupying 70% or more based on the total projected area | Silver amount ratio of grain structure (%) and halogen composition (listed in order from center of grain) <> indicates epitaxial junction portion |
|---|---|---|
| Em-A | (111)main plane tabular grain | (11%)AgBr/(35%)$AgBr_{97}I_3$/(18%)AgBr/(9%)$AgBr_{62}I_{38}$/(27%)AgBr |
| Em-B | (111)main plane tabular grain | (7%)AgBr/(31%)$AgBr_{97}I_3$/(16%)AgBr/(12%)$AgBr_{62}I_{38}$/(34%)AgBr |
| Em-C | (111)main plane tabular grain | (1%)AgBr/(77%)$AgBr_{99}I_1$/(9%)$AgBr_{95}I_5$/(13%)<$AgBr_{63}Cl_{35}I_2$> |
| Em-D | (111)main plane tabular grain | (57%)AgBr/(14%)$AgBr_{96}I_4$/(29%)<$AgBr_{57}Cl_{41}I_2$> |
| Em-E | (111)main plane tabular grain | (13%)AgBr/(36%)$AgBr_{97}I_3$/(7%)AgBr/(11%)$AgBr_{62}I_{38}$/(33%)AgBr |
| Em-F | (111)main plane tabular grain | (11%)AgBr/(35%)$AgBr_{97}I_3$/(18%)AgBr/(4%)AgI/(32%)AgBr |
| Em-G | (111)main plane tabular grain | (11%)AgBr/(35%)$AgBr_{97}I_3$/(18%)AgBr/(4%)AgI/(32%)AgBr |
| Em-H | (111)main plane tabular grain | (15%)AgBr/(44%)$AgBr_{97}I_3$/(11%)AgBr/(5%)AgI/(25%)AgBr |
| Em-I | (111)main plane tabular grain | (60%)AgBr/(2%)AgI/(38%)AgBr |
| Em-J | (111)main plane tabular grain | (57%)AgBr/(14%)$AgBr_{96}I_4$/(29%)<$AgBr_{57}Cl_{41}I_2$> |
| Em-K | (111)main plane tabular grain | (12%)AgBr/(43%)$AgBr_{90}I_{10}$/(14%)AgBr/(2%)AgI/(29%)AgBr |
| Em-L | (111)main plane tabular grain | (8%)AgBr/(10%)$AgBr_{95}I_5$/(52%)$AgBr_{93}I_7$/(11%)AgBr/(2%)AgI/(17%)AgBr |
| Em-M | (111)main plane tabular grain | (58%)AgBr/(4%)AgI/(38%)AgBr |
| Em-N | (100)main plane cubic grain | (6%)AgBr/(94%)$AgBr_{96}I_4$ |

TABLE 3

Characteristics of silver halide grains contained in Em-A to Em-N

| Emulsion name | Av. silver iodide content(mol %)/ VC*1 of inter-grain(%) | Surface iodide content (mol %) | Av. chloride content (mol %)/ VC*1 of inter-grain(%) | Surface chloride content (mol %) | Twin plane spacing (μm)/ VC*1 (%) | (100) face ratio in side planes (%) | Ratio*2 of grains satisfying requirement A*3 (%) |
|---|---|---|---|---|---|---|---|
| Em-A | 4.5/10 | 3.90 | 0 | 0 | 0.011/30 | 20 | 55 |
| Em-B | 5.5/11 | 5.00 | 0 | 0 | 0.010/30 | 30 | 75 |
| Em-C | 1.5/10 | 3.70 | 4.7/8.0 | 16 | 0.010/31 | 25 | — |
| Em-D | 1.1/11 | 5.00 | 12/9.0 | 23 | 0.009/29 | 25 | — |
| Em-E | 5.3/10 | 5.90 | 0 | 0 | 0.012/30 | 35 | 20 |
| Em-F | 5.1/10 | 3.90 | 0 | 0 | 0.012/30 | 20 | 60 |
| Em-G | 6.3/13 | 5.60 | 0 | 0 | 0.010/30 | 30 | 65 |
| Em-H | 6.3/12 | 7.39 | 0 | 0 | 0.016/32 | 20 | 15 |
| Em-I | 2.0/14 | 5.68 | 0 | 0 | 0.016/32 | 35 | 18 |
| Em-J | 6.3/13 | 5.60 | 0 | 0 | 0.010/30 | 30 | 65 |
| Em-K | 6.3/9.0 | 1.90 | 0 | 0 | 0.019/30 | 30 | 15 |
| Em-L | 6.1/8.0 | 5.50 | 0 | 0 | 0.019/33 | 30 | 18 |
| Em-M | 4.0/10 | 5.50 | 0 | 0 | 0.020/31 | 30 | 20 |
| Em-N | 3.8/9.0 | 4.50 | 0 | 0 | — | — | — |

*1VC: variation coefficient

*2Ratio of grains satisfying requirement A to all grains in number (%)

*3It is a silver iodobromide grain or a silver iodochlorobromide grain having a (111) main plane in which an equivalent-circular diameter is 1.0 μm or more and the grain thickness is 0.15 μm or less, the grain having 10 or more dislocation lines. Further, the grain has a core portion having a thickness of 0.1 μm or less in which the core portion comprises silver iodobromide and does not contain an annual ring structure.

TABLE 4

Sensitizing dye and dopant used in Em-A to Em-N

| Emulsion name | Layer used | Sensitizing dye | Dopant |
|---|---|---|---|
| Em-A | High-speed red-sensitive layer | 2, 3, 14 | $K_2IrCl_6$, $K_4Ru(CN)_6$ |
| Em-B | Medium-speed red-sensitive layer | 1, 2, 3 | $K_2IrCl_6$, $K_2IrCl_5(H_2O)$, $K_4Ru(CN)_6$ |
| Em-C | Medium and low-speed red-sensitive layers | 2, 3, 14 | $K_2IrCl_6$, $K_4Fe(CN)_6$ |
| Em-D | Low-speed red-sensitive layer | 2, 3, 14 | $K_2IrCl_6$, $K_4Fe(CN)_6$ |
| Em-E | Layer for donating interlayer effect to red-sensitive layer | 7, 8 | $K_4Fe(CN)_6$ |
| Em-F | High-speed green-sensitive layer | 4, 5, 6, 8 | $K_2IrCl_6$, $K_4Ru(CN)_6$ |
| Em-G | Medium-speed green-sensitive layer | 4, 5, 6, 8 | $K_2IrCl_6$, $K_4Ru(CN)_6$ |
| Em-H | Medium and low-speed green-sensitive layers | 4, 5, 6, 8, 13 | $K_2IrCl_6$ |
| Em-I | Low-speed green-sensitive layer | 6, 8, 13 | $K_2IrCl_6$, $K_4Fe(CN)_6$ |
| Em-J | Low-speed green-sensitive layer | 6, 8, 13 | $K_2IrCl_6$, $K_4Fe(CN)_6$ |
| Em-K | High-speed blue-sensitive layer | 9 | — |
| Em-L | Medium-speed blue-sensitive layer | 16 | — |
| Em-M | Low-speed blue-sensitive layer | 9, 15 | — |
| Em-N | Low-speed blue-sensitive layer | 12, 15 | $K_2IrCl_6$ |

Emulsions Em-A, B, F, G and L were prepared referring to the preparation process of emulsion 1-F described in Example of JP-A-2002-268162.

Emulsions Em-E, H, I, K and M were prepared referring to the preparation process of emulsion 1-D described in Example of JP-A-2002-268162.

Emulsions Em-C, D and J were prepared referring to the preparation process of emulsion described in Example of JP-A-2002-278007.

Emulsion Em-N was prepared referring to the preparation process described in Example 1 Em-N of JP-A-2002-72429.

Emulsions Em-K to N were sensitized by reduction at preparation of particles.

The optimum amount of spectral sensitization dyes described in Table 4 was added to the emulsions and gold sensitization, sulfur sensitization and selenium sensitization were optimally carried out.

The sensitizing dyes used in examples of the present invention will be described below.

Sensitizing dye 1

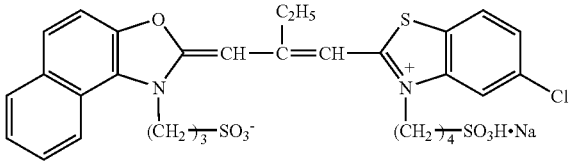

Sensitizing dye 2

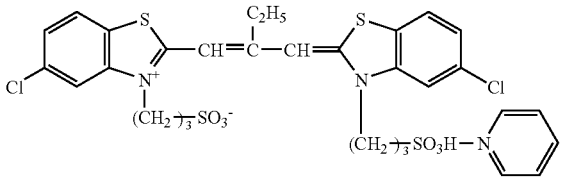

-continued

Sensitizing dye 3

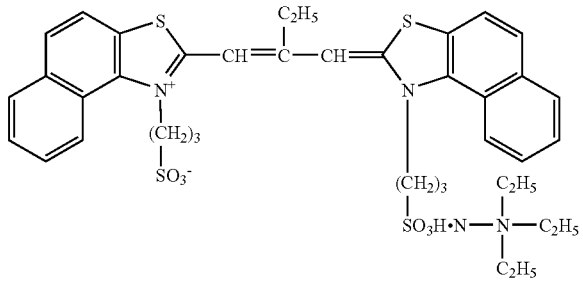

Sensitizing dye 4

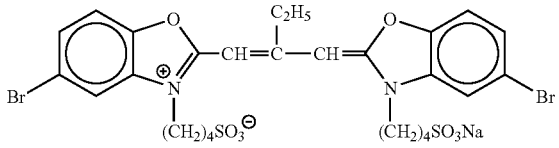

Sensitizing dye 5

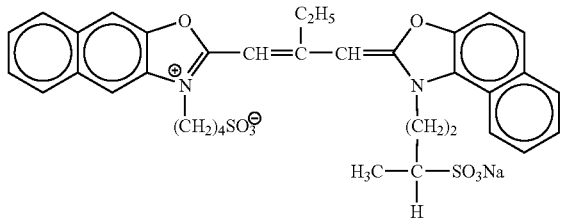

Sensitizing dye 6

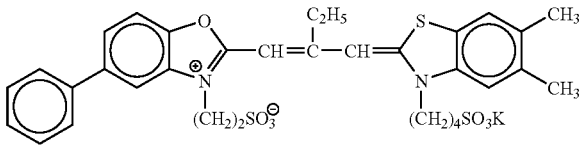

Sensitizing dye 7

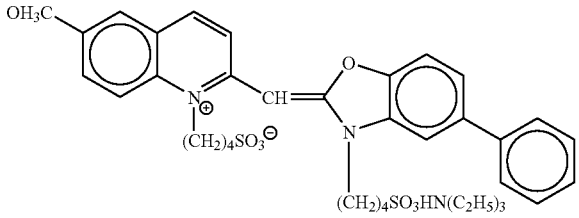

Sensitizing dye 8

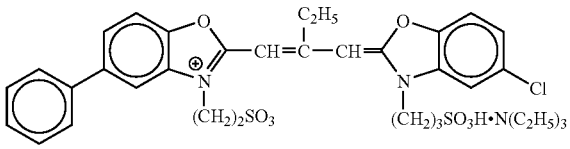

Sensitizing dye 9

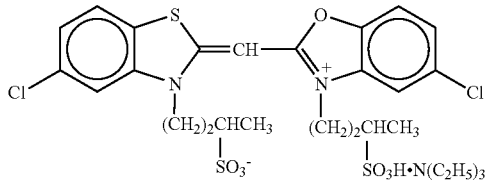

-continued
Sensitizing dye 12
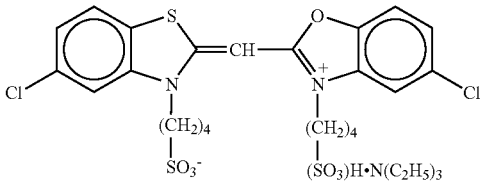
Sensitizing dye 13
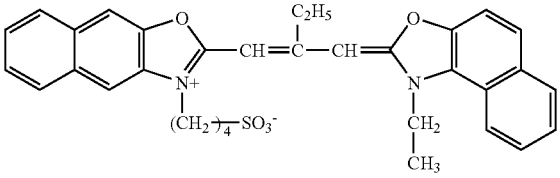
Sensitizing dye 14
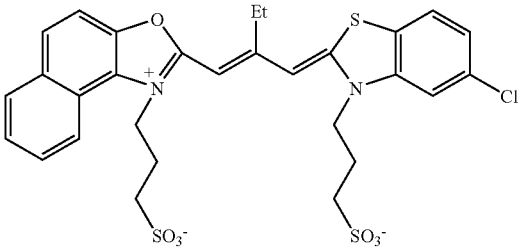
-continued
Sensitizing dye 15
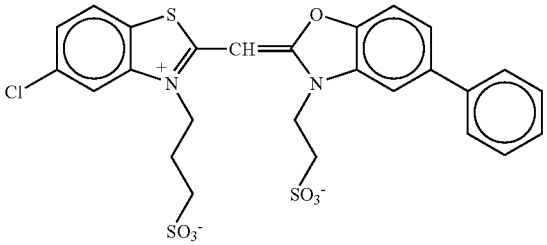
Sensitizing dye 16
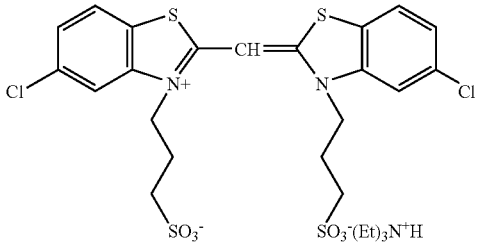
Other compounds used in examples of the present invention will be described below.
ExC-1
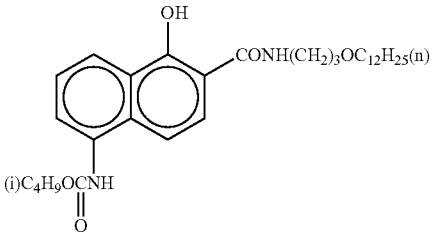
ExC-2
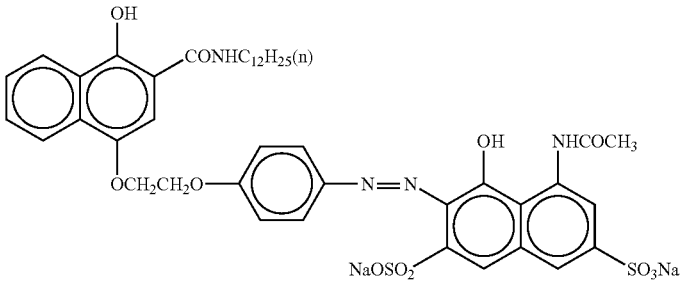
ExC-3
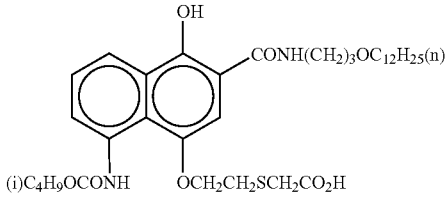

-continued
ExC-4
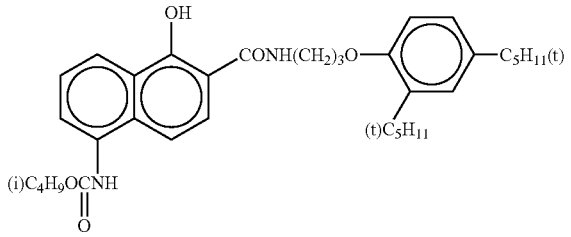
ExC-5
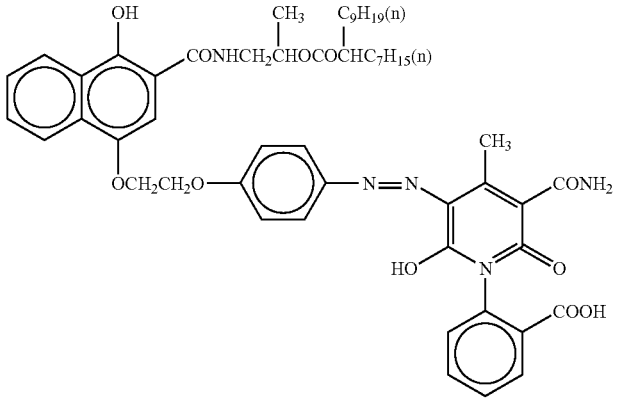
ExC-6
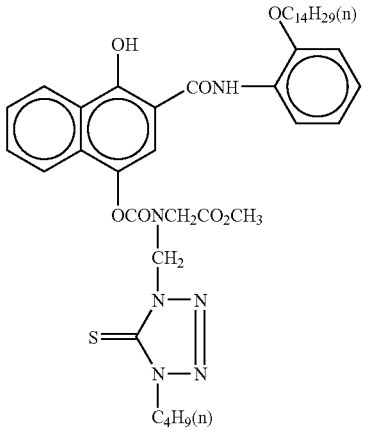
ExC-7
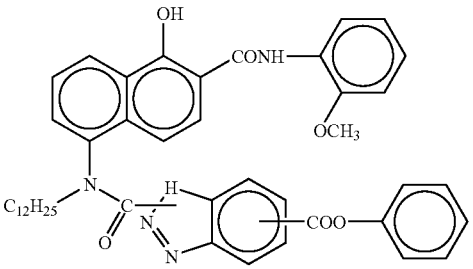

-continued
ExC-8
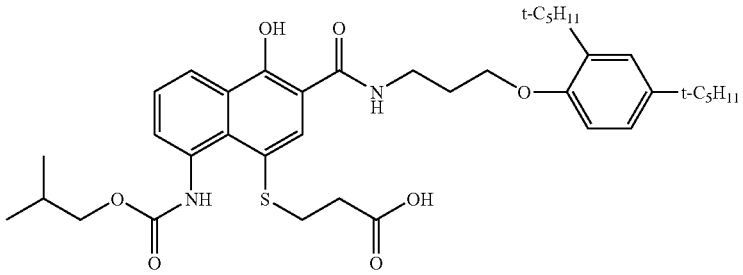
ExC-9
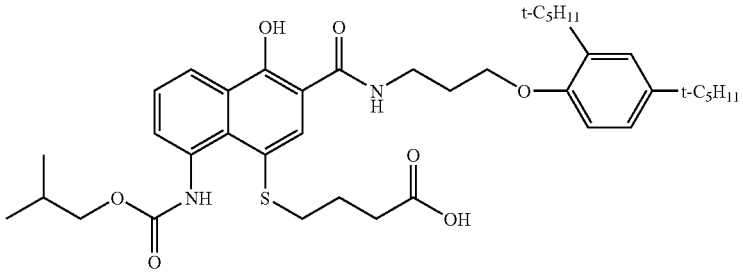
ExC-10
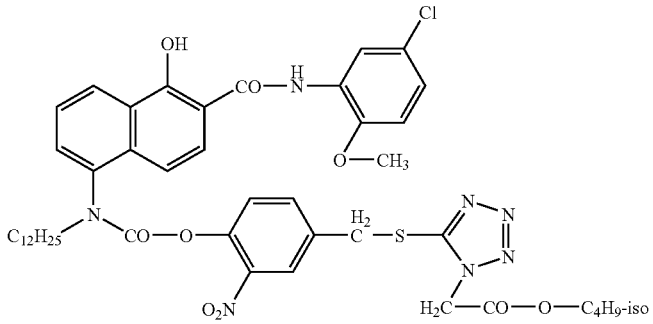
ExM-1
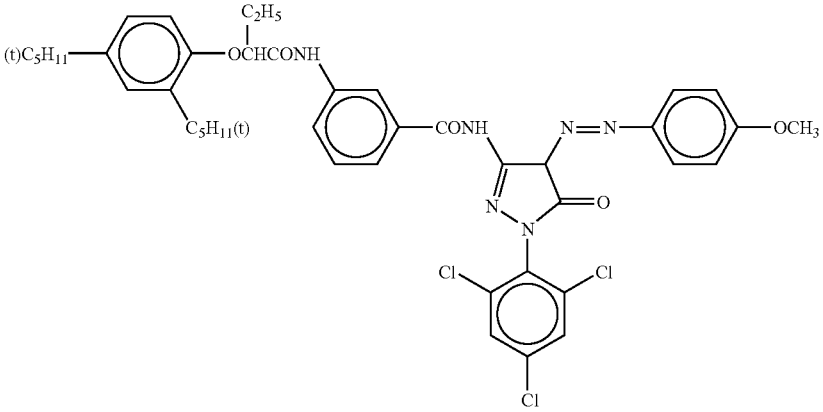

-continued
ExM-2
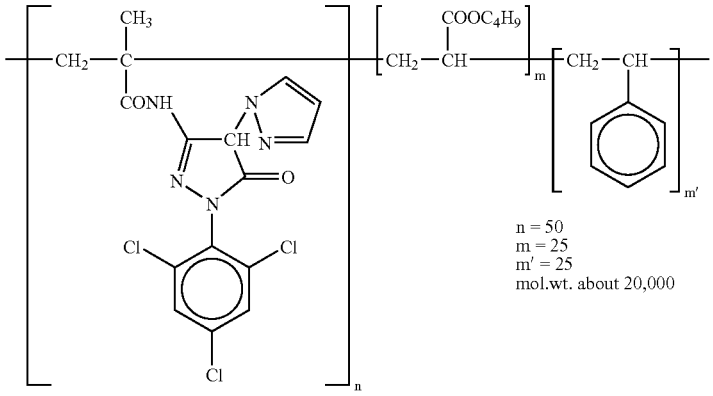
ExM-3
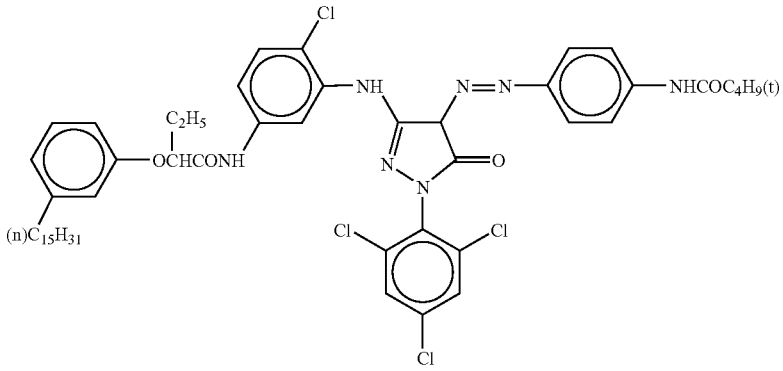
ExM-4
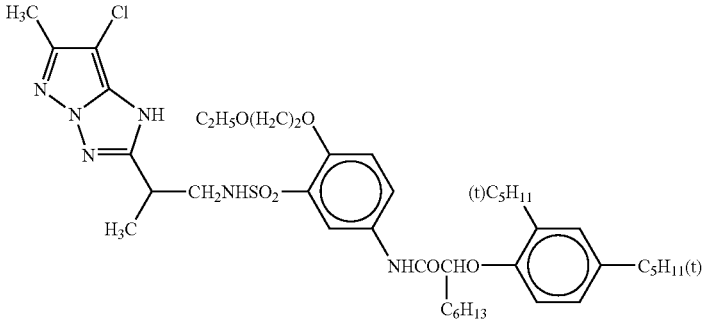
ExM-5
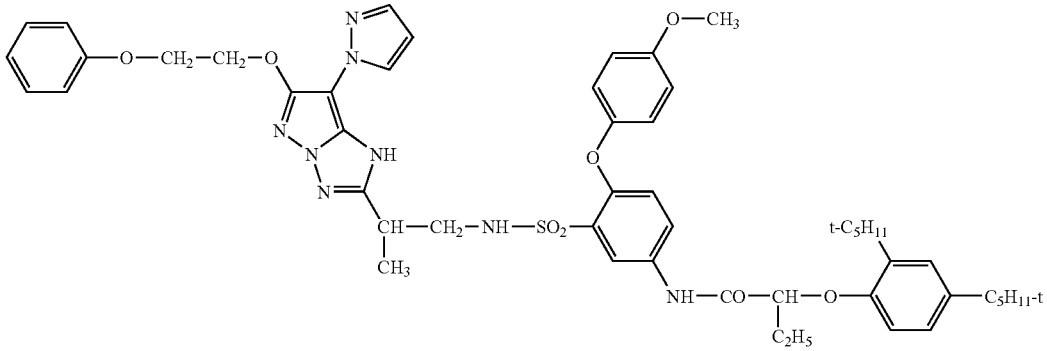

-continued
ExM-6
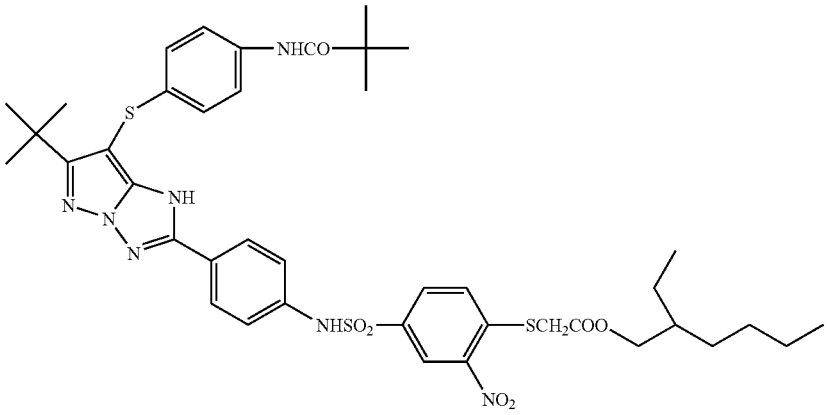
ExY-1
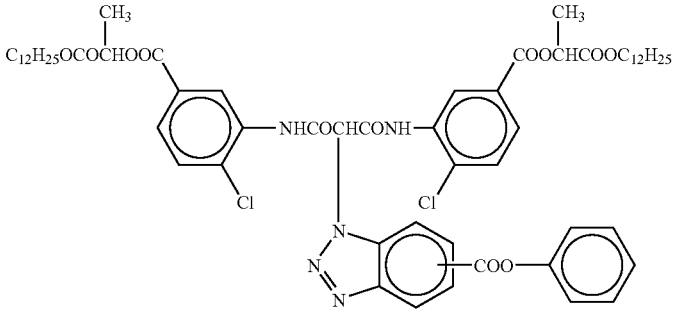
ExY-2
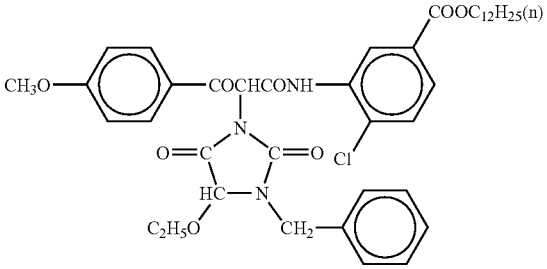
ExY-3
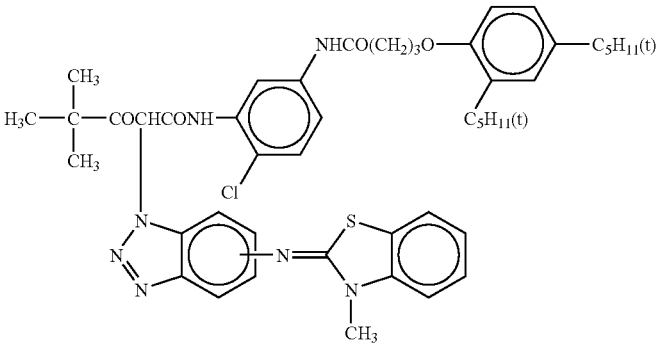

-continued
ExY-4
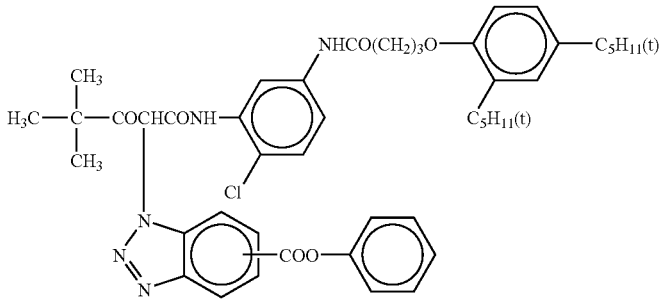
ExY-5
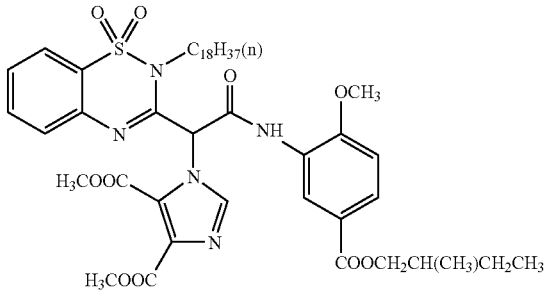
Cpd-1
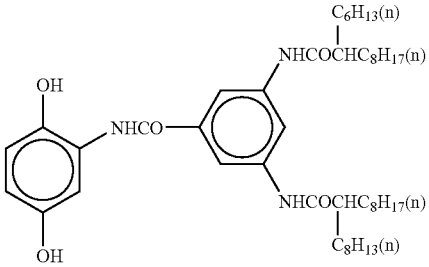
Cpd-2
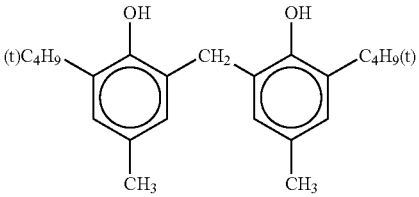
Cpd-3
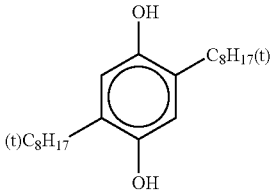
Cpd-4
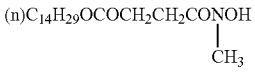
Cpd-5
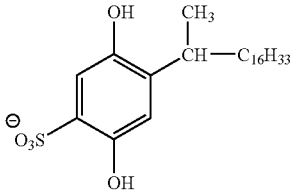

-continued
Cpd-6
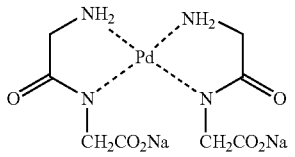
Cpd-7
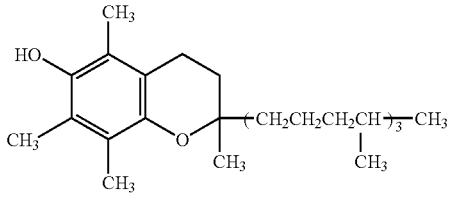
UV-1
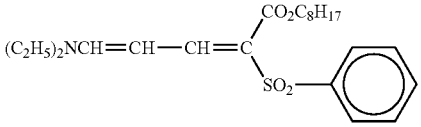
UV-2
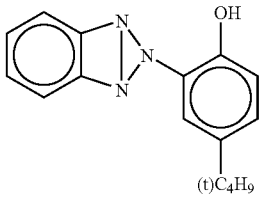
UV-3
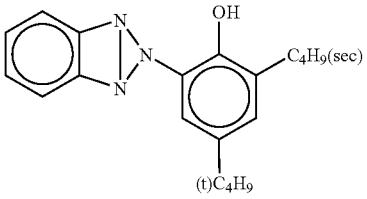
UV-4
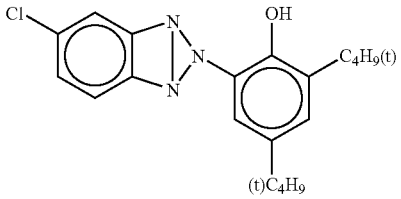
UV-5
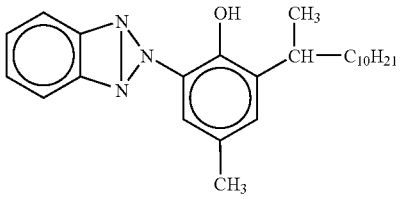
B-1
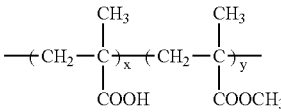
x/y = 10/90 (mass ratio)
Weight-average molecular
weight: about 35,000

-continued
B-2
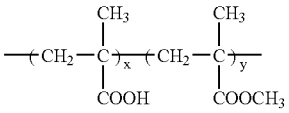
x/y = 40/60 (mass ratio)
Weight-average molecular weight: about 20,000
B-3
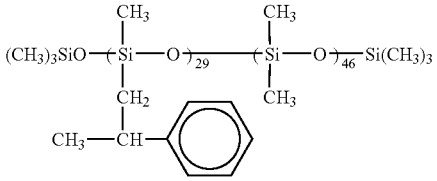
(mole ratio)
Weight-average molecular weight: about 8,000
B-4
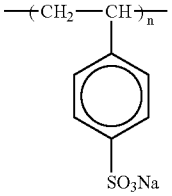
Weight-average molecular weight: about 750,000
B-5
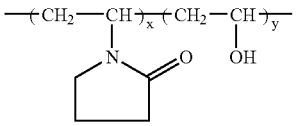
x/y = 70/30 (mass ratio)
Weight-average molecular weight: about 17,000
B-6
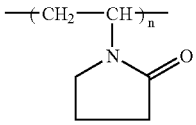
Weight-average molecular weight: about 10,000
HBS-1 Tricresyl phosphate
HBS-2 Di-n-butyl phthalate
HBS-3
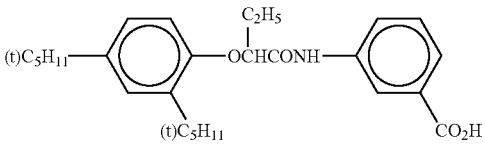
HBS-4 Tri (2-ethylhexyl) phosphate
HBS-5
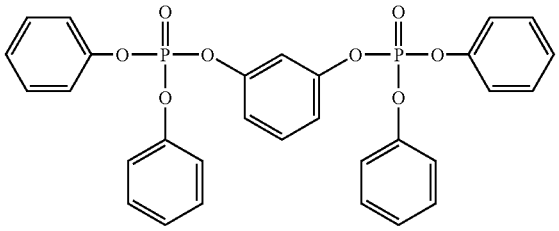

-continued
S-1
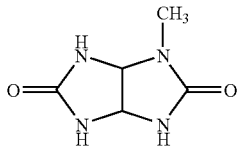
H-1
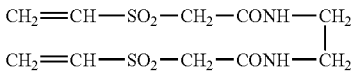
F-1
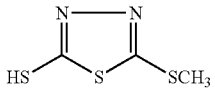
F-2
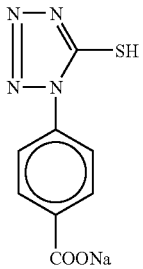
F-3
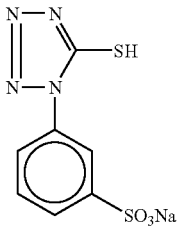
F-4
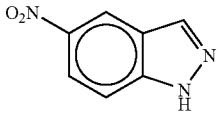
F-5
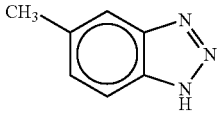
F-6
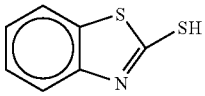
F-7
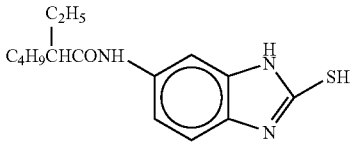

-continued
F-8
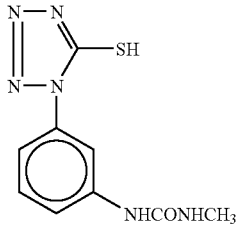
F-9
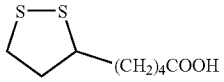
F-10
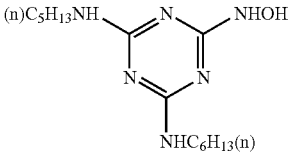
F-11
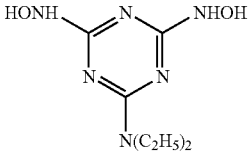
F-12
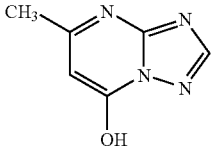
F-13
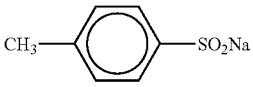
F-14
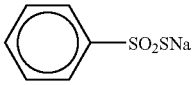
F-15
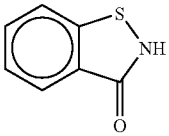
F-16
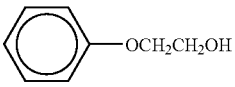
F-17
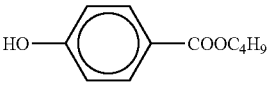
F-18
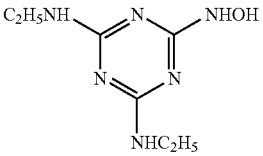

-continued

F-19

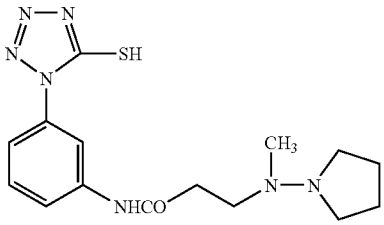

W-1

$C_8F_{17}SO_2NHCH_2CH_2CH_2OCH_2CH_2\overset{\oplus}{N}(CH_3)_3$

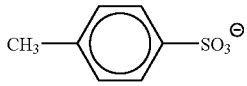

W-2

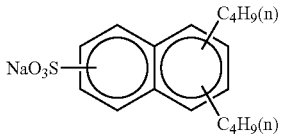

W-3

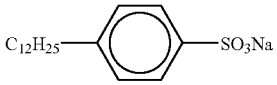

W-4

$$\begin{array}{l} \qquad\quad C_2H_5 \\ \qquad\quad | \\ (n)C_4H_9CHCH_2COOCH_2 \\ \qquad\qquad\qquad\quad | \\ (n)C_4H_9CHCH_2COOCHSO_3Na \\ \qquad\quad | \\ \qquad\quad C_2H_5 \end{array}$$

W-5

$nC_{10}H_{21}O\text{—}(CH_2CH_2O)_x\text{—}SO_3Na$ x = 1 to 3

W-6

$nC_{10}H_{21}O\text{—}(CH_2CH_2O)_z\text{—}C_4H_8SO_3Na$ z = 1 to 3

W-7

$$\text{—}(CH_2\underset{\underset{COOC_4H_9(n)}{|}}{CH})_x\text{—}(CH_2\underset{\underset{COOCH_3}{|}}{CH})_y\text{—}(CH_2\underset{\underset{COOH}{|}}{CH})_z\text{—}$$

x/y/z = 20/60/20
(mass ratio)
Weight-average molecular
weight: about 36,000

W-8

$C_{11}H_{23}\text{—}CH{=}CH\text{—}CH_2\text{—}SO_3Na$ 60%

$C_{11}H_{23}\text{—}\underset{\underset{OH}{|}}{CH}\text{—}CH_2\text{—}CH_2\text{—}SO_3Na$ 40%

W-9

$HO\text{—}(CH(CH_3)CH_2O)_{26.5}\text{—}(CH_2CH_2O)_{85.3}\text{—}(CH_2CH(CH_3)O)_{26.5}\text{—}H$ ExF-1

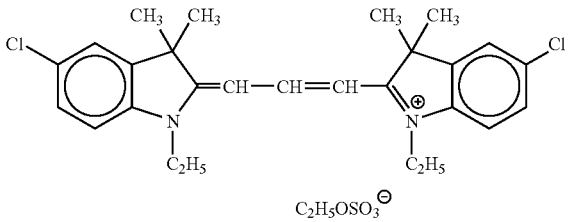

-continued
ExF-2
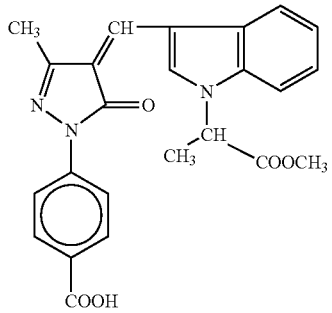
ExF-4
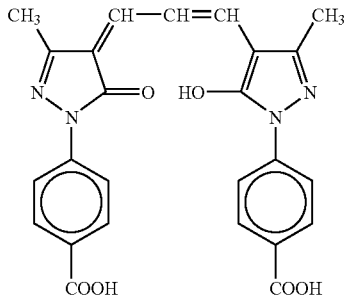
ExF-5
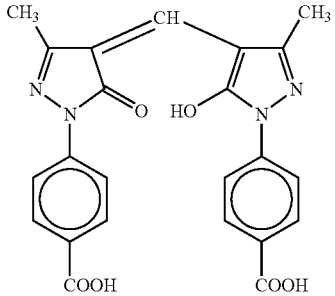
ExF-6
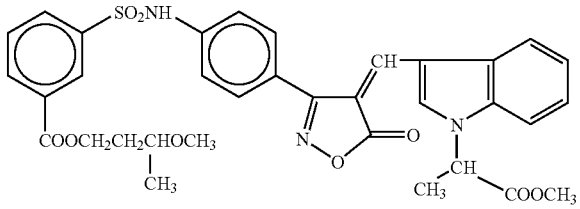
ExF-7
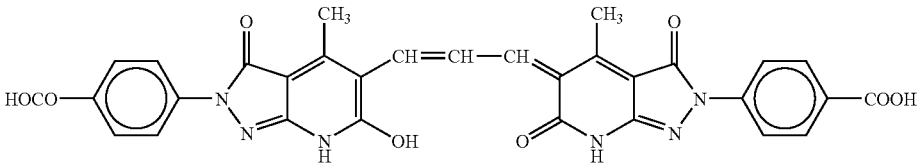

-continued

ExF-8

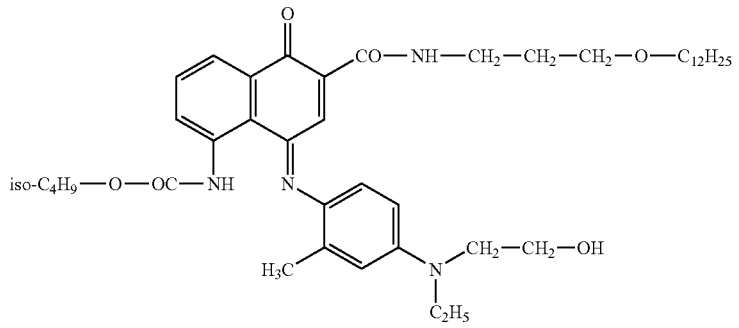

ExF-9

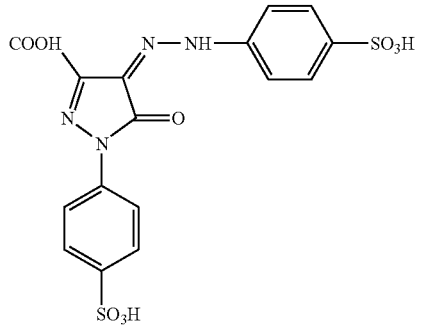

ExF-10

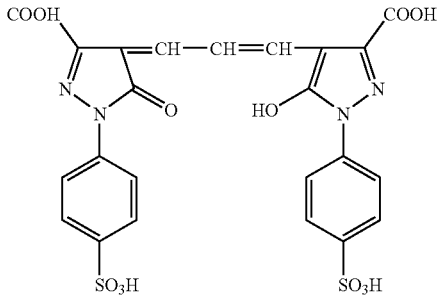

ExF-11

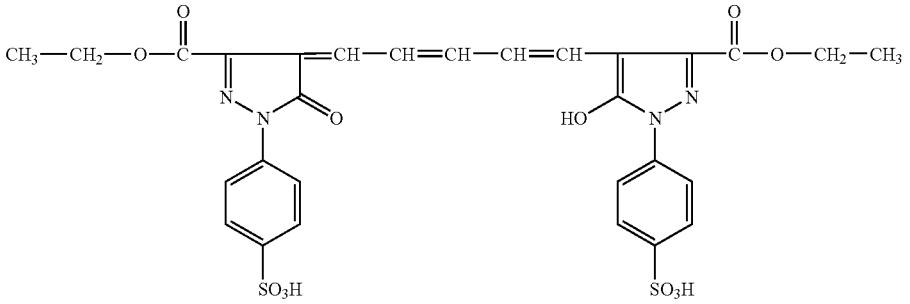

The above-mentioned silver halide color photosensitive material is referred to as sample 101.

The compounds 7, 22, 35 and T-1 were added respectively to the emulsion Em-A of 6th layer, the emulsion Em-F of 11th layer and the emulsion Em-K of 15th layer as shown in Table 5 to prepare Em-A-1 to Em-A-4, Em-F-1 to Em-F-4 and Em-K-1 to Em-K-4.

TABLE 5

| Compound selected from type 1 and type 2 | 6th layer emulsion/ Add. amount* | 11th layer emulsion/ Add. amount | 15th layer emulsion/ Add. amount |
|---|---|---|---|
| 7 | Em-A-1/3 × $10^{-7}$ | Em-F-1/3 × $10^{-7}$ | Em-K-1/3 × $10^{-6}$ |
| 22 | Em-A-2/3 × $10^{-7}$ | Em-F-2/3 × $10^{-7}$ | Em-K-2/3 × $10^{-6}$ |

TABLE 5-continued

| Compound selected from type 1 and type 2 | 6th layer emulsion/ Add. amount* | 11th layer emulsion/ Add. amount | 15th layer emulsion/ Add. amount |
|---|---|---|---|
| 35 | Em-A-3/3 × $10^{-7}$ | Em-F-3/3 × $10^{-7}$ | Em-K-3/3 × $10^{-6}$ |
| T-1 | Em-A-4/3 × $10^{-7}$ | Em-F-4/3 × $10^{-7}$ | Em-K-4/3 × $10^{-6}$ |

*mol/mol Ag (Preparation of Samples 102 to 119)

Samples 102 to 119 were prepared in such a manner that for Sample 101, the emulsion Em-A of the $6^{th}$ layer, the emulsion Em-F of the $11^{th}$ layer and the emulsion Em-K of the $15^{th}$ layer were replaced with the emulsion of the present invention described in Table 5 and W-1 added to the $17^{th}$ (the second protective layer) was changed to the compound (A) in equal mass as shown in Table 6.

The evaluation of sensitivity measurement, charge adjusting ability test, high speed coating adoptability test and processing variation were carried out for the above samples.

As sensitometry, ISO sensitivity which is the international standard is generally used at determining specific sensitivity in the industry but it is prescribed in the ISO sensitivity that the development of a photosensitive material is carried out at the 5th day after exposure and development processing is according to the assignment of respective companies.

In the present invention, time until development processing after exposure is shortened and the fixed development processing was designed to be carried out.

The determining method is substantially in accordance with JIS K 7614-1981 except that the development processing is completed within 30 min to 6 hr after exposure for sensitometry and that the development processing is performed according to Fuji Color standard processing recipe CN-16.

Samples 101 to 108 were exposed through, manufactured by Fuji Photo Film Co., Ltd., gelatin filter SC-39 and continuous wedge for 1/100 sec.

The samples after the exposure were processed in the following manner.

(Processing Procedure)

| Step | Processing time | Processing temp. |
|---|---|---|
| Color development: | 3 min 15 sec | 38° C. |
| Bleaching: | 3 min 00 sec | 38° C. |
| Washing: | 30 sec | 24° C. |
| Fixing: | 3 min 00 sec | 38° C. |
| Washing (1): | 30 sec | 24° C. |
| Washing (2): | 30 sec | 24° C. |
| Stabilization: | 30 sec | 38° C. |
| Drying: | 4 min 20 sec | 55° C. |

The composition of the processing solution for use in each of the above steps is as follows:

| | (Unit: g) |
|---|---|
| (Color developer) | |
| Diethylenetriaminepentaacetic acid | 1.0 |
| 1-Hydroxyethylidene-1,1-diphosphonic acid | 2.0 |
| Sodium sulfite | 4.0 |

-continued

| | (Unit: g) |
|---|---|
| Potassium carbonate | 30.0 |
| Potassium bromide | 1.4 |
| Potassium iodide | 1.5 mg |
| Hydroxylamine sulfate | 2.4 |
| 4-(N-ethyl-N-β-hydroxyethylamino)-2-methylaniline sulfate | 4.5 |
| Water | q. s. ad 1.0 L |
| pH (adjusted with potassium hydroxide and sulfuric acid) | 10.05. |
| (Bleaching solution) | |
| Ethylenediaminetetraacetic acid ferric ammonium trihydrate salt | 100.0 |
| Ethylenediaminetetraacetic acid disodium salt | 10.0 |
| 3-Mercapto-1,2,4-triazole | 0.03 |
| Ammonium bromide | 140.0 |
| Ammonium nitrate | 30.0 |
| Aq. ammonia (27%) | 6.5 mL |
| Water | q. s. ad 1.0 L |
| pH (adjusted with aq. ammonia and nitric acid) | 6.0. |
| (Fixer) | |
| Ethylenediaminetetraacetic acid disodium salt | 0.5 |
| Ammonium sulfite | 20.0 |
| Aq. soln. of ammonium thiosulfate (700 g/L) | 295.0 mL |
| Acetic acid (90%) | 3.3 |
| Water | q. s. ad 1.0 L |
| pH (adjusted with aq. ammonia and nitric acid) | 6.7 |
| (Stabilizer) | |
| p-Nonylphenoxypolyglycidol (glycidol av. polymn. deg. 10) | 0.2 |
| Ethylenediaminetetraacetic acid | 0.05 |
| 1,2,4-Triazole | 1.3 |
| 1,4-Bis(1,2,4-triazol-1-ylmethyl)piperazine | 0.75 |
| Hydroxyacetic acid | 0.02 |
| Hydroxyethylcellulose (Daicel Chemical Industries, Ltd. HEC SP-2000) | 0.1 |
| 1,2-Benzoisothiazolin-3-one | 0.05 |
| Water | q. s. ad 1.0 L |
| pH | 8.5. |

The specified photographic speed of sample 101 determined by the above-mentioned method was ISO 650.

(Sensitivity)

The sensitivity of the respective samples was determined in the same manner as the fore-mentioned specific photo sensitivity.

(Evaluation of Charge Adjusting Ability Test)

Each of the samples was processed to 135 format, one stored in a film patrone (cartridge) was installed in a camera, high speed winding-up was carried out under environment of a temperature of 15° C. and a humidity of 15%, and after development was carried out by the under-mentioned treatment, fogging was visually observed.

(Evaluation of High Speed Coating Adoptability Test)

The particle diameter of B-1 of 17th layer was changed to 3 μm, and after the solution was coated at 1 m/sec by a slide bead coating system, it was immediately dried and the number of cissings which were generated on the surface of the coating film was visually measured and indicated by the frequency of cissings. The frequency of cissing was that the number of cissings of each of the samples against the number of cissings of the sample 101 was shown by percentage, and when it was 100 or less, it was judges as effective for suppressing cissings.

(Evaluation of Processing Variation)

The processing variation was evaluated in the following manner. The color development step in the above processing method was carried out for 2 minutes 45 seconds and 3 minutes 15 seconds, the density difference of fog +0.2 was measured and represented by a relative value when the density difference of Sample 101 was referred to as 100. It is represented that the less from 100 the value is, the less the processing variation is.

TABLE 6

| Sample No. | Emulsion name 6th layer | 11th layer | 15th layer | 17th layer Compound(A) | Silver amount (mg/m$^2$) | specified photographic speed | Static-induced fog | Cissing frequency | Processing variation | Remark |
|---|---|---|---|---|---|---|---|---|---|---|
| 101 | A | F | K | W-1 | 8.5 | 650 | ○ | 100 | 100 | Comp. |
| 102 | A-1 | F-1 | K-1 | W-1 | 8.5 | 800 | X | 105 | 85 | Comp. |
| 103 | A-2 | F-2 | K-2 | W-1 | 8.5 | 800 | X | 102 | 90 | Comp. |
| 104 | A-3 | F-3 | K-3 | W-1 | 8.5 | 805 | X | 106 | 87 | Comp. |
| 105 | A-4 | F-4 | K-4 | W-1 | 8.5 | 795 | X | 105 | 80 | Comp. |
| 106 | A | F | K | FA-4 | 8.5 | 680 | ○ | 70 | 95 | Comp. |
| 107 | A-1 | F-1 | K-1 | FA-4 | 8.5 | 815 | ○ | 70 | 75 | Inv. |
| 108 | A-2 | F-2 | K-2 | FA-4 | 8.5 | 820 | ○ | 69 | 77 | Inv. |
| 109 | A-3 | F-3 | K-3 | FA-4 | 8.5 | 820 | ○ | 70 | 76 | Inv. |
| 110 | A-4 | F-4 | K-4 | FA-4 | 8.5 | 810 | ○ | 74 | 78 | Inv. |
| 111 | A | F | K | FB-1 | 8.5 | 675 | ○ | 67 | 96 | Comp. |
| 112 | A-1 | F-1 | K-1 | FB-1 | 8.5 | 810 | ○ | 67 | 76 | Inv. |
| 113 | A-2 | F-2 | K-2 | FB-1 | 8.5 | 815 | ○ | 69 | 79 | Inv. |
| 114 | A-3 | F-3 | K-3 | FB-1 | 8.5 | 810 | ○ | 65 | 75 | Inv. |
| 115 | A-4 | F-4 | K-4 | FB-1 | 8.5 | 810 | ○ | 70 | 77 | Inv. |
| 116 | A-1 | F-1 | K-1 | FC-2 | 8.5 | 805 | ○ | 65 | 76 | Inv. |
| 117 | A-2 | F-2 | K-2 | FC-2 | 8.5 | 810 | ○ | 66 | 77 | Inv. |
| 118 | A-3 | F-3 | K-3 | FC-2 | 8.5 | 805 | ○ | 70 | 79 | Inv. |
| 119 | A-4 | F-4 | K-4 | FC-2 | 8.5 | 810 | ○ | 68 | 78 | Inv. |

The results of the sensitivity, charge adjustability property (static-induced fog), high-speed coating adoptability (cissing frequency) and processing variation of Samples 101 to 119 are shown in Table 6. The static-induced fog of Table 6 was described as ○ when there is no generation and as X when generation was observed.

It is grasped from Table 6 that although the compounds of the present invention, whose one-electron oxidation product capable of, through subsequent bond cleavage reaction or bond formation reaction, releasing one or more electrons, attain sensitivity enhancement and the lessening of the processing variation, the generation of cissing is much and constitution in the high-speed coating adoptability is fragile from the results of Samples 102 to 105. Further, it was surprisingly cleared that the static-induced fog was generated.

On the other hand, it was cleared from Samples 107 to 110 and 112 to 119 that a remarkable effect appeared for the static-induced fog and the generation of cissing in spite of high sensitivity, by using the fluorine base compound represented by the compound (A) of the invention. Further, it was unexpectedly cleared that the further improvement of the lessening of the processing variation was attained.

EXAMPLE 2

(Preparation of Samples 201 and 202)

The silver coating amounts as shown in Table 7 were set by reducing the silver coating amounts of the emulsion layer for Sample 101 of Example 1.

(Preparation of Samples 203 to 206)

Samples 203 to 206 were prepared in such a manner that for Sample 101, compound 22 whose one-electron oxidation product capable of, through subsequent bond cleavage reaction or bond formation reaction, releasing one or more electrons were added at the addition amounts of $3.0\times10^{-7}$ mol/molAg with respect to emulsions Em-A to Em-J and $3.0\times10^{-6}$ mol/molAg with respect to emulsions Em-K to Em-N, and the silver coating amounts were changed as shown in Table 7 by reducing the silver coating amounts of the emulsion layer.

(Preparation of Samples 207 to 210)

Samples 207 to 210 were prepared in such a manner that for Sample 203, compound whose one-electron oxidation product capable of, through subsequent bond cleavage reaction or bond formation reaction, releasing one or more electrons were added at 2-fold addition amount, and the silver coating amounts were changed as shown in Table 7 by reducing the silver coating amounts of the emulsion layer.

TABLE 7

| Sample No. | Emulsion layer Type 1 or 2 | 17th layer Compound(A) | Silver amount (mg/m$^2$) | specified photographic speed | Static-induced fog | Cissing frequency | Processing variation | Radiation fog | Remark |
|---|---|---|---|---|---|---|---|---|---|
| 101 | Absence | W-1 | 8.5 | 650 | ○ | 100 | 100 | 100 | Comp. |
| 108 | Presence | FA-4 | 8.5 | 820 | ○ | 69 | 77 | 100 | Inv. |
| 201 | Absence | W-1 | 7.4 | 500 | ○ | 101 | 110 | 90 | Comp. |
| 202 | Absence | W-1 | 5.4 | 400 | ○ | 100 | 119 | 70 | Comp. |
| 203 | Presence | W-1 | 7.4 | 750 | X | 101 | 80 | 90 | Comp. |

TABLE 7-continued

| Sample No. | Emulsion layer Type 1 or 2 | 17th layer Compound(A) | Silver amount ($mg/m^2$) | specified photographic speed | Static-induced fog | Cissing frequency | Processing variation | Radiation fog | Remark |
|---|---|---|---|---|---|---|---|---|---|
| 204 | Presence | FA-4 | 7.4 | 745 | ○ | 71 | 80 | 88 | Inv. |
| 205 | Presence | FB-1 | 7.4 | 750 | ○ | 70 | 82 | 89 | Inv. |
| 206 | Presence | FC-2 | 7.4 | 745 | ○ | 70 | 80 | 87 | Inv. |
| 207 | Presence | W-1 | 5.4 | 675 | X | 100 | 84 | 67 | Comp. |
| 208 | Presence | FA-4 | 5.4 | 680 | ○ | 70 | 83 | 68 | Inv. |
| 209 | Presence | FB-1 | 5.4 | 680 | ○ | 74 | 85 | 67 | Inv. |
| 210 | Presence | FC-2 | 5.4 | 680 | ○ | 67 | 83 | 66 | Inv. |

The results of the sensitivity, charge adjustability property (static-induced fog), high-speed coating adoptability (cissing frequency), processing variation and radiation fog of Samples 101, 108, 201 to 210 are shown in Table 7. The evaluation of radiation fog was carried out by the following method.

(Evaluation of Radiation Fog)

After the γ ray (1.173 and 1.333 MeV) of a radiation isotope element $^{60}Co$ was irradiated to respective samples by 0.2 R, and the above processing was carried out to measure a density value of fog. A density difference between the fog values of each samples and the fog value of the above sample whose sensitivity had been determined. The obtained value was represented by a relative value when the density difference of Sample 101 was referred to as 100. The less the value is, the less the fog fluctuation is.

It was cleared from Table 7 that although the improvement in the static-induced fog could not be compatible with the reduction in the radiation fog and processing variation by reducing the silver coating amount, all constitutions could be improved by using in combination the compound (A) of the invention and the compound of the invention whose one-electron oxidation product capable of, through subsequent bond cleavage reaction or bond formation reaction, releasing one or more electrons.

EXAMPLE 3

Multi-layered color photosensitive materials were prepared in the same manner as in Samples 101 to 119 of Example 1 and Samples 201 to 210 of Example 2 except that polyethylene phthalate described in the Example 1 of JP-A-2002-144493 was used as the support. Similar experiment was carried out, and the effect of the present invention could be confirmed.

What is claimed is:

1. A silver halide color photosensitive material comprising a support and, superimposed thereon, at least one red-sensitive layer, at least one green-sensitive layer, at least one blue-sensitive layer and at least one protective layer, at least one of the layers containing at least one compound selected from a group consisting of the following type 1 and type 2, and at least one of the layers containing at least one fluorine compound represented by the following general formula (A):

(Type 1)

Compound which undergoes a one-electron oxidation so as to form a one-electron oxidation product capable of, through subsequent bond cleavage reaction, releasing one or more electrons;

(Type 2)

Compound which undergoes a one-electron oxidation so as to form a one-electron oxidation product capable of, after subsequent bond formation reaction, releasing one or more electrons;

Rf—X-M General formula (A):

wherein Rf represents a single perfluorinated alkyl group containing 2 to 6 carbons; X represents a divalent coupling group that contains a non-fluorinated ethylene linkage attached to R; and M represents a single anionic group, a single cationic group or a single betaine group.

2. The silver halide color photosensitive material according to claim 1, wherein the total amount of silver contained in the photosensitive material is 7.5 $mg/m^2$ or less.

3. The silver halide color photosensitive material according to claim 1, wherein the total amount of silver contained in the photosensitive material is 5.5 $mg/m^2$ or less.

4. A silver halide color photosensitive material comprising a support and, superimposed on one side thereof, at least one red-sensitive layer, at least one green-sensitive layer, at least one blue-sensitive layer and at least one protective layer, at least one of the layers containing at least one compound selected from a group consisting of the following type 1 and type 2, and at least one of the layers containing at least one fluorine compound represented by the following general formula (A), and an antistatic layer being applied on the other side of the support:

(Type 1)

Compound which undergoes a one-electron oxidation so as to form a one-electron oxidation product capable of, through subsequent bond cleavage reaction, releasing one or more electrons;

(Type 2)

Compound which undergoes a one-electron oxidation so as to form a one-electron oxidation product capable of, after subsequent bond formation reaction, releasing one or more electrons, Rf—X-M General formula (A):

wherein Rf represents a single perfluorinated alkyl group containing 2 to 6 carbons; X represents a divalent coupling group that contains a non-fluorinated ethylene linkage attached to R; and M represents a single anionic group, a single cationic group or a single betaine group.

5. The silver halide color photosensitive material according to claim 4, wherein the total amount of silver contained in the photosensitive material is 7.5 $mg/m^2$ or less.

6. The silver halide color photosensitive material according to claim 4, wherein the total amount of silver contained in the photosensitive material is 5.5 $mg/m^2$ or less.

* * * * *